US008160471B2

(12) United States Patent
Jimba et al.

(10) Patent No.: US 8,160,471 B2
(45) Date of Patent: Apr. 17, 2012

(54) DEVELOPER SUPPLY CONTAINER

(75) Inventors: Manabu Jimba, Toride (JP); Ayatomo Okino, Moriya (JP); Toshiaki Nagashima, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 345 days.

(21) Appl. No.: 12/617,120

(22) Filed: Nov. 12, 2009

(65) Prior Publication Data

US 2010/0119265 A1 May 13, 2010

(30) Foreign Application Priority Data

Nov. 13, 2008 (JP) ..... 2008-291560

(51) Int. Cl.
*G03G 15/08* (2006.01)

(52) U.S. Cl. ..... 399/106; 399/263

(58) Field of Classification Search ..... 399/102, 399/103, 105, 262, 263
See application file for complete search history.

(56) References Cited

U.S. PATENT DOCUMENTS

| | | | | |
|---|---|---|---|---|
| 6,879,789 | B2 | 4/2005 | Yamada et al. | |
| 6,920,298 | B2 * | 7/2005 | Yamada et al. | 399/106 |
| 6,985,686 | B2 | 1/2006 | Okino et al. | |
| 6,993,273 | B2 | 1/2006 | Yamada | |
| 7,155,138 | B2 * | 12/2006 | Yamada | 399/106 |
| 7,266,330 | B2 | 9/2007 | Murakami et al. | |
| 7,412,192 | B2 | 8/2008 | Nakajima et al. | |
| 7,426,363 | B2 | 9/2008 | Murakami et al. | |
| 7,433,634 | B2 | 10/2008 | Okino et al. | |
| 7,469,113 | B2 * | 12/2008 | Yamada et al. | 399/106 |
| 2007/0104505 | A1 | 5/2007 | Murakami et al. | |
| 2009/0129813 | A1 | 5/2009 | Nagashima et al. | |
| 2009/0185824 | A1 | 7/2009 | Murakami et al. | |
| 2009/0297226 | A1 | 12/2009 | Nagashima et al. | |

FOREIGN PATENT DOCUMENTS

| | | | |
|---|---|---|---|
| JP | 7-5759 | A | 1/1995 |
| JP | 10-63078 | A | 3/1998 |
| JP | 2002-318490 | A | 10/2002 |

* cited by examiner

*Primary Examiner* — David Gray
*Assistant Examiner* — Gregory H Curran
(74) *Attorney, Agent, or Firm* — Fitzpatrick, Cella, Harper & Scinto

(57) ABSTRACT

A developer supply container detachably mountable to an image forming apparatus includes a rotatable container body provided with a portion-to-be-engaged on an inner surface thereof; an opening for permitting discharging of the developer; a sealing portion for sealing the opening; an extended portion being displaceable toward a rotational axis of the container body; an engaging portion engageable with the portion-to-be-engaged; and a limiting portion to substantially hold the sealing portion in a sealing position by engagement between the engaging portion and the portion-to-be-engaged, and a non-limiting portion to permit the relative movement of the sealing portion by disengagement between the engaging portion and the portion-to-be-engaged.

15 Claims, 35 Drawing Sheets

(a)

(b)

(a)

(b)

(a)

(b)

DEVELOPER SUPPLY CONTAINER

FIELD OF THE INVENTION AND RELATED ART

The present invention relates to a developer supply container which is removably mountable in an image forming apparatus.

In the field of an electrophotographic image forming apparatus, such as an electrophotographic copying machine, an electrophotographic printer, etc., it is common practice for use microscopic particles of developer to be used for image formation. As the developer is consumed by an electrophotographic image forming apparatus, the apparatus is supplied with developer from the developer container in the apparatus, which is removably mountable in the image forming apparatus.

Developer is in the form of extremely microscopic powder. Therefore, if developer is mishandled, it is possible for developer to scatter. Thus, it has been proposed, and has been put to practical use, to keep a developer supply container in an image forming apparatus, and discharge developer from the developer supply container little by little from the small developer outlet, with which the developer supply container is provided.

In the case of a developer supply container, such as the one described above, the developer outlet of the developer supply container is kept sealed by a sealing member to prevent developer from leaking from the developer container. Further, the developer supply container is designed in such a manner that as it reduces in the amount of the developer therein, it prompts an operator to replace the developer supply container in the image forming apparatus, with a new one. However, if the developer outlet of a developer supply container fails to be properly sealed by a sealing member, it is possible that when the operator replaces the old developer supply container with a new one, the sealing member will dislodges from its preset sealing position relative to the developer supply container. Therefore, it is possible that the adjacencies of the developer supply container will be soiled by the developer as it leaks from the improperly sealed developer outlet of the developer supply container.

Thus, there have been proposed various structural arrangements for preventing developer from the leaking from a conventional developer supply container through its developer outlet. According to one of the proposal (Japanese Laid-open Patent Application 2002-318490, the leaking of developer from the developer outlet of the developer supply container is prevented by providing the sealing member with a sealing portion formed of an elastic material, in order to allow the external diameter of the sealing portion of the sealing member to be slightly larger than the internal diameter of the developer outlet.

However, the above-described structural arrangement will possibly create the following problem. That is, in order to ensure that the sealing portion will reliably keep the developer outlet airtightly sealed, the external diameter of the sealing portion of the sealing member has to be rendered substantially larger than the internal diameter of the developer outlet of the developer supply container. Therefore, the following problem may occur.

That is, in order to supply the developing apparatus with developer, it is necessary to unseal the developer outlet by moving the sealing member from the developer outlet. Thus, if the sealing portion of the sealing member is increased in external diameter to keep the developer outlet airtightly sealed, it becomes difficult for the sealing member to be disengaged from the developer outlet. In other words, the amount of force (unsealing force) necessary to unseal the develop supply container becomes very large.

More concretely, in the case of an image forming apparatus structured so that its sealing member is to be opened by an operator, the amount of force required of an operator to open the developer supply container will be substantial, and therefore, the image forming apparatus will be reduced in terms of usability.

In the case of an image forming apparatus structured so that its sealing member is disengaged with the use of a power source, instead of an operator, the various components involved in the unsealing of the developer supply container have to be reinforced, and also, the power source for disengaging the sealing member has to be increased in output. Thus, this structural arrangement is disadvantageous from the standpoints of the size and cost reduction of the main assembly of an image forming apparatus.

SUMMARY OF THE INVENTION

The primary object of the present invention is to provide a developer supply container which is satisfactory in opposing two functional properties, that is, sealability and unsealability.

According to an aspect of the present invention, there is provided a developer supply container detachably mountable to an image forming apparatus comprising a rotatable container body provided with an inside space containing a developer, said container body being provided with a portion-to-be-engaged on an inner surface thereof; an opening, provided at one end with respect to a direction of a rotational axis of container body, for permitting discharging of the developer from the inside space; a sealing portion for sealing said opening, said sealing portion being movable relative to said container body in the direction of the rotational axis between a sealing position for sealing said opening and an unsealing position for unsealing said opening; an extended portion extended from said sealing portion toward an inside of said container body and movable integrally with said sealing portion in the rotational axis direction, said extended portion being displaceable toward the rotational axis; an engaging portion provided at a free end portion of said extended portion and engageable with said portion-to-be-engaged; and a limiting portion movable between a limiting position in which displacement of said extended portion toward the rotational axis is limited to substantially hold said sealing portion in said sealing position by engagement between said engaging portion and said portion-to-be-engaged, and a non-limiting position in which displacement of said extended portion toward the rotational axis is permitted to permit the relative movement of said sealing portion by disengagement between said engaging portion and said portion-to-be-engaged.

According to another aspect of the present invention, there is provided a developer supply container detachably mountable to an image forming apparatus, said developer supply container comprising: a rotatable container body provided with an inside space containing a developer, said container body being provided with a portion-to-be-engaged on an inner surface thereof; an opening, provided at one end with respect to a direction of a rotational axis of container body, for permitting discharging of the developer from the inside space; a sealing portion for sealing said opening, said sealing portion being movable relative to said container body in the direction of the rotational axis between a sealing position for sealing said opening and an unsealing position for unsealing said opening; an extended portion extended from said sealing portion toward an inside of said container body and movable integrally with said sealing portion in the rotational axis direction, said extended portion being elastically deformable toward the rotational axis; an engaging portion provided at a free end portion of said extended portion and engageable with said portion-to-be-engaged; and a limiting portion movable between a limiting position in which an elastical deformation of said extended portion toward the rotational axis is limited to substantially hold said sealing portion in said sealing position by engagement between said engaging portion and said portion-to-be-engaged, and a non-limiting position in which an elastical deformation of said extended portion toward the rotational axis is permitted to permit the relative movement of said sealing portion by disengagement between said engaging portion and said portion-to-be-engaged.

These and other objects, features, and advantages of the present invention will become more apparent upon consideration of the following description of the preferred embodiments of the present invention, taken in conjunction with the accompanying drawings.

BRIEF DESCRIPTION OF THE DRAWINGS

FIG. 5(*b*) is an enlarged partial sectional view of the sealing portion and developer outlet; FIG. 5(*c*) is a perspective view of the combination of the sealing member and sealing member unlocking member; and FIG. 5(*d*) is a partially cut-out perspective view of the combination of the sealing member, and the main assembly of the developer supply container, which shows the relationship between the sealing member and container proper.

FIGS. 13(*a*) and 13(*b*) are drawings for describing the operation for transmitting the developer supply container driving force to the container.

FIG. 33(*b*) is an enlarged sectional view of the combination of a part of the sealing portion, and the developer outlet.

DETAILED DESCRIPTION OF THE PREFERRED EMBODIMENTS

Hereinafter, the developer supply containers in the preferred embodiments of the present invention will be described in more detail with reference to the appended drawings.

Embodiment 1

First, referring to FIG. 1, an example of an image forming apparatus in which a developer supply container in accordance with the present invention is removably mountable will be described.

[Image Forming Apparatus]

Figure 1:
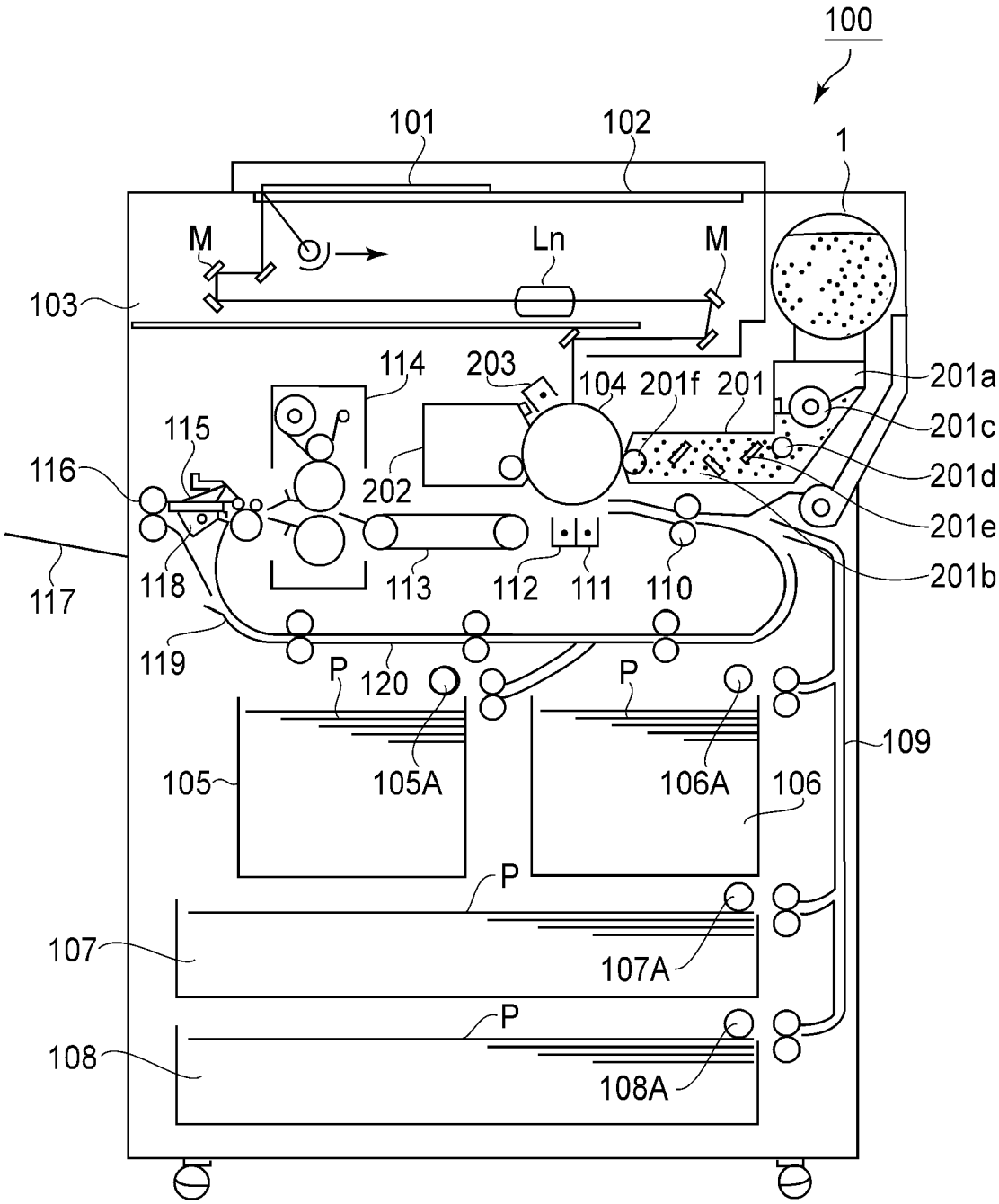
FIG. 1 is a sectional view of the image forming apparatus, in the first preferred embodiment of the present invention, in which a developer supply container in accordance with the present invention is removably mountable. It shows the general structure of the apparatus.

The main assembly of the image forming apparatus 100 (which hereafter will be referred to simply as "apparatus main assembly") of the image forming apparatus shown in FIG. 1 is provided with an original placement platen 102 formed of glass; an optical portion made up of multiple mirrors M and lenses L; and an electrophotographic photosensitive member 104 (which hereafter will be referred simply as "photosensitive drum"), which is an image bearing member in the form of a drum. As an original 101 is placed on the original placement glass platen 102, an optical image, which reflects the information of the original 101, is focused on the photosensitive drum 104 by the multiple mirrors M and lenses L.

The apparatus main assembly is provided with cassettes 105, 106, 107, and 108, in which recording mediums P (which hereafter may be referred to simply as "recording paper") are stored in layers. The most suitable recording paper P for a given image forming operation is selected among the various recording media P in these cassettes, in response to the information inputted by an operator (user) through the control portion 100*a* shown in FIG. 2, or based on the size of the original 101. Incidentally, the recording medium P does not need to be limited to recording paper. For example, an OHP sheet, and the like, may be selected as the recording medium as necessary.

Each of the selected recording papers P is fed into the apparatus main assembly, while being separated from the rest, by feeding-and-separating apparatus 105A, 106A, 107A, or 107A, and then, is conveyed to a pair of registration rollers 110 by way of a recording medium conveyance passage 109. Then, the recording paper P is conveyed to the transfer portion by the pair of registration rollers 110 in such a manner that the rotation of the photosensitive drum 104 synchronizes with the photosensitive drum scanning timing of the optical portion 103. In the transfer portion, the image formed of developer on the peripheral surface of the photosensitive drum 104 is transferred onto the recording paper P by a transfer discharging device 111. After the transfer of the image formed of developer, onto the recording paper P, the recording paper P is separated from the photosensitive drum 104 by a separation discharging device 112.

Thereafter, the recording paper P is conveyed to a fixing portion 114 by a conveying portion 113. In the fixing portion 114, the image formed of developer, on the recording paper P, is fixed to the recording paper P by heat and pressure. When the image forming apparatus in the one-side copying mode, the recording paper P is discharged into a delivery tray 117 by a pair of discharge rollers 116, simply through a discharging-and-reversing portion 115. When the image forming apparatus is in the two-sided mode, the movement of the recording paper P is controlled by the flapper 118 of the discharge-and-reversing portion 115. That is, the recording paper P is conveyed to the pair of registration rollers 110 by way of recording paper re-feeding passages 119 and 120. Then, the recording paper P is discharged after being conveyed through the same recording medium conveyance passages as those through which the recording medium P is conveyed when the image forming apparatus is in the one-side copying mode.

When the image forming apparatus is in the multilayer copying mode, after the formation of an image on one surface of the recording paper P, the recording paper P is almost discharged from the apparatus main assembly 100 by the pair of discharge rollers 116 through the recording paper discharging-and-reversing passage 115. Then, the flapper 118 is controlled with such timing that the trailing end of the recording paper P has passed the flapper 118, but is still remaining pinched by the pair of discharge rollers 116, and at the same time, the pair of discharge rollers 116 is rotated in reverse. As a result, the recording paper P is conveyed back into the apparatus main assembly 100. Then, the recording paper P is conveyed to the pair of registration rollers 110 by way of the recording paper re-feeding portions 119 and 120. Then, the recording paper P is conveyed through the same recording paper passage as it is conveyed when the image forming apparatus is in the one-side copying mode. Then, it is discharged into the delivery tray 117.

The apparatus main assembly 100 structured as described above is provided with a developing apparatus 201 (as a developing means), a cleaning apparatus 202, a primary charging device 203, etc., which are disposed in the adjacencies of the peripheral surface of the photosensitive drum 104.

In an image forming operation, the peripheral surface of the photosensitive drum 104 is uniformly charged, and an electrostatic latent image is formed on the uniformly charged peripheral surface of the photosensitive drum 104 by exposing the charged surface with the optical portion 103. Then, the electrostatic latent image is developed by the developing apparatus 201, which uses developer. The developing apparatus 201 is supplied with toner (as developer) by a developer supply container 1, which is for supplying the developing apparatus with toner. The developer supply container 1 is removably mounted in the apparatus main assembly 100 by an operator.

Incidentally, the present invention is applicable to both a case in which only toner is supplied from the developer supply container 1 to the main assembly of an image forming apparatus, and a case in which both toner and carrier are supplied from the developer supply container 1 to an image forming apparatus. Here, the first case will be described.

The developing apparatus 201 has a developer hopper 201*a* (developer storing-and-holding means) and a developing device 201*b*. The developer hopper 201*a* has a stirring member for stirring the developer supplied from the developer supply container 1. After being stirred by the stirring member 201*c*, the developer is sent to the developing device 201*b* by a magnetic roller 201*d*. The developing device 201*b* has a development roller 201*f* and developer conveying members 201*e*. The developer is sent to the developer hopper 201*a* by the magnetic roller 201*d*, and then, is sent to the development roller 201*f* by the developer conveying members 201*e*. Then, the developer is supplied to the peripheral surface of the photosensitive drum 104 by the development roller 201*f*.

The cleaning apparatus 202 is for removing the developer which is remaining on the photosensitive drum 104. The primary charging device 203 is for charging the photosensitive drum 104.

Figure 2:
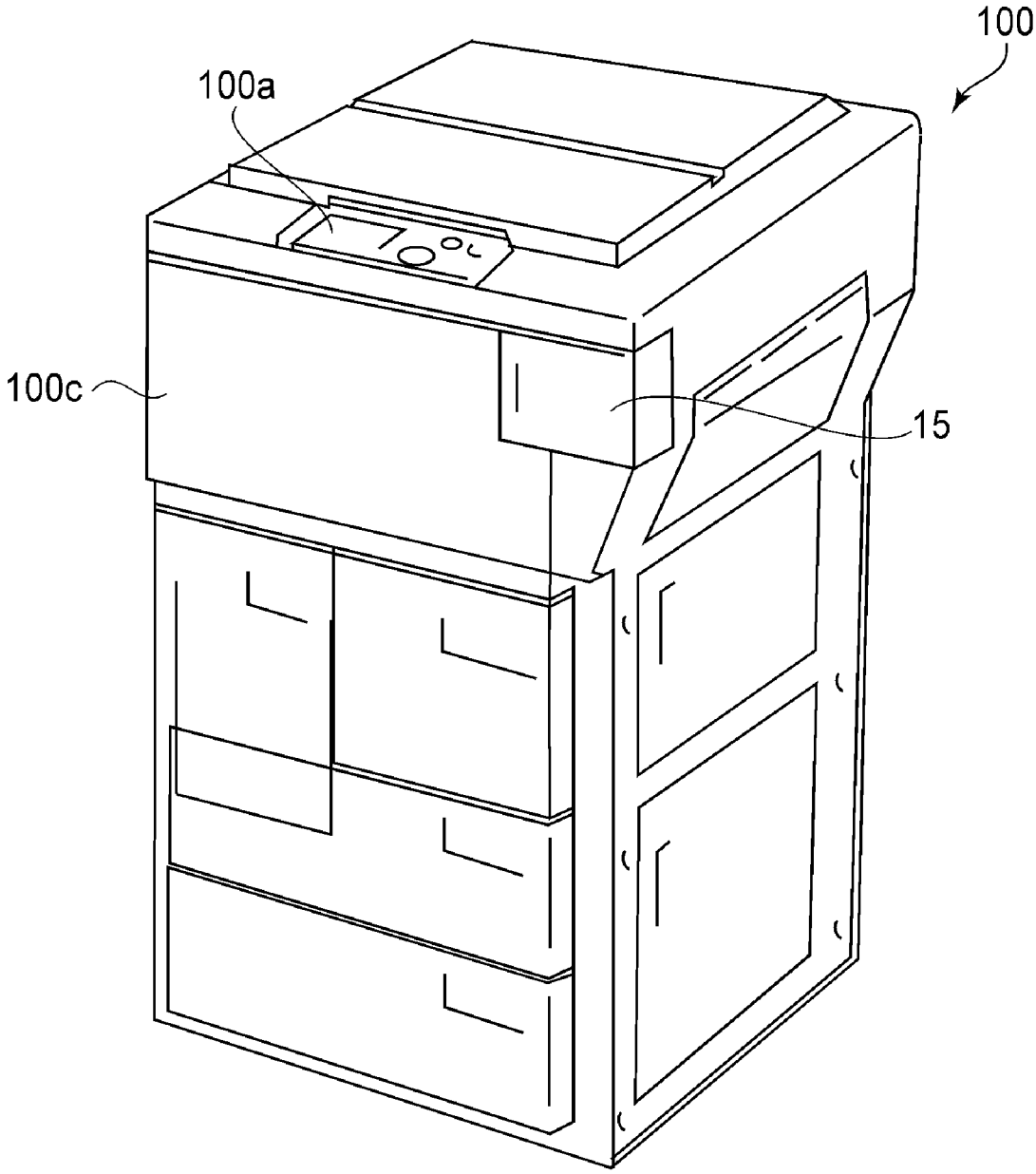
FIG. 2 is a perspective view of the image forming apparatus, in the first preferred embodiment of the present invention. It shows the general structure of the apparatus.
Figure 3:
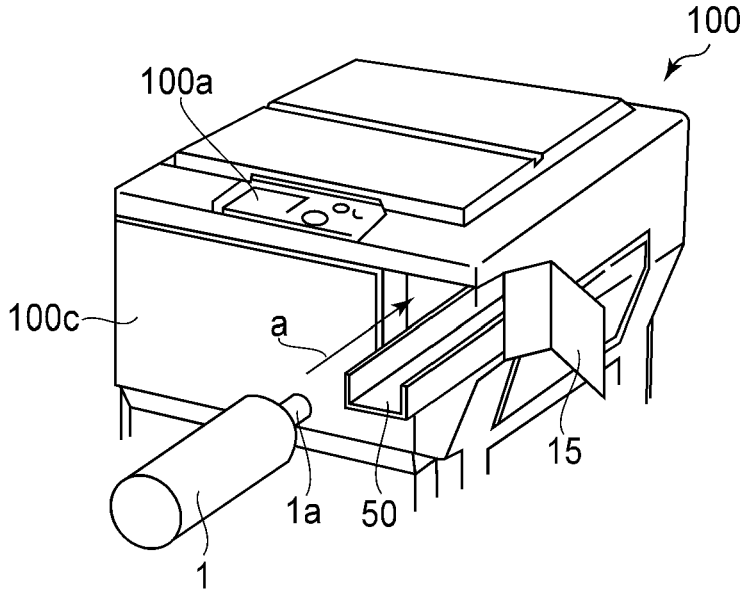
FIG. 3 is an enlarged perspective view of the developer supply container chamber in the image forming apparatus in FIG. 1.

Designated by a referential number 15 in FIG. 2 is a cover for replacing the developer supply container 1. The developer supply container replacement cover 15 (which hereafter will be referred to simply as "replacement front cover") is a part of the external shell of the image forming apparatus. Referring to FIG. 3, as the replacement front cover 15 is opened by an operator, a developer supply container holder 50, which is a part of the developer supply container mounting means, is pulled out to a preset position by a driving means (unshown). The developer supply container 1 is to be mounted on the developer supply container holder 50. If the operator wants to remove the developer supply container 1 from the apparatus main assembly 100, the operator is to pull the developer supply container holder 50 from the apparatus main assembly 100, and to remove the developer supply container 1 on the developer supply container holder 50.

The replacement front cover 15 is a cover dedicated to the mounting or removal (replacement) of the developer supply container 1, and is opened or closed only for mounting or dismounting the developer supply container 1. For the maintenance of the apparatus main assembly 100, a front cover 100*c* is opened.

Incidentally, the usage of the developer supply container holder 50 is not mandatory. That is, the apparatus main assembly may be structured so that the developer supply container 1 is directly mounted in the apparatus main assembly 100, or directly taken out of the apparatus main assembly 100.

[Developer Supply Container]

Next, referring to FIGS. 4 and 5, the developer supply container 1 in this embodiment will be described.

Figure 4:
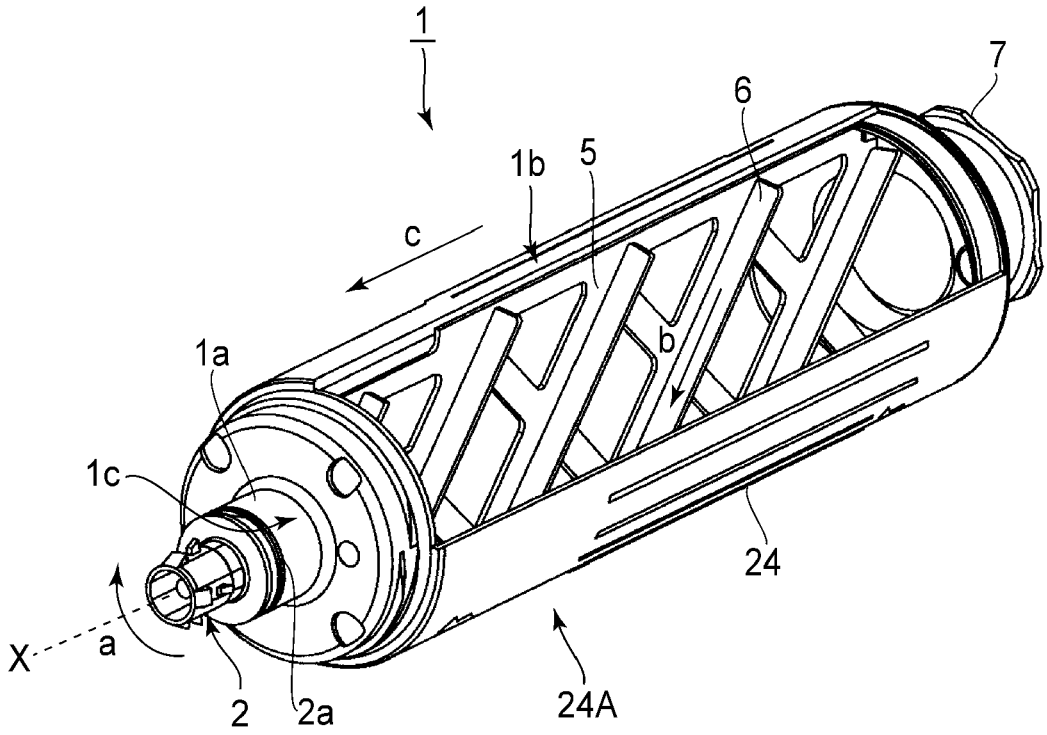
FIG. 4 is a partially broken perspective view of the developer supply container in the first preferred embodiment of the present invention.

FIG. 4 is a perspective view of the developer supply container 1 in this embodiment. Referring to FIG. 4, the developer supply container 1 has a large diameter portion 1*b* and a small diameter portion 1*c*. It has a container proper 24A. The container proper 24A has a developer storage portion 24 and a flange 7. The developer storage portion 24 is provided with a developer outlet 1*a*, which is roughly at the center of the small diameter portion 1*c*. The flange 7 is located at the other end of the developer storage portion 24 from the developer outlet 1*a*. The developer supply container 1 is provided with a developer conveying member 5 (which hereafter may be referred to as "baffling member"), which is in the developer storage portion 24. Further, the developer supply container 1 is provided with a sealing member 2, which is disposed in such a manner that it can seal the developer outlet 1*a*. Next, referring to FIGS. 5(*a*), 5(*b*), 5(*c*), and 5(*d*), the developer supply container 1 is provided with a sealing member unlocking member 3 (regulating portion) for unlocking the sealing member 2 to allow the sealing member 2 to move in the direction indicated by a referential code a (or b).

First, referring to FIG. 4, the internal structure of the developer supply container 1 will be described.

[Conveying Member]

The container proper 24A of the developer supply container 1 is roughly cylindrical. The container proper 24A and apparatus main assembly 100 are structured in such a manner that the container proper 24*a* is roughly horizontally, and rotatably, placed in the apparatus main assembly 100. It rotates as it is rotationally driven by the apparatus main assembly 100.

The container proper 24A of the developer supply container 1 is provided with the internal baffling member 5 (baffling plate) as described before. Each of the primary surfaces of the baffling member 5 is provided with multiple ribs, which are slanted relative to the rotational axis of the developer supply container 1. The end of one of the slanted ribs 6 is in contact with the small diameter portion 1*c*. The developer supply container 1 is structured so that the developer in the developer supply container 1 is conveyed toward the developer outlet 1*a* by the multiple slanted ribs 6, and is discharged from the developer supply container 1 through the developer outlet 1*a*.

The principle based on which the developer is discharged is as follows. That is, referring to FIG. 4, as the developer supply container 1 is rotated in the direction a, the developer is lifted by the baffling members 5, and then, slides down on the slanted ribs 6 in the direction b, being eventually conveyed to the developer outlet 1*a* of the developer supply container 1 by the slanted ribs 6. As this operation is continued, the developer in the developer supply container 1 is gradually discharged from the developer supply container 1 through the developer outlet 1*a* while being stirred.

The method for driving the developer supply container 1 does not need to be limited to the above described one in this embodiment, that is, the rotational driving of the developer supply container 1. For example, the developer supply container 1 may be vibrated, shaken, etc., to discharge the developer through the developer outlet 1*a*. In other words, as long as the developer is properly discharged through the developer outlet 1*a*, the method for driving the developer supply container 1 does not matter.

That is, as long as the apparatus main assembly 100 and developer supply container 1 are structured so that as the developer supply container 1 is driven by the apparatus main assembly 100, the developer is properly discharged from the developer supply container 1, the developer supply container 1 may be driven by any of the abovementioned methods; it may be rotated, swung back and forth, or vibrated.

Further, as long as the developer in the developer supply container 1 is properly discharged from the developer supply container 1, the means for conveying the developer in the developer supply container 1 to the developer outlet 1*a* as the developer supply container 1 is driven as described above does not need to be limited to the baffling member 5. For example, the internal surface of the cylindrical portion of the developer storage portion 24 may be provided with a spiral rib(s) (developer conveying portion(s)), or a spiral groove(s) (developer conveying portion(s)). In terms of developer stirring performance, the spiral groove is inferior to the baffling member 5. However, the spiral groove can be integrally formed as a part of the developer storage portion 24, and therefore, is advantageous in terms of cost. Thus, it is desired that the method for conveying the developer in the developer supply container 1 and the method for driving the developer supply container 1 are properly selected based on the required specifications for an image forming apparatus.

[Sealing Member]

Next, referring to FIGS. 5(*a*), 5(*b*), 5(*c*), and 5(*d*), the sealing member 2 used in this embodiment will be described. FIG. 5(*a*) is a front view of the sealing member 2 and the sealing member unlocking member 3, and FIG. 5(*a*) is an enlarged view of a part of the sealing member 2*a*, and a part of the developer outlet 1*a*. FIG. 5(*c*) is a perspective view of the sealing member 2 and sealing member unlocking member 3, and FIG. 5(*d*) is a perspective view of the sealing member 2, as seen from the main portion of the developer supply container 1.

Figure 5:
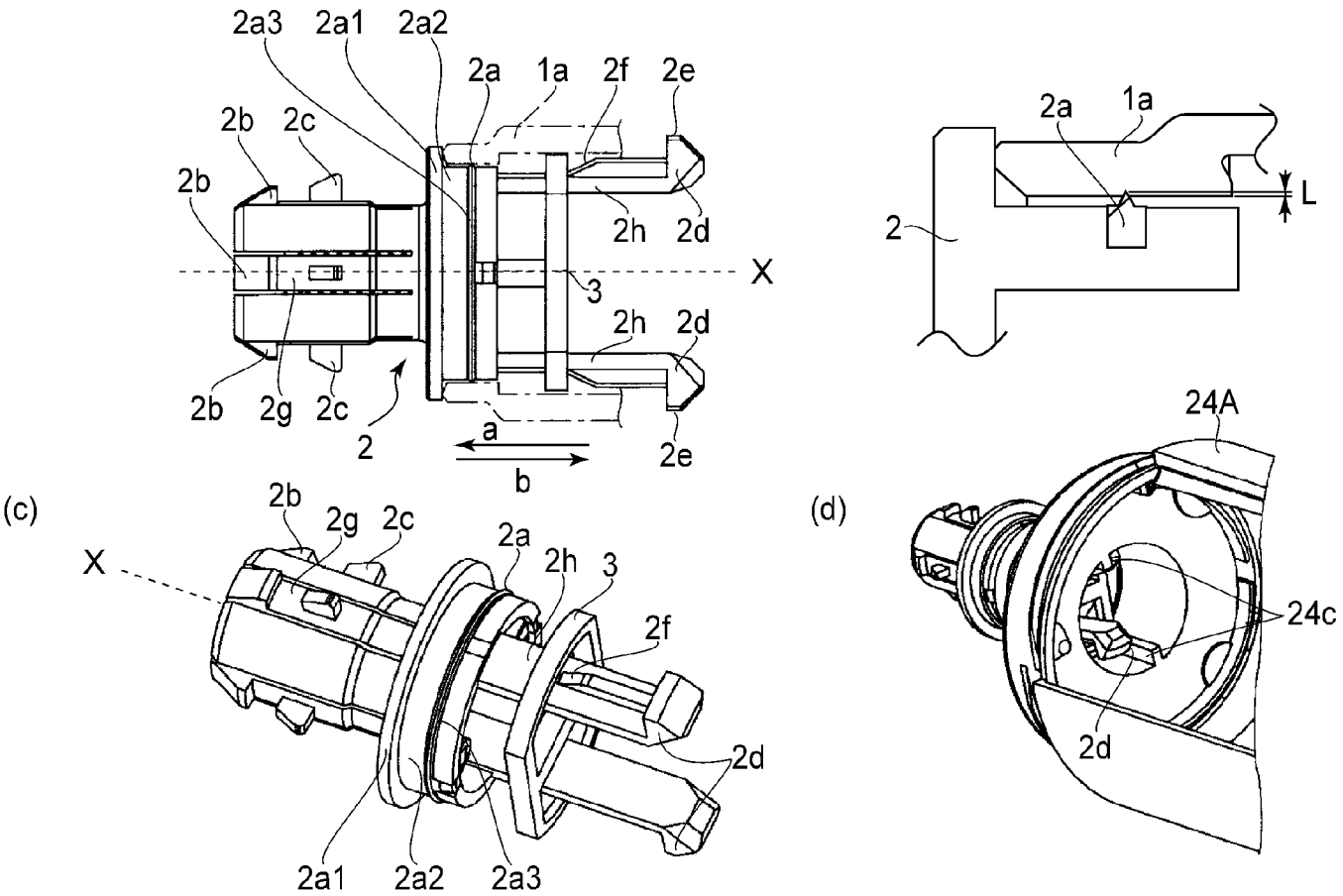
FIG. 5(*a*) is a front view of 2*a* the combination of the sealing member and sealing member unlocking member.

Referring to FIG. 5(*a*), the sealing member 2 has a sealing portion 2*a*, a locking projection 2*b*, an unlocking projection 2*c*, a container driving force transmitting portion 2*d*, a locking portion 2*e*, a tapered unlocking portion 2*f*. Further, the sealing member 2 has a plate-like first portion 2*g* (arm portion) from which the locking projection 2*b* and unlocking projection 2*c* project, and a plate-like second portion 2*f* (arm portion) from which the container driving force transmitting portion 2*d*, locking projection 2*e*, and tapered unlocking projection 2*f* project. The sealing member 2 is made of an elastically deformable resin. The sealing member 2 is injection-molded in such a manner that the abovementioned portions of the sealing member 2 are integrally formed with the main portion of the sealing member 2. The plate-like first portion 2*g* extends in the direction a (parallel to rotational axis X of developer supply container 1). That is, the plate-like first portion 2*g* is an elastically deformable portion (which may be referred to as cantilever arm) of the sealing member 2, and extends away from the container proper 24A. It is structured so that as it is subjected to an external force, it is capable of deforming (elastically deforming) inward of the sealing member 2 in terms of the diameter direction of the developer supply container 1, and also, so that as it is freed from the external force, it is capable of elastically returning where it was before it was subjected to the external force, in the outward direction of the sealing member in terms of the diameter direction of the developer supply container 1. In other words, the plate-like first portion 2*g* is deformable to the adjacencies of the rotational axis X of the container proper 24A by an external force. It is also capable of flexing back in the direction to move away from the rotational axis X as it is freed from the external force.

Similarly, the plate-like second portion 2*h* is an elastically deformable portion (which may be referred to as cantilever arm) of the sealing member 2, and extends away from the container proper. It is structured so that as it is subjected to an external force, it is capable of deforming (elastically deforming) inward of the sealing member 2 in terms of the diameter direction of the developer supply container 1, and also, so that as it is freed from the external force, it is capable of elastically returning where it was before it was subjected to the external force, in the outward direction of the sealing member in terms of the diameter direction of the developer supply container 1. In other words, the plate-like second portion 2*h* is deformable to the adjacencies of the rotational axis X of the container proper by an external force. It is also capable of elastically flexing back in the direction to move away from the rotational axis X as it is freed from the external force.

Next, referring to FIGS. 5-15, the functions of each of the abovementioned portions of the sealing member 2 will be described in detail.

[Sealing Portion]

Figure 6:
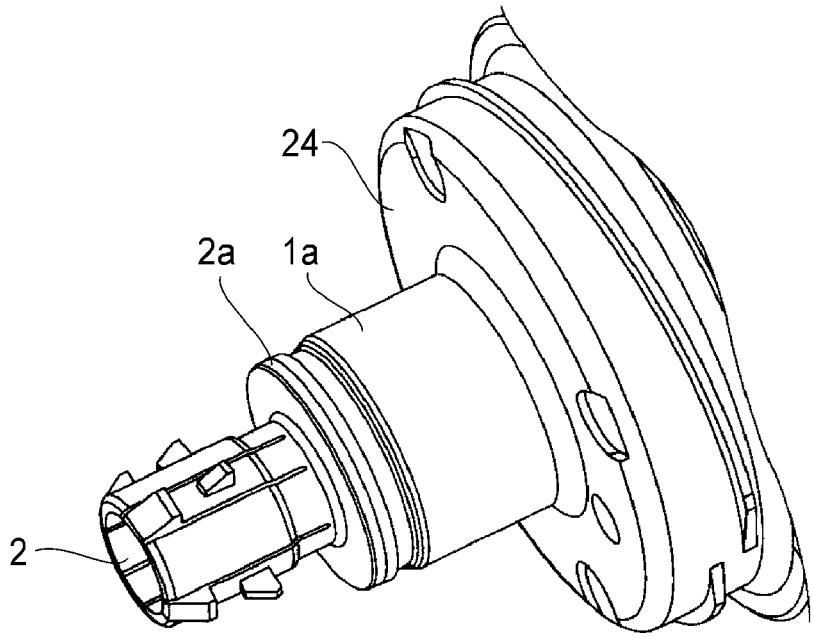
FIG. 6(*a*) is a perspective view of one of the modified versions of the sealing portion in the first preferred embodiment, and FIG. 6(*b*) is a sectional view of the modified version of the sealing portion shown in FIG. 6(*a*).
Figure 6:
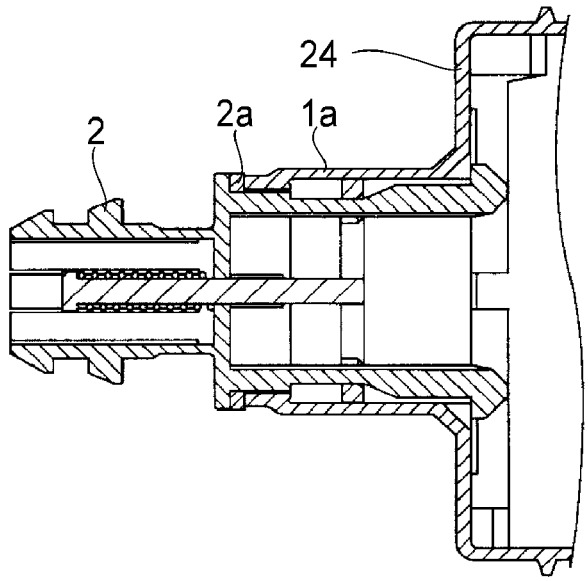

First, referring to FIGS. 5(*a*)-5(*d*), 6(*a*), and 6(*b*), the sealing portion 2*a* will be described. FIGS. 6(*a*) and 6(*b*) show the sealing portion of the sealing member 2 in the first modified version of the first preferred embodiment. FIG. 6(*a*) is a perspective view of the sealing portion, and FIG. 6(*b*) is a front view of the sealing portion.

Referring to FIGS. 5(*a*) and 5(*b*), the sealing portion 2*a* has: a flange portion 2*a*1, which comes into contact with the edge of the developer outlet 1*a*; a cylindrical portion 2*a*2, which extends inward of the container proper 24A from the flange portion 2*a*1; and an elastic portion 2*a*3 (ring), which is fitted around the cylindrical portion 2*a*2 and contacts the cylindrical internal surface of the developer outlet 1*a*. The sealing member 2 is prevented by a locking mechanism (which will be described later) from being accidentally disengaged from the developer outlet 1*a*. Therefore, the sealing portion 2*a* is structured so that the primary object of the sealing portion 2*a* is to keep the developer outlet 1*a* airtightly sealed. That is, the sealing portion 2*a* does not need to be shaped to have both the "airtightly sealing" function, and "accidental unsealing preventing" function; it may be structured primarily to keep the developer outlet 1*a* "airtightly sealed," and to make it "easier to unseal the developer outlet 1*a*".

Next, referring to FIG. 5(*b*), the elastic portion 2*a*3 is shaped so that the external diameter of its widest portion is greater by a proper amount L than the internal diameter of the developer outlet 1. Thus, as the elastic portion 2*a*3 is pressed into the developer outlet 1*a*, the developer outlet 1*a* becomes airtightly sealed, preventing thereby the developer from leaking from the developer outlet 1*a*.

In order for the elastic portion 2*a*3 to airtightly seal the developer outlet 1*a* by being pressed into the developer outlet 1*a*, the elastic portion 2*a*3 is provided with a proper amount of elasticity. Thus, it is common practice to use one of such substances as various rubbers, foamed urethane, and the like, as the material for the elastic portion 2*a*3. In the case of this embodiment, a silicon rubber was used as the material for the elastic portion 2*a*3.

Further, the elastic portion 2*a*3 in this embodiment is shaped so that the elastic portion 2*a*3 has only a single sealing projection (which hereafter may be referred to as "single lip"), as shown in FIG. 5(*b*). In other words, in order to minimize the amount of force necessary to unseal the developer outlet 1*a*, the area of contact between the internal wall of the developer outlet 1*a* and the sealing projection is made as small as possible.

Incidentally, the elastic portion 2*a*3 does not need to be shaped so that it has only a single lip. Further, the material for the elastic portion 2*a*3 does not need to be limited to one of the above-mentioned substances. In essence, all that is required of the shape and structure of the elastic portion 2*a*3 is that they can make the amount of force necessary to move the sealing member 2 out of the developer outlet 1*a* as small as possible while preventing the developer from leaking from the developer outlet 1*a*.

For example, referring to FIGS. 6(*a*) and 6(*b*), the sealing member 2 may be structured so that its sealing portion 2*a* presses on the end surface of the wall of the developer outlet 1*a* to seal the developer outlet 1*a*. In such a case, the sealing member 2 is not structured so that the sealing portion 2*a* is pressed into the developer outlet 1*a*, as shown in FIG. 5(*a*), to airtightly seal the developer outlet 1*a*. Therefore, the amount of force necessary to unseal the outlet 1*a* by moving the sealing member 2 away from the developer outlet 1*a* is smaller.

[Locking Projection]

Figure 7:
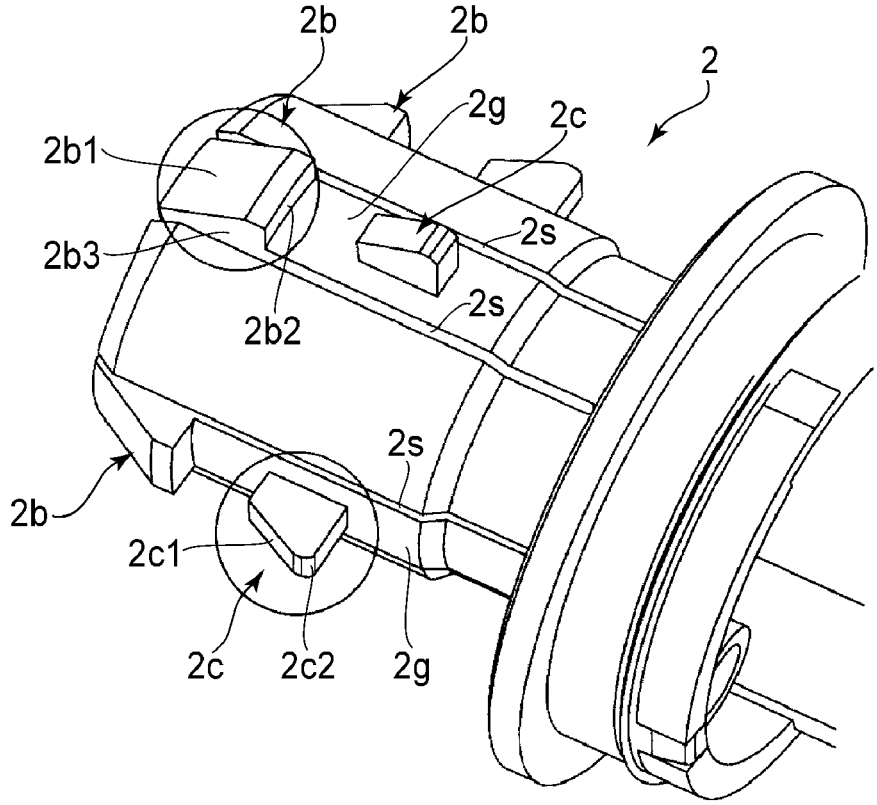
FIG. 7 is an enlarged perspective view of a part of the sealing member.
Figure 8:
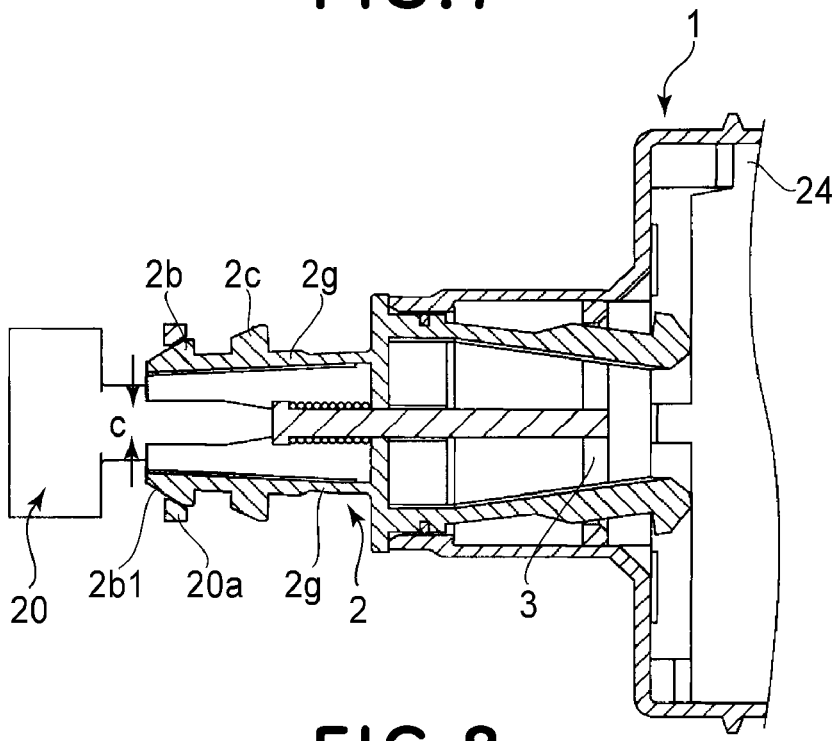
FIG. 8 is a sectional view of the sealing member when the sealing member is in the main assembly of the image forming apparatus.
Figure 9:
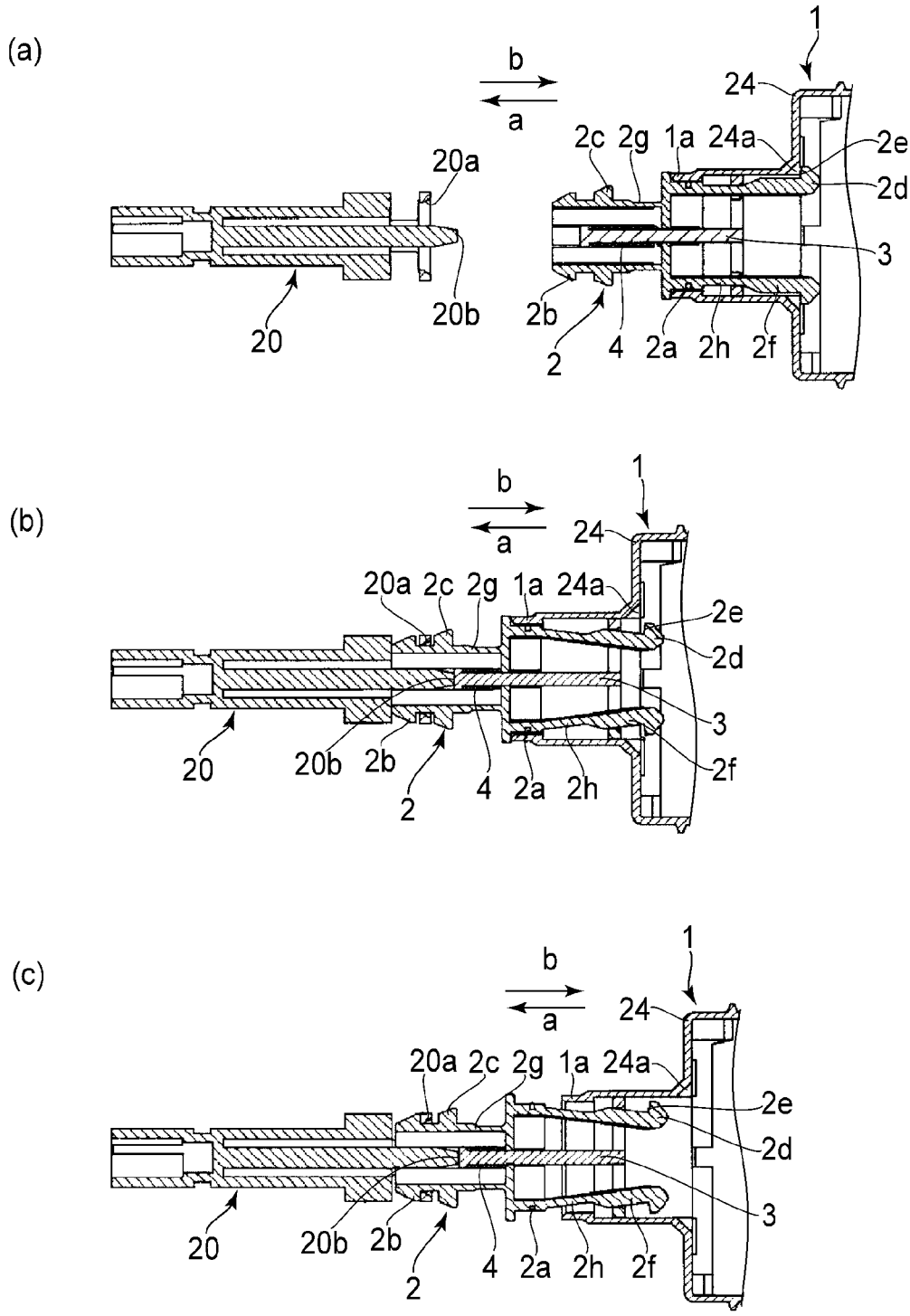
FIGS. 9(*a*)-9(*c*) are sectional views of the combination of the developer container driving portion of the main assembly of the image forming apparatus, and a part of the developer supply container; they are for describing the operation for connecting the developer supply container to the developer supply container driving portion of the main assembly.
Figure 10:
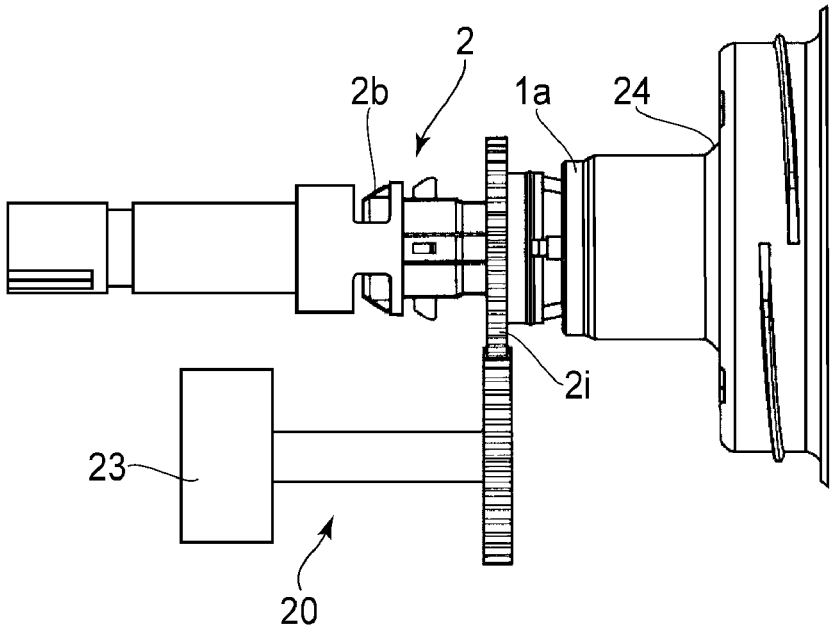
FIG. 10 is a front view of one of the modified versions of the driving force transmitting method.

Next, referring to FIGS. 7, 8, 9(*a*)-9(*c*), and 10, the structure of the locking projection 2*b* will be described. FIG. 7 is an enlarged perspective view of a part of the sealing member 2, and FIG. 8 is a sectional view of the sealing member 2, the plate-like first portion 2*g* of which is in the form into which it was elastically deformed in the apparatus main assembly 100. FIG. 9(*a*) is a sectional view of the combination of the developer supply container driving portion 20 and sealing member 2, before the developer supply container 1 is mounted into the apparatus main assembly 100, and FIG. 9(*b*) is a sectional view of the developer supply container driving portion 20 and sealing member 2, after the developer supply container 1 was mounted into the apparatus main assembly 100. FIG. 9(*c*) is a sectional view of the developer supply container driving portion 20 and sealing member 2, after the sealing member 2 was moved to unseal the developer outlet 1*a* of the developer supply container 1. FIG. 10 is a front view of the driving force transmitting portion of the sealing member 2, in one of the modified versions of the first preferred embodiment.

Referring to FIG. 7, the locking projection 2*b* is at the leading end of each of the multiple plate-like first portions 2*g* of the sealing member 2. There are slits 2*s* on both sides of each plate-like first portion 2*g*, making it possible for the plate-like first portion 2*g* to deform in a direction c indicated in FIG. 8. Also referring to FIG. 7, the leading end of the locking projection 2*b* is provided with a tapered portion 2*b*1, and the opposite end of the locking projection 2*b* from the tapered portion 2*b*2, in terms of the axial line of the developer supply container 1, is a locking surface 2*b*2, which is roughly perpendicular to the plate-like first portion 2*g*. The lateral surfaces, which connect the leading end of the locking projection 2*b* and the opposite end of the locking projection 2*b*, make up a driving force receiving (catching) 2*b*3, which receives the driving force from the cylindrical and hollow developer supply container driving portion 20 of the apparatus main assembly 100.

Next, referring to FIG. 9(*a*), in order to ensure that when the developer supply container 1 is mounted into the apparatus main assembly 100, the sealing member 2 smoothly enters the developer supply container driving portion 20 (which hereafter may be referred to simply as driving portion 20), the connective end portion of the driving portion 20 is provided with a portion having a tapered surface 20*a*, that is, a surface which gradually reduces in diameter. Thus, as the developer supply container 1 is moved in the direction a, the plate-like first portion 2*g*, which has the locking projection 2*b*, is elastically deformed in the direction c by the combination of the tapered surface 20*a* of the developer supply container driving portion 20, and the tapered portion 2*b*1 of the leading end of the locking projection 2*b*.

Next, referring to FIG. 9(*b*), as the developer supply container 1 is moved in the first direction, that is, in the direction a, the sealing member 2 is smoothly inserted into the developer supply container driving portion 20. Then, as the developer supply container 1 is moved further in the direction a, the plate-like first portion 2*g* is made to restore its shape by its elasticity. Consequently, the sealing member 2 becomes engaged (locked) with the driving portion 20 by its locking projection 2*b* in such a manner that it cannot move either in the direction a, or the second direction (direction b) which is opposite to the direction a. In other words, the sealing member 2 becomes engaged with the driving portion 20 in such a manner that it cannot be moved in the thrust direction, except for a small amount of play between the driving portion 20 and locking projection 2*b*.

Further, as the developer supply container 1 is moved into the position shown in FIG. 9(*b*), the sealing member unlocking member 3 is moved in the direction b relative to the sealing member 2, by the projection 20*b* of the driving portion 20. Thus, the sealing member 2 is disengaged from the sealing member catching (locking) portion 24*a* of the developer storage portion 24, making it possible for the sealing member 2 to come out of the developer outlet 1*a* to unseal the developer outlet 1*a*.

The details of the operation carried out by the above described sealing member unlocking member 3 to engage the sealing member 2 and the sealing member catching (locking) portion 24*a* of the developer storage portion 24, or to disengage the sealing member 2 from the sealing member catching portion 24*a*, will be described later.

Referring to FIG. 9(*c*), the sealing member 2 is remaining engaged with the driving portion 20 by being kept pressed toward the driving portion 20. Thus, as the developer storage portion 24 moves in the direction b, only the developer storage portion 24 moves in the direction b. As a result, the sealing member 2 comes out of the developer outlet 1*a*, unsealing thereby the developer outlet 1*a*, and therefore, it becomes possible for the developer to be discharged. Further, as the driving portion 20 is rotated, the sealing member 2 rotates by receiving the rotational force from the driving portion 20 through a driving force receiving portion 2*b*3 (FIG. 7).

From the standpoint of the special efficiency of the apparatus main assembly 100 and the cost of the apparatus main assembly 100, described next is the most preferable structure for the image forming apparatus in this embodiment.

That is, the image forming apparatus and developer supply container 1 in this embodiment is structured so that the developer outlet 1*a* is unsealed by keeping the sealing member 2 and driving portion 20 attached to each other by moving the developer supply container 1 and using the engagement between the locking projection 2*b* of the sealing member 2, and the driving portion 20 of the apparatus main assembly 100, and also, so that the driving force from the apparatus main assembly 100 is transmitted to the developer supply container 1 by using the driving force receiving portion 2*b*3 of the locking projection 2*b*. However, the structural setup for transmitting the driving force to the developer supply container 1 does not need to be limited to this setup. For example, the image forming apparatus and developer supply container 1 may be structured so that as the developer supply container 1 is mounted into the apparatus main assembly 100, the driving portion 20 engages with the sealing member 2 by being moved in the direction b by the mounting of the developer supply container 1, and then, the sealing member 2 is moved out of the developer outlet 1, unsealing thereby the developer outlet, by the movement of the driving portion 20 in the direction a.

Further, referring to FIG. 10, the apparatus main assembly 100 and developer supply container 1 may be structured so the sealing member 2 is provided with a gear 2*i* to transmit the driving force from a driving motor 23 of the apparatus main assembly 100 to the gear 21 through the gear 2*i* to rotate the sealing member 2.

[Unlocking Projection]

Figure 12:
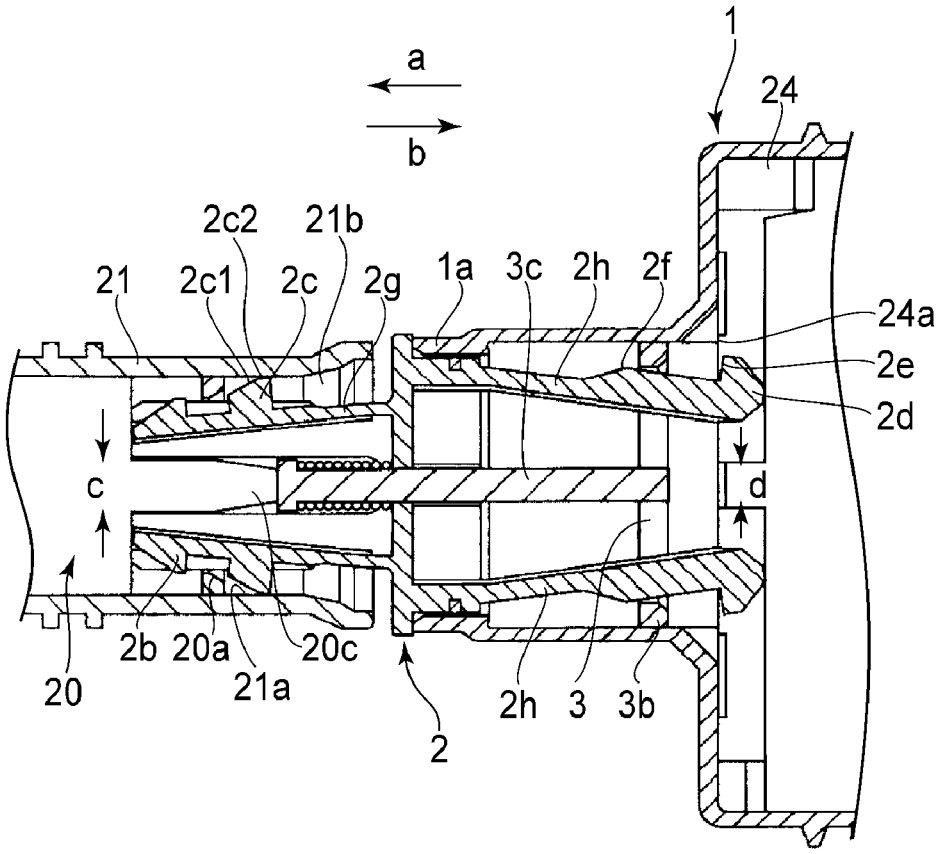
FIG. 12 is a sectional view of the combination of the developer supply container driving portion, sealing member, and sealing member unlocking member; it describes the operation for unlocking the sealing member.
Figure 11:
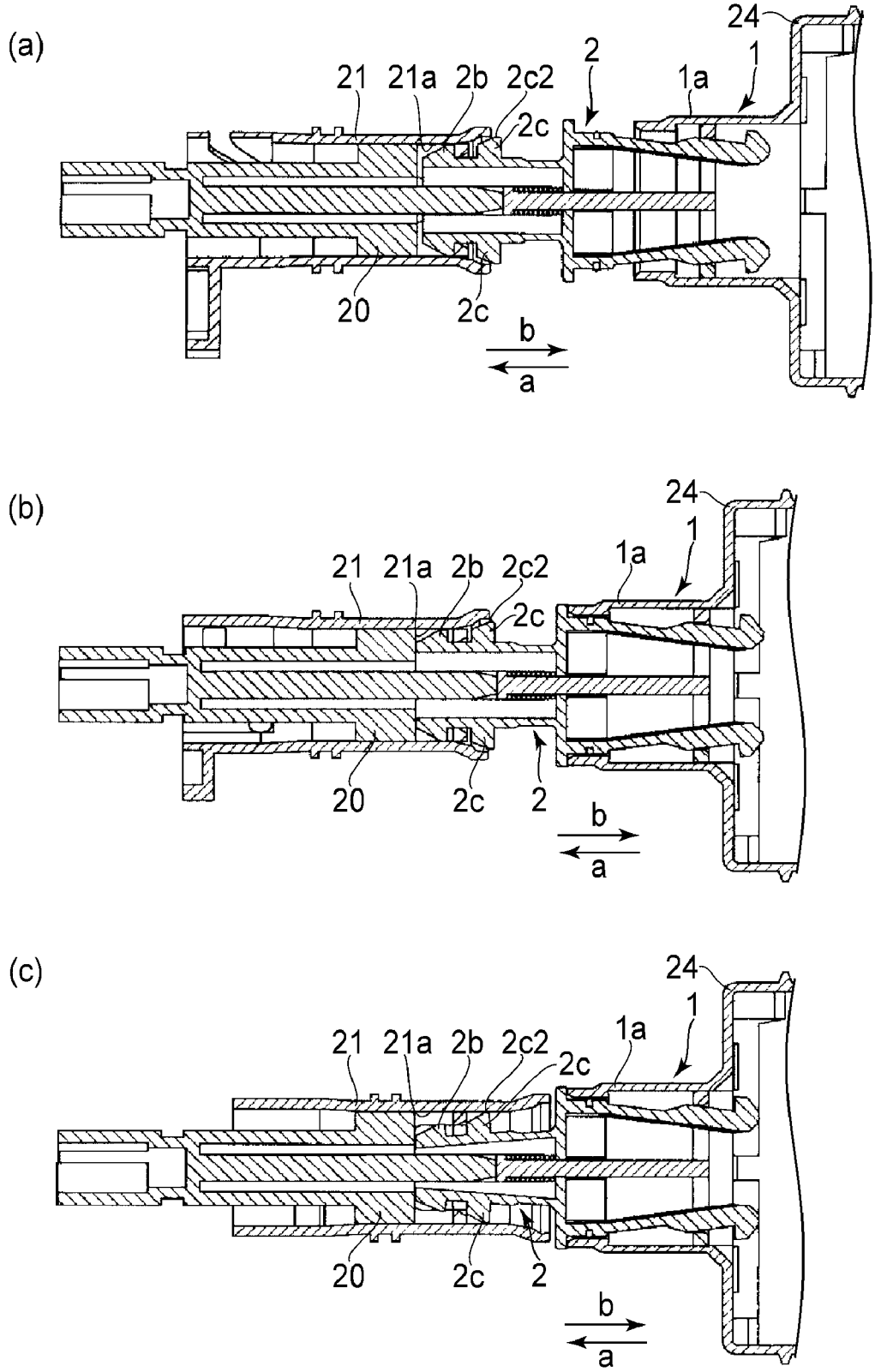
FIGS. 11(*a*)-11(*c*) are sectional views of the combination of the developer container driving portion of the main assembly of the image forming apparatus, and a part of the developer supply container; they are for describing the operation for disconnecting the developer supply container from the developer supply container driving portion of the main assembly.
Figure 13:
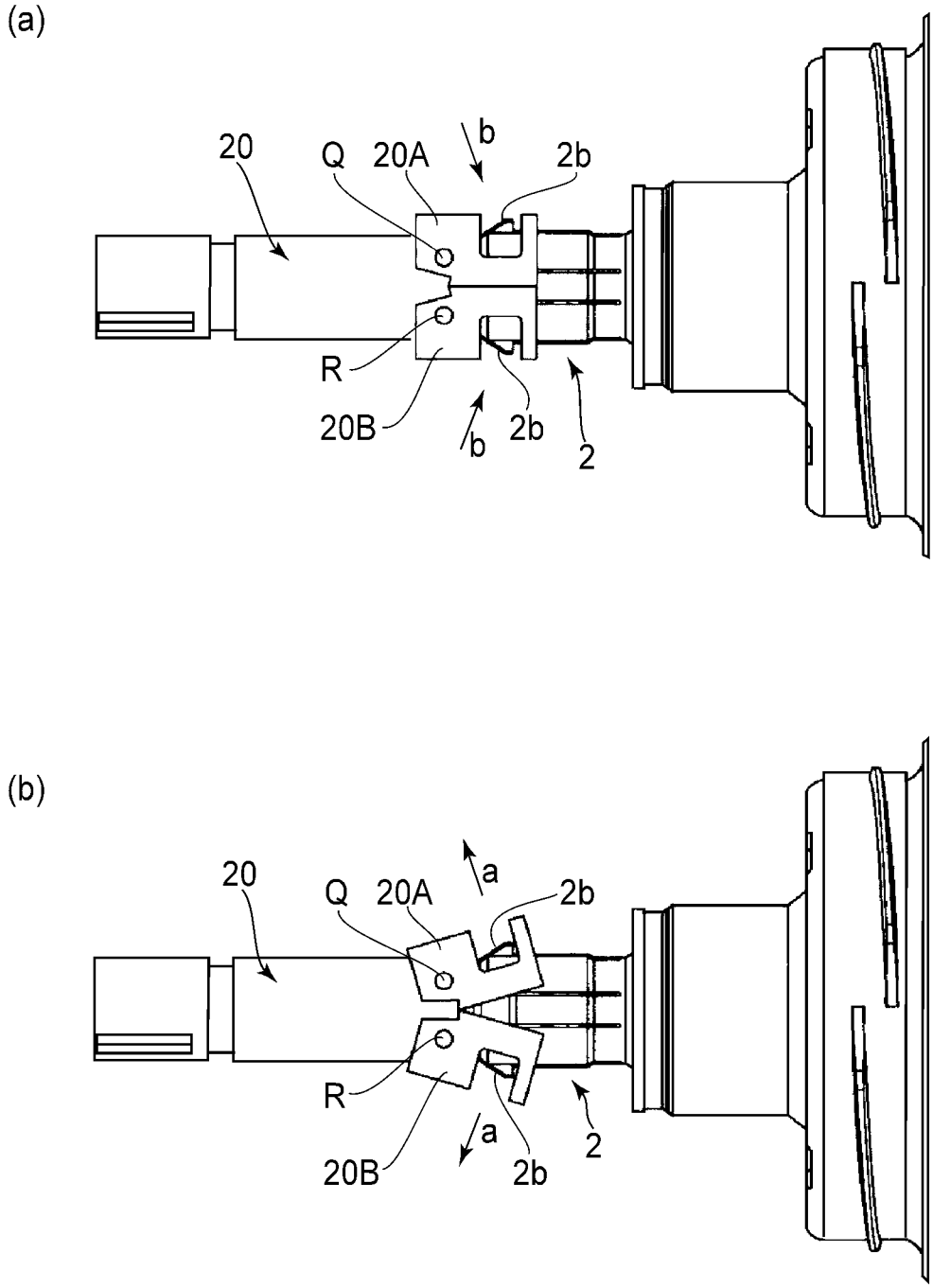
FIG. 13 shows one of the modified version of the means for transmitting driving force to the developer supply container.

Next, referring to FIGS. 7, 8, 11(*a*)-11(*c*), 12, 13(*a*), and 13(*b*), the structure of the unlocking projection 2*c* will be described. FIG. 11(*a*) is a sectional view of the combination of the developer container driving portion of the main assembly of the image forming apparatus, and the sealing member portion of the developer supply container 1, when the sealing member 2 is not in the position in which it keeps the developer outlet 1*a* sealed. FIG. 11(*b*) is a sectional view of the combination of the developer container driving portion of the main assembly of the image forming apparatus, and the sealing member portion of the developer supply container 1, when the sealing member 2 is in the position in which it keeps the developer outlet 1*a* sealed. FIG. 11(*c*) is sectional view of the combination of the developer container driving portion of the main assembly of the image forming apparatus, and the sealing member portion of the developer supply container 1, after the disengagement of the driving portion 20 of the apparatus main assembly 100 from the locking projection 2*b* by the unlocking projection 2*c*. FIG. 12 is a sectional view of the sealing member unlocking member 3 (which hereafter may be referred to simply as unlocking member 3) and its adjacencies, and shows the operation of the unlocking member 3. FIGS. 13(*a*) and 13(*b*) are front views of the combination of the driving portion 20 and sealing member 2, in one of the modifications of the preferred embodiment, and are for describing the method for disengaging the locking projection 2*b*, which is engagement with the driving portion 20 of the apparatus main assembly 100, without using the unlocking projection 2*c*.

Referring to FIG. 7, the unlocking projection 2*c* is on each of the multiple plate-like first portions 2*g* having the locking projection 2*b*. It is between the locking projection 2*b* and the base of the plate-like first portion 2*g*. The unlocking projection 2*c* has the tapered portion 2*c*1, which is at the leading end of the unlocking projection 2*c*, and a contact surface 2*c*2, which is at the edge of the sealing member 2 in terms of the diameter direction of the developer supply container 1. As described before, there is the slit 2*s* on each side of the plate-like first portion 2*g*, and the end portion of the plate-like first portion 2*g* is bendable in the direction c as shown in FIG. 8.

Next, referring to FIG. 11(*a*), when the locking projection 2*b* is in engagement with the driving portion 20 of the apparatus main assembly 100, there is a gap between the unlocking projection 2*c* and the disengaging portion 21 of the apparatus main assembly 100.

Next, referring to FIG. 11(*b*), when the developer supply container 1 is replaced, the developer storage portion 24 is moved in the direction a. As the developer storage portion 24 is moved in the direction a, the developer outlet 1*a* is sealed by the sealing member 2. At this point in time, there is still a gap between the disengaging portion 21, and the unlocking projection 2*c* of the sealing portion 2. Thus, the locking projection 2*b* and driving portion 20 remain engaged with each other.

Next, referring to FIG. 11(*c*), the unlocking portion 21 of the apparatus main assembly 100 is moved in the direction b, and the surface 21*a* of the disengaging portion 21 comes into contact with the surface 2*c*2 of the unlocking projection 2*c*, as shown in FIG. 12. During this process, the plate-like first portion 2*g* smoothly displaces in the direction c, because of the relationship between the tapered surface 21*b* of the disengaging portion 21, and the tapered surface 2*c*1. Therefore, the unlocking projection 2*c* of the plate-like first portion 2*g* also displaces in the direction c.

Here, the locking projection 2*b* also displaces in the direction c, because it is a part of the plate-like first portion 2*g*. As a result, the locking projection 2*b* becomes disengaged from the driving portion 20. Thereafter, as the developer supply container 1 displaces further in the direction b, the sealing member 2 separates from the driving portion 20, making it possible for the developer supply container 1 to be removed from the apparatus main assembly 100.

Incidentally, the plate-like first portion 2*g* of the sealing member 2, which is provided with the locking projection 2*b* and unlocking projection 2*c*, is desired to be formed of a resin, such as plastic, by injection molding. However, it may be formed of the material other than a resin, with the use of a manufacturing method other than injection molding. Further, the plate-like first portion 2*g* does not need to be formed in a single piece; it may be formed of two or more pieces, which are joined to form the plate-like first portion 2*g*. As a substance to be used as the material for injection-molding the plate-like first portion 2*g*, low density polyethylene is most desirable. However, polypropylene, straight chain polyamide, for example, Nylon (commercial name), high density polyethylene, polyester, ABS, HIPS (high impact polystyrene), etc., can also be used as preferable materials. Further, it may be manufactured of an elastically deformable metal or the like.

As described above, the plate-like first portion 2*g* which is provided with the locking projection 2*b* and unlocking projection 2*c* is formed as an elastically deformable member. Therefore, the driving portion 20 and locking projection 2*b* can be easily engaged or disengaged by utilizing the elasticity of the plate-like first portion 2*g*. Therefore, they can be made simple in structure. Further, the substances listed above as the materials for the plate-like first portion 2*g* have a proper amount of elasticity. Therefore, the driving portion 20 and locking projection 2*b* can be easily engaged with each other or disengaged from each other, while being satisfactorily durable.

In this embodiment, the sealing member 2 is provided with the unlocking projection 2*c* to make it simpler to disengage the locking portion 2*b* and driving portion 20 from each other. However, the above described structural arrangement is not mandatory; the provision of the unlocking projection 2*c* is not mandatory.

For example, the sealing member 2 and driving portion 20 may be structured as shown in FIG. 13(*a*). That is, the driving portion 20 of the apparatus main assembly 100 is separated into a first driving portion 20A and a second driving portion 20B, which are rotatably supported by a pair of shafts Q and R, respectively, with which the driving portion 20 is provided. As the first and second driving portion 20A and 20B displace in the direction b, the driving portion 20 engages with the locking projections 2*b*. Further, referring to FIG. 13(*b*), as the first and second driving portions 20A and 20B displace in the direction a, the driving portion 20 disengages from the locking projection 2*b*. In the case of this setup, however, the apparatus main assembly 100 becomes complicated in structure. Therefore, it is most desirable that the structural arrangement in the first preferred embodiment is used.

[Container Driving Force Transmitting Portion]

Figure 14:
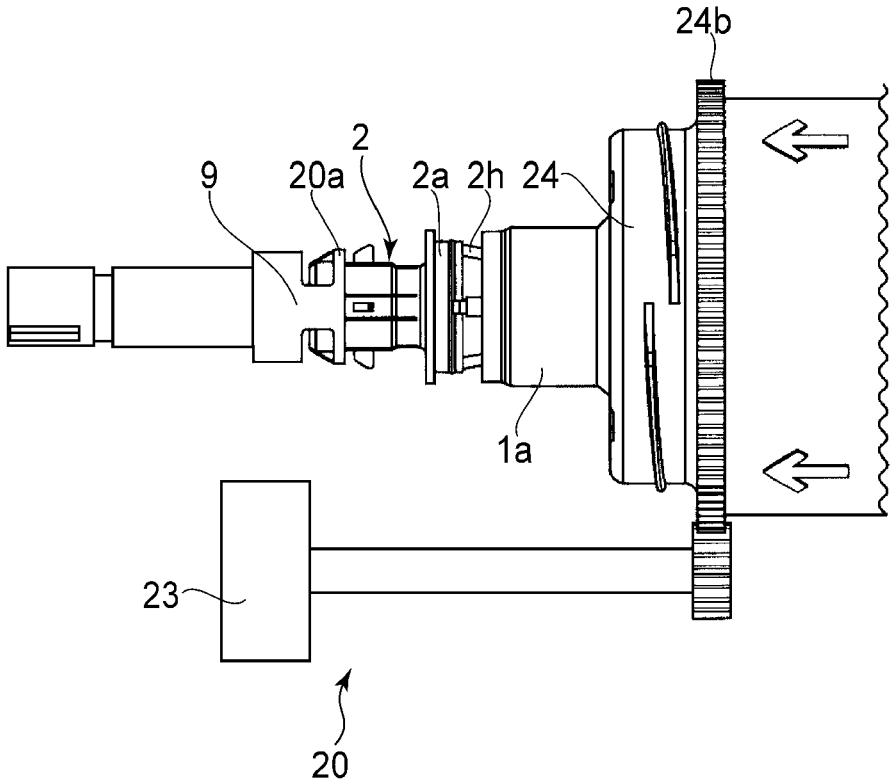
FIG. 14 is a front view of another modified version of the developer supply container driving force transmitting method.

Next, referring to FIGS. 5(*a*), 5(*b*), 5(*c*), 5(*d*), and FIG. 14, the container driving force transmitting portion 2*d* will be described. FIGS. 5(*a*), 5(*b*), 5(*c*), and 5(*d*) are as described above. In particular, FIG. 5(*d*) is a perspective view of the partially cut-out container proper 24A, and is for describing the method for transmitting driving force from the sealing member 2 to the container proper 24A. FIG. 14 is a drawing of one of the modified versions of the means for transmitting driving force from the apparatus main assembly 100 to the developer supply container 1.

Referring to FIG. 5, one of the lengthwise end portions of the sealing member 2 is provided with the locking projection 2*b* and unlocking projection 2*c*, and the opposite lengthwise end of the sealing member 2 is provided with a container driving force transmitting portion 2*d*, which is a part of the plate-like second portion 2*h*, as shown in FIG. 5(*c*). Next, referring to FIG. 5(*d*), the container driving force transmitting portion 2*d* engages with the container driving force receiving (catching) portion 24*c* of the developer storage portion 24, which is near the developer outlet 1*a*.

Therefore, the rotational driving force which the sealing member 2 receives from the driving portion 20 of the image forming apparatus 100 is transmitted to the container driving force transmitting portion 2*d* through the locking projection 2*b* of the sealing member 2, and then, is transmitted to the container driving force receiving (catching) portion 24*c* of the developer storage portion 24. Therefore, the developer supply container 1 is rotatable to supply the apparatus main assembly 100 with the developer.

In this embodiment, the image forming apparatus was structured so that the developer supply container 1 is rotated by transmitting rotational force from the apparatus main assembly 100 to the developer supply container 1 through the container driving force transmitting portion 2*d* of the sealing member 2. However, it is not mandatory that the means for rotating the developer supply container 1 is limited to the one in this embodiment.

For example, referring to FIG. 14, the image forming apparatus may be structured so that the developer supply container 1 is provided with a gear 24*b*, which fitted around the peripheral surface of the developer storage portion 24, whereas the apparatus main assembly 100 is provided with a locking member 9 for unsealing the developer outlet 1*a* by engaging the sealing member 2.

Here, the relationship between the locking member 9 and sealing member 2 in this modified version, and the relationship between the driving portion 20 and sealing member 2 in the first preferred embodiment, are the same, except that the locking member 9 does not drive the sealing member 2.

That is, in the case of the modified version, the apparatus main assembly 100 and developer supply container 1 are structured so that the developer outlet 1*a* is unsealed, as described in the section titled "Locking Projection", while the sealing member 2 remains engaged with the locking member 9, and then, the force for driving the developer supply container 1 is directly transmitted from the motor 23 of the apparatus main assembly 100 to the container gear 24*b* of the developer storage portion 24. However, in terms of cost and space, the structural arrangement, such as the one in the modified version, is disadvantageous, not only making it therefore difficult to reduce the apparatus main assembly 100 in size, but also, making the developer supply container 1 in structure as well as shape.

Further, in this preferred embodiment, the locking portion 2*e*, shown in FIG. 5, doubles as the container driving force transmitting portion 2*d*. Therefore, if the sealing member 2 fails to be disengaged from the developer outlet 1*a* because of the problems having occurred to the developer supply container 1 and/or apparatus main assembly 100 (if developer supply container 1 fails to be accurately mounted), the container driving force is not transmitted to the sealing member 2, and therefore, the developer supply container 1 does not rotate. Therefore, the apparatus main assembly 100 is not supplied with the developer. Thus, even after the replacement of the old developer supply container 1, from which the developer has been exhausted, with a brand-new developer supply container 1, the apparatus main assembly 100 fails to recognize the replacement. Therefore, it is possible for an operator to be informed that the developer supply container 1 is having a problem, or the developer supply container 1 failed to be accurately mounted.

In the case of the structural arrangement, shown in FIG. 14, which the force for driving the developer supply container 1 is directly transmitted from the apparatus main assembly 100 to the container gear 24*b* of the developer storage portion 24, the developer supply container 1 rotates anyway even if there is a problem, such as the above described one. Therefore, it is possible that an unexpected incident may occur. Also because of this reason, the structural arrangement in the first preferred embodiment may be said to be the most desirable one.

[Locking Portion]

Next, referring to FIGS. 5(*a*), 5(*b*), 5(*c*), 5(*d*), and 15, the locking portion 2*e*, which functions also as an engaging portion (hooking portion), will be described.

Figure 15:
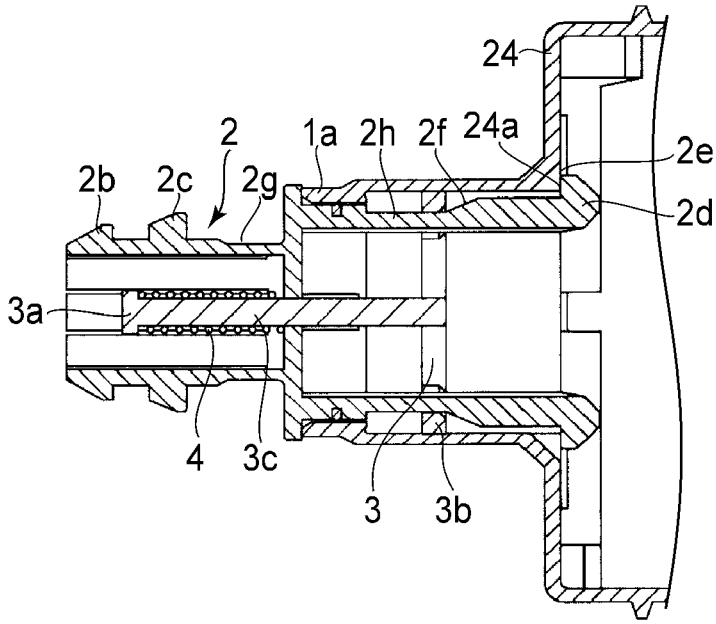
FIG. 15 is a sectional view of a part of the developer supply container prior to the mounting of the developer supply container in the main assembly of the image forming apparatus.

FIG. 15 is a sectional view of the sealing member portion of the developer supply container 1 before the mounting of the developer supply container 1 into the apparatus main assembly 100. FIGS. 5(*a*), 5(*b*), 5(*c*), and 5(*d*) are as described before.

Referring to FIG. 5, the end of the plate-like second portion 2*h* is the container driving force transmitting portion 2*d*, and a part of the container driving force transmitting portion 2*d* is provided with the locking portion 2*e*, which functions as an engaging-and-locking portion. Further, the developer storage portion 24 is provided with the sealing member catching portion 24*a*, which is located in the adjacencies of the developer outlet 1*a* of the developer storage portion 24 and functions as the sealing member locking portion. The locking portion 2*e* engages with the sealing member catching portion 24*a* to prevent the sealing member 2 from slipping out of the developer outlet 1*a*.

[Tapered Unlocking Portion]

Next, referring to FIGS. 5 and 12, the tapered unlocking portion 2*f* will be described. FIG. 12 is a drawing for describing the movement of the unlocking member 3.

Referring to FIG. 5, the plate-like second portion 2*h* has the tapered unlocking portion 2*f*. Next, referring to FIG. 12, as the developer supply container 1 is mounted into the apparatus main assembly 100, the unlocking member 3, which will be described later, is moved in the direction b, relative to the sealing member 2. Thus, the tapered unlocking portion 2*f* comes into contact with the unlocking portion 3*b* of the unlocking member 3. During this movement of the unlocking member 3, the tapered unlocking portion 2*f* smoothly slides on the inward surface of the unlocking portion 3*b* of the unlocking member 3, and therefore, the tapered unlocking portion 2*f* smoothly enters the unlocking portion 3*b*, causing thereby the plate-like second portion 2*h* to displace in the direction d. Thus, the locking portion 2*e* of the plate-like second portion 2*h* displaces in the direction d, with the plate-like second portion 2*h*, being thereby disengaged (unlocked) from the sealing member catching portion 24*a* of the developer storage portion 24.

The above described sealing member unlocking operation will be described later in detail in the section titled "Operation for Mounting Developer Supply Container".

[Unlocking Member]

Figure 16:
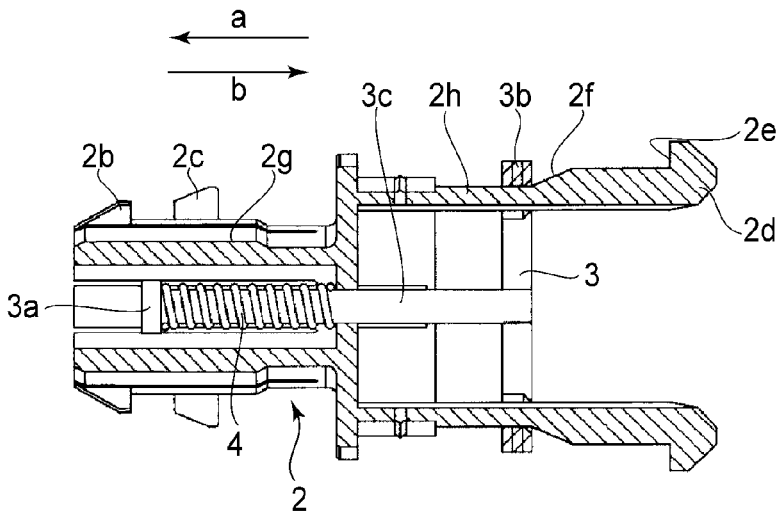
FIG. 16 is a sectional view of the sealing member and sealing member unlocking member, and is for describing the locking and unlocking of the sealing member.
Figure 17:
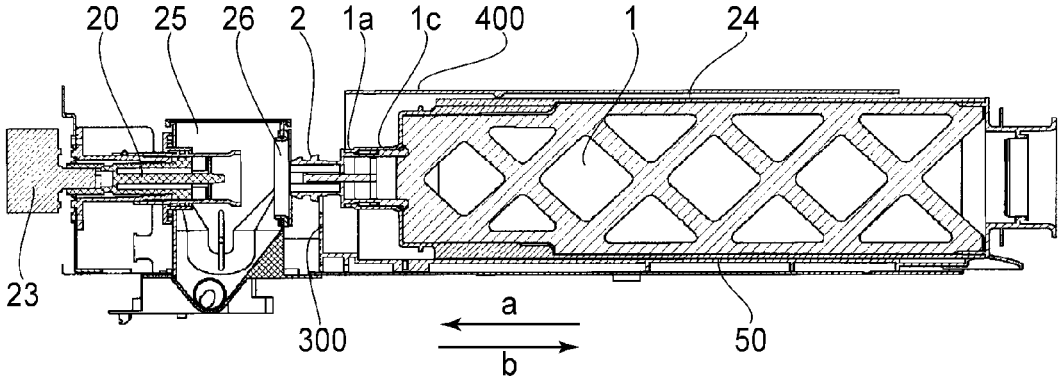
FIG. 17 is a sectional view of the developer supply container, and its adjacencies, when the developer supply container is in the apparatus main assembly; it is for describing the operation for mounting the developer supply container into the main assembly of the image forming apparatus.

Next, referring to FIG. 16, the unlocking member 3 which functions as a regulating member, and a spring 4 which functions as a pressure applying member, will be described. FIG. 16 is a drawing of the combination of the sealing member 2 and unlocking member 3 after the installation of the unlocking member into the sealing member 2.

Referring to FIG. 16, the unlocking member 3 has: a bumping portion 3*a*; an unlocking portion 3*b*; and a supporting shaft 3*c* which connects the bumping portion 3*a* to the unlocking portion 3*b*. Further, there is a spring 4 between the sealing member 2 and supporting shaft 3*c*. The spring 4 is the member for keeping the unlocking member 3 continuously pressured in the direction a. As the unlocking member 3 is installed into the sealing member 2, the bumping portion 3*a* is positioned on the inward side of the rough cylindrical shape, which the multiple plate-like first portions 2*g* of the sealing member 2 form. In other words, the bumping portion 3*a* does not protrude outward beyond the sealing member 2 in terms of the diameter direction of the developer supply container 1. Therefore, the bumping portion 3*a* cannot be easily touched.

The details of the function of each of the various portions of the sealing member 2 and unlocking member 3 will be described in the following section titled as "Operation for Mounting Developer Supply Container".

[Operation for Mounting Developer Supply Container]

Next, referring to FIGS. 17-20, 21-24, and 25-28, the operation for mounting the developer supply container 1 into the apparatus main assembly 100 will be described. FIGS. 17-20 are sectional views of the developer supply container 1 and its adjacencies, and are for describing the operation for mounting the developer supply container 1 into the apparatus main assembly 100. FIGS. 21-24, which correspond to FIGS. 17-20, one for one, are sectional views of the driving portion 20, disengaging portion 21, sealing member 2, and unlocking member 3, and are for describing the operation of the unlocking member 3 in the sealing member 2. FIGS. 25-28, which also correspond to FIGS. 17-20, are perspective views of the developer supplying apparatus 400 of the apparatus main assembly 100.

Figure 21:
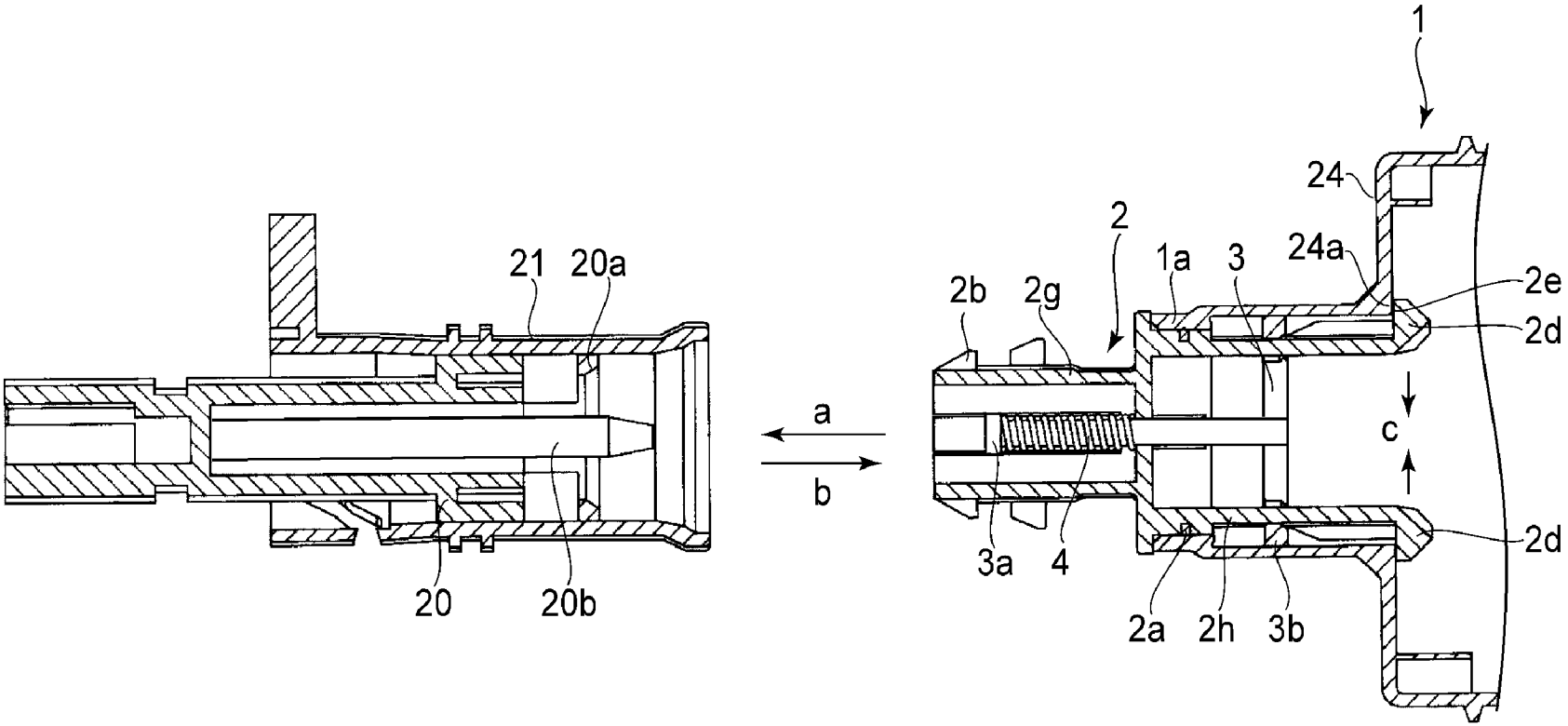
FIG. 21 is a sectional view of the combination of the developer supply container driving portion of the main assembly of the image forming apparatus, and the sealing member portion of the developer supply container, and is for describing the operation for mounting the developer supply container into the main assembly of the image forming apparatus.
Figure 25:
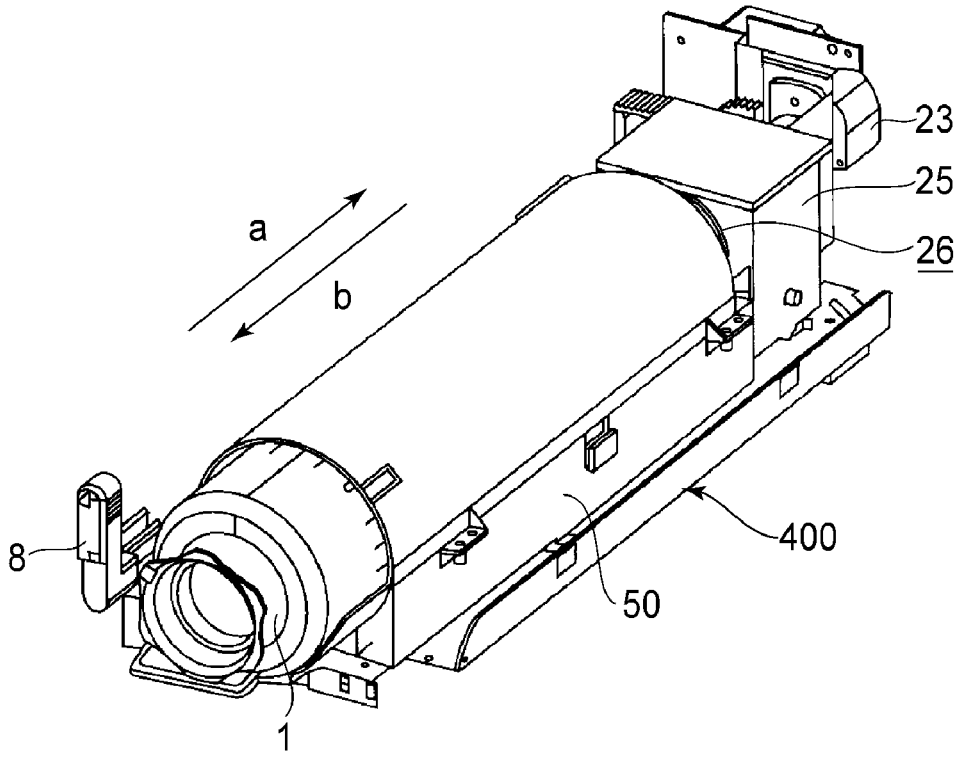
FIG. 25 is a perspective view of the developer supply container, and its adjacencies, when the developer supply container is in the apparatus main assembly; it is for describing the operation for mounting the developer supply container into the main assembly of the image forming apparatus.

First, referring to FIG. 25, when an operator mounts the developer supply container 1, the developer supply container 1 is to be mounted into the container holder 50, with which the developer supplying apparatus 400 of the apparatus main assembly 100 is provided, in the direction a. The container holder 50 is held by an unshown stopper so that it does not move in the direction a. Further, the locking portion 2*e* of the sealing member 2 of the developer supply container 1 remains engaged with the sealing member catching portion 24*a* of the developer storage portion 24, as shown in FIG. 21. When the locking portion 2*e* and sealing member catching portion 24*a* are in engagement with each other, the locking surface of the sealing member catching portion 24*a* and the locking surface of the locking portion 2*e* are in contact with each other. Therefore, even if the operator accidentally tries to move the sealing member 2 in the direction to unseal the developer outlet 1*a*, the developer outlet 1*a* cannot be unsealed. That is, the engagement between the locking portion 2*e* and the sealing member catching portion 24*a* of the developer storage portion 24 ensures that it does not occur that the developer outlet 1*a* is accidentally unsealed.

Further, the unlocking portion 3*b* of the unlocking member 3 is on the inward side of the developer storage portion 24, being therefore inaccessible from outside the developer storage portion 24. Therefore, even if an operator handles the developer supply container 1 in an unexpected manner, the sealing member 2 does not easily come out of the developer outlet 1*a*.

Figure 18:
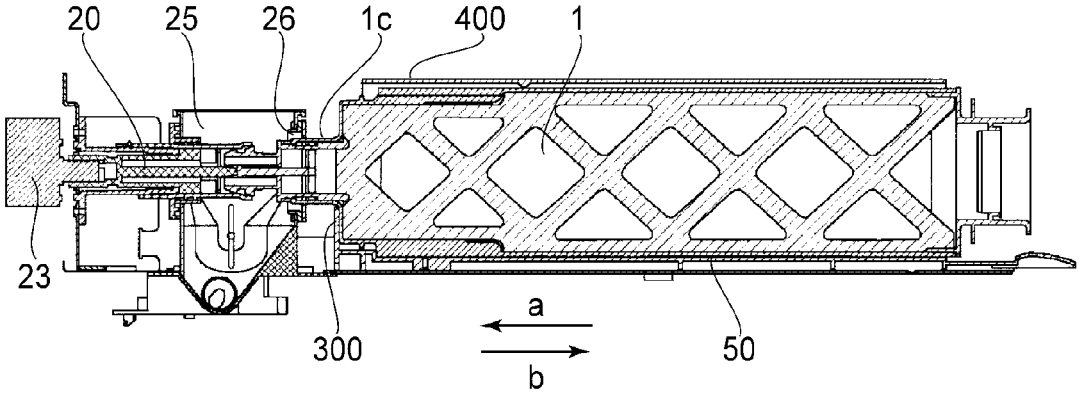
FIG. 18 is a sectional view of the developer supply container, and its adjacencies, when the developer supply container is in the apparatus main assembly; it is for describing the operation for mounting the developer supply container into the main assembly of the image forming apparatus.
Figure 22:
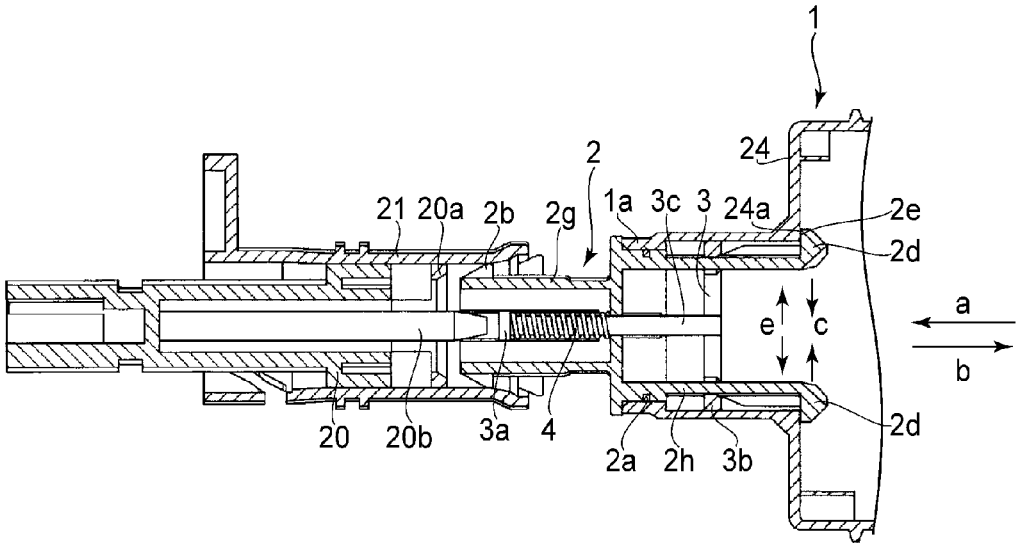
FIG. 22 is a sectional view of the combination of the developer supply container driving portion of the main assembly of the image forming apparatus, and the sealing member portion of the developer supply container, and is for describing the operation for mounting the developer supply container into the main assembly of the image forming apparatus.
Figure 23:
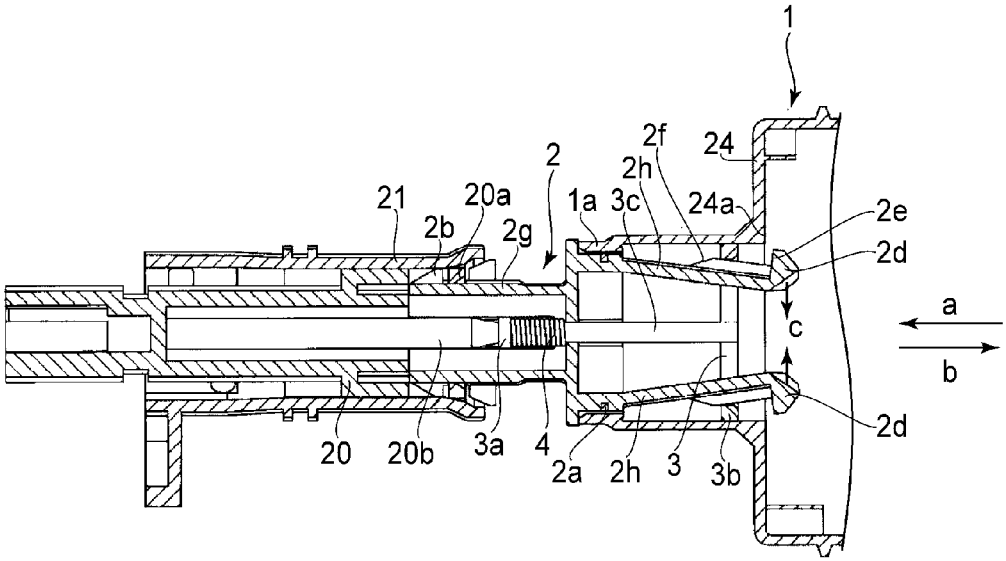
FIG. 23 is a sectional view of the combination of the developer supply container driving portion of the main assembly of the image forming apparatus, and the sealing member portion of the developer supply container, and is for describing the operation for mounting the developer supply container into the main assembly of the image forming apparatus.
Figure 26:
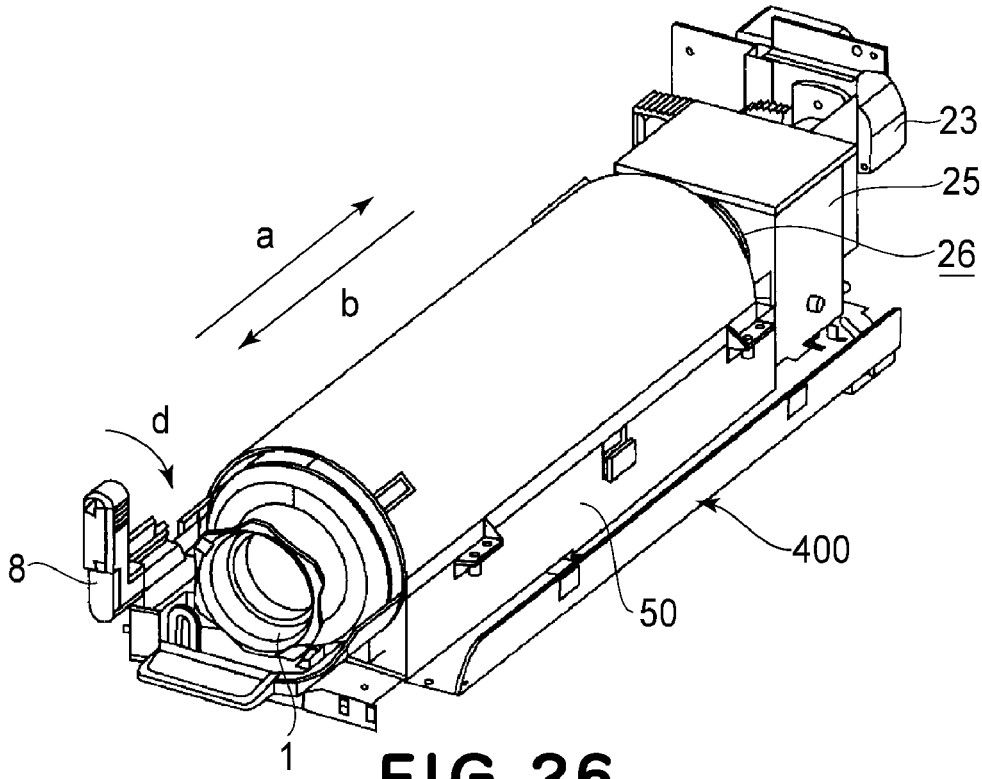
FIG. 26 is a perspective view of the developer supply container, and its adjacencies, when the developer supply container is in the apparatus main assembly; it is for describing the operation for mounting the developer supply container into the main assembly of the image forming apparatus.

As the operator inserts the developer supply container 1 further in the direction a, from the position shown in FIG. 25 to the position shown in FIG. 26, the leading end of the developer supply container 1 bumps into a container stopper 300, with which the leading end of the container holder 50 is provided, as shown in FIG. 18. Thus, it becomes impossible for the operator to insert the developer supply container 1 further in the direction a. As the leading end of the developer supply container 1 bumps into the container stopper 300, the developer supply container 1 is locked with the container holder 50 so that it moves with the container 50 thereafter. When the developer supply container 1 is in the state shown in FIG. 18, there is a gap between the bumping portion 3*a* of the unlocking member 3 and the bumping projection 20*b* of the driving portion 20, as shown in FIG. 22. Thus, the unlocking member 3 does not move in the direction b, relative to the sealing member 2. Therefore, the locking portion 2*e* of the sealing member 2 remains engaged with the sealing member catching portion 24*a* of the developer storage portion 24. Therefore, it is ensured that the developer supply container 1 is prevented from being accidentally unsealed. Therefore, it is possible to prevent the sealing member 2 from being moved in the direction to unseal the developer outlet 1 by the vibrations and impacts which are sometimes generated during the operation for mounting the developer supply container 1.

There is also a gap between the locking projection 2*b* of the sealing member 2 and the driving portion 20; the sealing member 2 is not in connection with the driving portion 20. Further, as the small diameter portion 1*c* of the developer supply container 1 slides into a buffer seal 26, the peripheral surface of the small diameter portion 1*c* of the developer storage portion 24 comes into contact with the inward surface of the buffer seal 26. Therefore, the interface between the small diameter portion 1*a* and the buffer seal 26 becomes airtightly sealed. Further, this airtight contact between the small diameter portion 1*c* and the buffer seal 26 remains intact during the operation which will be described next. Therefore, the problem that developer leaks from the toner buffer 25 during the operation for mounting the developer supply container 1 is reliably prevented.

Next, while the developer supply container 1 is in the state shown in FIG. 26, the operator rotates a set lever 8 in the direction d by a preset amount. As the set lever 8 is rotated, the container holder 50 is moved in the direction a by an unshown mechanism for moving the container holder 50. Thus, the developer supply container 1 on the container holder 50 moves with the container holder 50 in the direction a, to the position shown in FIG. 19. At this point in time, the container holder 50 is in its closest position to the toner buffer 25 of the developer supplying apparatus 400, as shown in FIG. 19.

Figure 19:
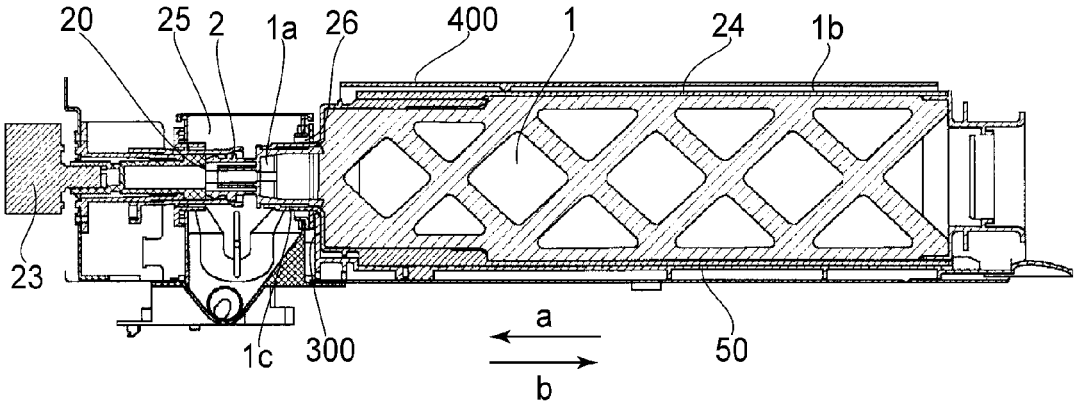
FIG. 19 is a sectional view of the developer supply container, and its adjacencies, when the developer supply container is in the apparatus main assembly; it is for describing the operation for mounting the developer supply container into the main assembly of the image forming apparatus.
Figure 20:
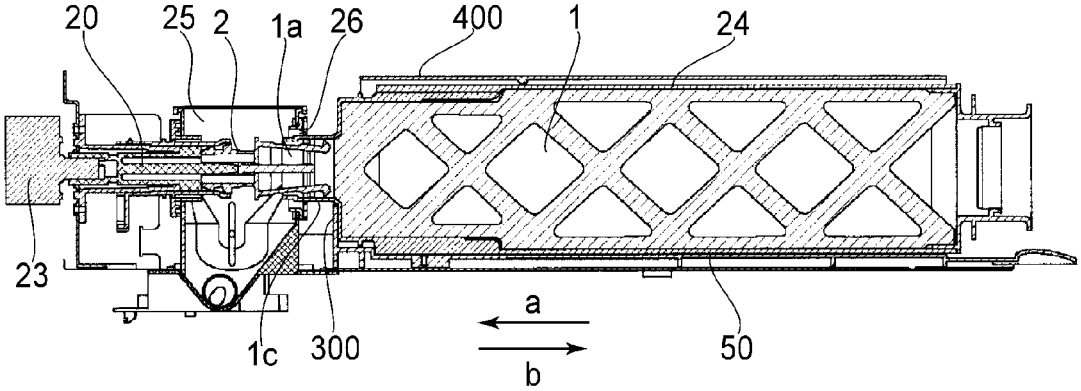
FIG. 20 is a sectional view of the developer supply container, and its adjacencies, when the developer supply container is in the apparatus main assembly; it is for describing the operation for mounting the developer supply container into the main assembly of the image forming apparatus.

When the developer supply container 1 moves from its position shown in FIG. 18 to its position shown in FIG. 19, the locking projection 2*b* engages with the driving portion 20, as described in the section titled as "Locking Projection". Next, referring to FIG. 23, the relationship between the developer supply container 1 in the position shown in FIG. 19, and the driving portion 20, will be described.

Figure 28:
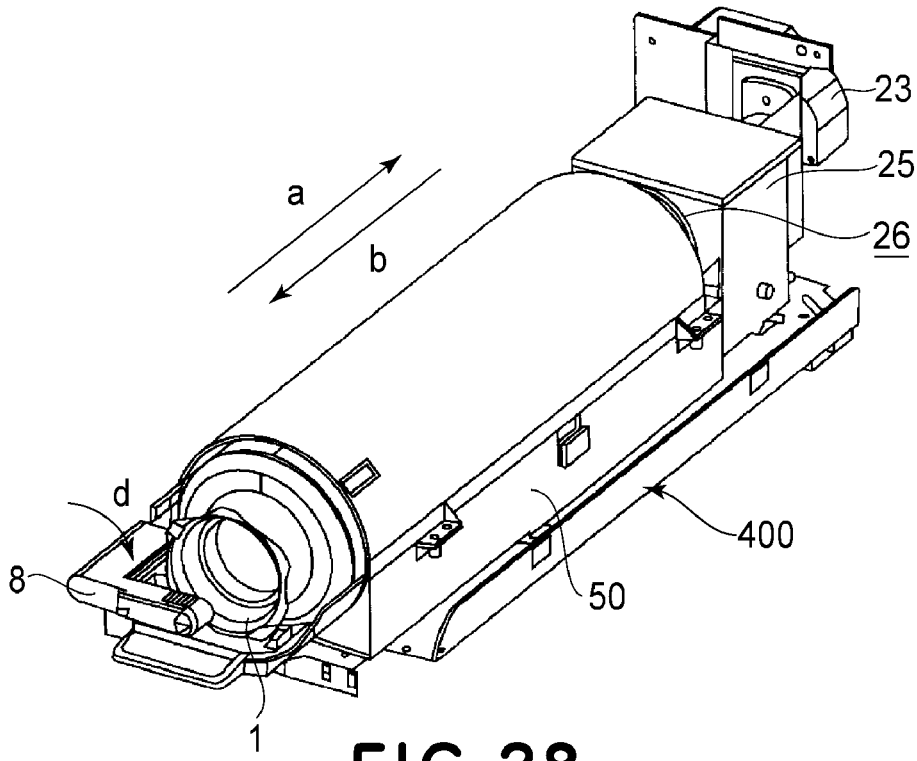
FIG. 28 is a perspective view of the developer supply container, and its adjacencies, when the developer supply container is in the apparatus main assembly; it is for describing the operation for mounting the developer supply container into the main assembly of the image forming apparatus.

Referring to FIG. 28, when the sealing member 2 of the developer supply container 1 is remaining engaged with the driving portion 20, the bumping portion 3*a* of the unlocking member 3 is in contact with the bumping projection 20*b* of the driving portion 20. Therefore, the unlocking portion 3*b* is moved in the direction b, relative to the sealing member 2, by the supporting shaft 3*c*. As the unlocking portion 3*b* moves in the direction b, the tapered unlocking portion 2*f* of the plate-like second portion 2*h* of the sealing member 2 bends in a manner to dive inward of the unlocking portion 3*b*, causing thereby the elastically deforming the plate-like second portion 2*h* in the direction c. During this elastic deformation of the plate-like second portion 2*h*, the locking portion 2*e* of the plate-like second portion 2*h* displaces in the direction c, as described above. Thus, the locking portion 2*e* becomes disengaged from the sealing member catching portion 24*a* of the developer storage portion 24. That is, the sealing member 2 becomes unlocked, and therefore, it can be moved out of the developer outlet 1*a* to unseal the developer outlet 1*a*.

Here, a force F which works in the direction to move the unlocking member 3 in the direction b is the resultant force from the combination of a force F1, which works in the direction to resist the force (pressure) generated by the spring 4, and a force F2, which works in the direction to displace the plate-like second portion 2*h* in the direction c. The plate-like second portion 2*h* relatively smoothly displaces in the direction c, because of its tapered shape. Therefore, the amount of the force necessary to move the unlocking member 3 in the direction b is roughly the same as the force F1. Thus, the amount of force F can be set as necessary by controlling the strength of the spring 4, being therefore easily controllable.

Figure 24:
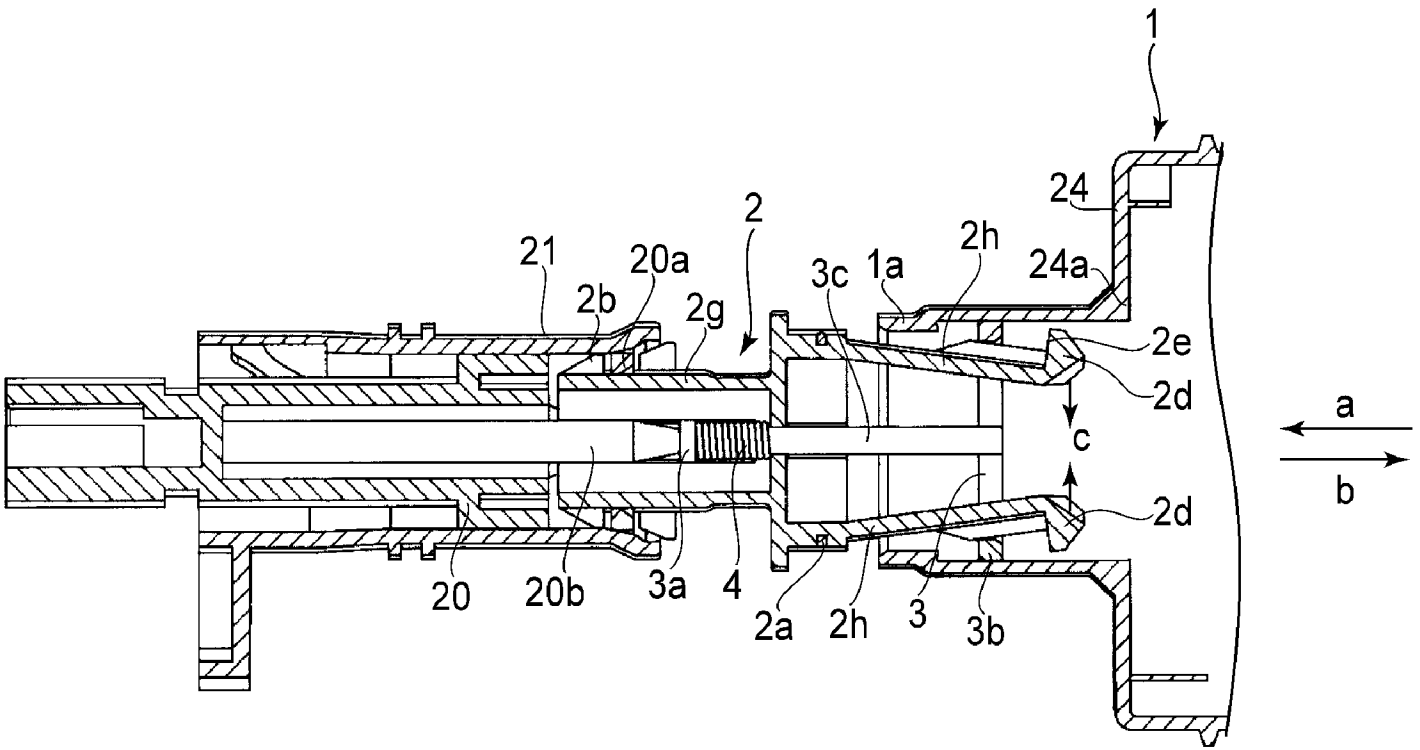
FIG. 24 is a sectional view of the combination of the developer supply container driving portion of the main assembly of the image forming apparatus, and the sealing member portion of the developer supply container, and is for describing the operation for mounting the developer supply container into the main assembly of the image forming apparatus.
Figure 27:
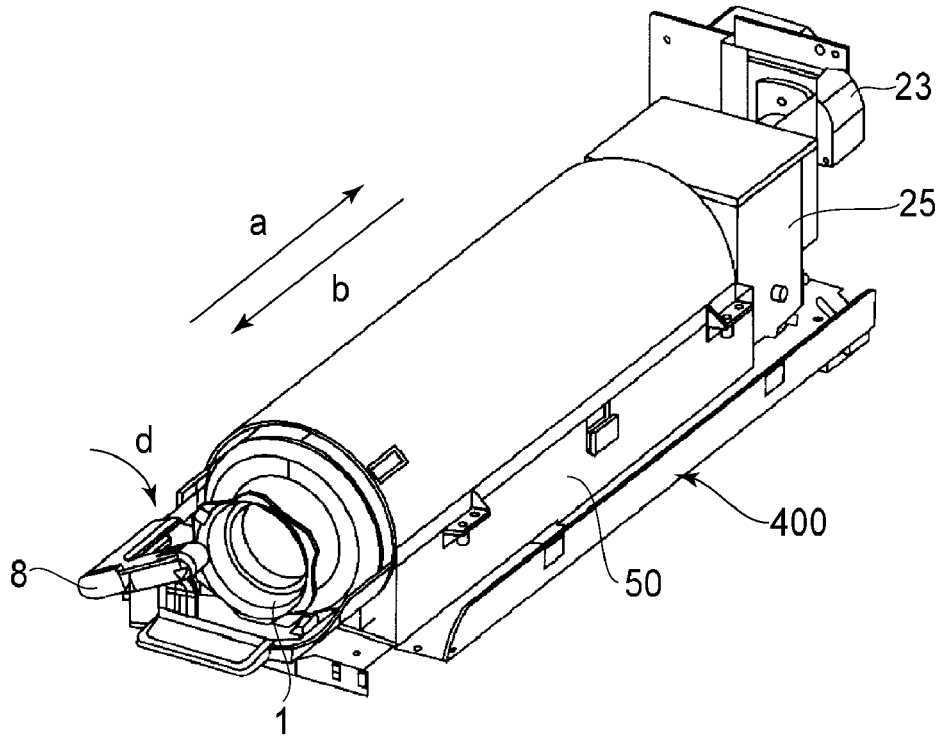
FIG. 27 is a perspective view of the developer supply container, and its adjacencies, when the developer supply container is in the apparatus main assembly; it is for describing the operation for mounting the developer supply container into the main assembly of the image forming apparatus.

Next, the operator is to rotate the set lever 8 in the direction d, from the position shown in FIG. 27 to the position shown in FIG. 28. As the set lever 8 is rotated, the container holder 50 is displaced by the unshown container holder displacement mechanism, in the direction b, which is opposite to the direction in which it was displaced previously. As the container holder 50 displaces in the direction b, only the developer storage portion 24 displaces in the direction b, because the locking projection 2*b* of the sealing member 2 is in engagement with the driving portion 20, as shown in FIG. 24, and also, as described in the section titled as "Locking Projection". As a result, the developer outlet 1*a* becomes unsealed, making it possible for the developer to be discharged. Since the sealing portion 2*a* of the sealing member 2 is structured so that it can be moved out of the developer outlet 1*a* with the application of a very small amount of force, the developer outlet 1*a* can be easily unsealed. That is, the sealing member 2 and developer supply container 1 are structured so that the sealing member 2 can be easily moved out of the developer outlet 1*a* of the developer supply container 1 to unseal the developer outlet 1*a* (developer supply container 1).

On the other hand, during the opposite operation from the above described operation for unsealing the developer outlet 1*a*, that is, when sealing the developer outlet 1*a* of the developer supply container 1 with the sealing member 2, the bumping projection 20*b* of the driving portion 20 is disengaged from the bumping portion 3*a* of the unlocking member 3, as shown in FIG. 22, and therefore, the unlocking member 3 is moved in the direction a by the pressure from the spring 4. Therefore, the plate-like second portion 2*h* of the sealing member 2 displaces in the direction e, causing the locking portion 2*e* to re-engage with the sealing member catching portion 24*a*. In other words, the sealing member 2 becomes locked with the developer storage portion 24, making it impossible for the developer outlet 1*a* to be unsealed.

[Comparative Verification]

Lastly, the results of the comparative verification of this embodiment will be described. FIGS. 5, 6, 29, 30, and 31 show the structures of the sealing members 2 used for the comparative verification of the sealing members 2 structured in accordance with the present invention. Table 1 shows the results of the evaluation of the sealing members 2 in the preferred embodiment of the present invention and in the comparative embodiment of the sealing member 2 (conventional sealing members), in terms of "airtightness", "how easily disengageable", and "prevention of accidental disengagement".

Figure 29:
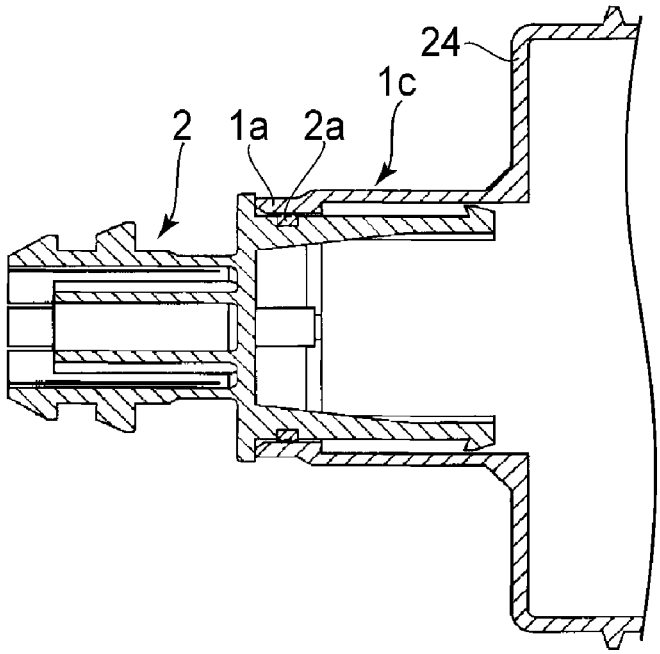
FIG. 29 is a sectional view of the first example of the conventional sealing member.

Referring to FIG. 29, the sealing member 2 used in the first conventional example is shaped so that the sealing portion 2*a* has two lips, and has the "airtightly sealing" function, and "accidental unsealing preventing" function.

Figure 30:
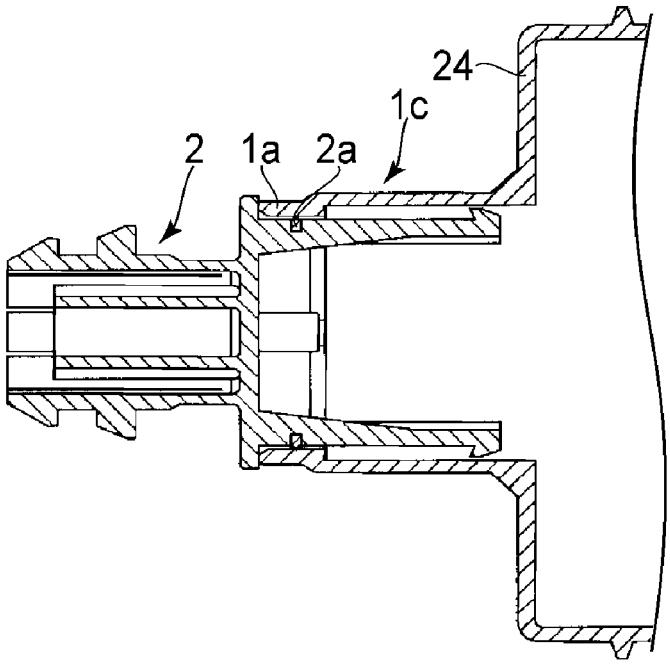
FIG. 30 is a sectional view of the second example of the conventional sealing member.

Next, referring to FIG. 30, the sealing member 2 used in the second conventional example is shaped in consideration of "being easier to disengage." Thus, in order to make the sealing member in the second conventional example smaller in the amount of force necessary to open it than the amount of force necessary to open the sealing member 1 in the first conventional example of the sealing member 1, the sealing portion 2*a* in the second conventional example is given only one lip.

Figure 31:
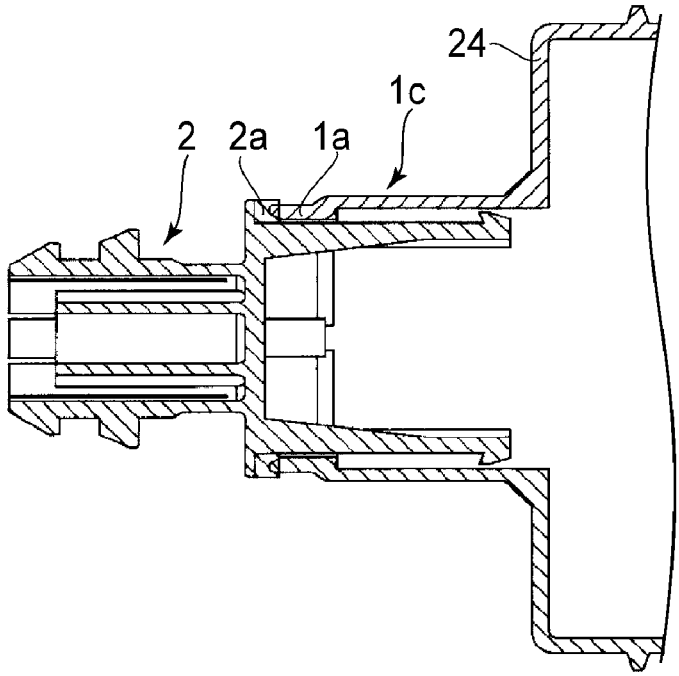
FIG. 31 is a sectional view of the third example of the conventional sealing member.

Next, referring to FIG. 31, the sealing member 2 used in the third conventional example is structured in consideration of "being easier to disengage." Thus, it is structured so that the sealing portion 2*a* is placed in contact with the end surface of the wall of the developer outlet 1*a* to seal the developer outlet 1*a*.

Next, referring to FIG. 5, in terms of the shape of the sealing portion 2*a*, the sealing member 2 used in the first preferred embodiment is the same as the sealing member 2 in the second conventional example. However, it is structured so that both the locking portion 2*e* and unlocking portion 3 are on the sealing member 2 as described before.

Next, referring to FIG. 5, in terms of the shape of the sealing portion 2*a*, the sealing member 2 in the first modified version of the first preferred embodiment is the same as the sealing member 2 in the third conventional example. However, it is structured so that the both the locking portion 2*e* and unlocking portion 3 are on the sealing member 2 as described before.

Next, the method for evaluating the functions of above described structural arrangements for the sealing member 2, in terms of "airtightness", "how easily unsealable", and "accidental unsealing prevention", will be described.

First, as for the evaluation in terms of "airtightness", the developer supply containers 1 were evaluated in terms of whether or not the abovementioned developer supply containers 1 leak developer when they are subjected to the vibrations, which simulated the vibrations which might occur when they are mounted into the developer supplying apparatus 400 shown in FIGS. 25-28, or when they are shipped.

As for the evaluation in terms of "how easily unsealable", a torque gauge was attached to the set lever 8 of the developer supplying apparatus 400 shown in FIGS. 25-28, and the amount of force necessary to rotate the set lever 8 in the direction d was detected.

As for the evaluation in terms of the "accidental unsealing prevention", the amount of force necessary to pull the sealing member 2 out of the developer outlet 1*a* was measured with the use of a multipurpose push-pull gauge.

The results of the above described evaluations are shown in Table 1.

TABLE 1

| | sealing property | unsealing force (Nm) | locking strength (N) |
|---|---|---|---|
| Conv. 1 | G | approx. 2-2.25 | approx. 40-45 |
| Conv. 2 | G | approx. 0.5-0.75 | approx. 10-15 |
| Conv. 3 | NG | approx. 0.5 | approx. 5 |
| Emb. 1 | G | approx. 0.5-0.75 | not openable |
| Mod. 1 | G | approx. 0.5 | not openable |

G: good
NG: no good during transportation

As will be evident from Table 1, the structural arrangement in the first conventional example was satisfactory in terms of the "airtightness" and "accidental unsealing prevention". However, it was very large in the amount of force necessary to pull the sealing member 2 out of the developer outlet 1 to unseal the developer outlet 1*a* when the developer supply container 1 is mounted into the developer supplying apparatus 400. That is, it was very difficult to unseal the developer supply container 1. In other words, it was unsatisfactory in terms of "how easily unsealable".

Next, in terms of "how easily unsealable", the structural arrangement in the second conventional example could be said to be an improvement compared to the structural arrangement in the first conventional example. However, it allows the sealing member 2 to too easily come out of the developer outlet 1*a*, being therefore unsatisfactory in terms of "accidental unsealing prevention".

As for the structural arrangement in the third conventional example, as the developer supply container 1 was subjected to the vibrations, which simulated the vibrations which might occur during the shipment of the developer supply container 1, the sealing member 2 moved out of the developer outlet 1*a*, and the occurrence of developer leak was confirmed. In addition, like the structural arrangement in the second conventional example, it was not satisfactory also in terms of "accidental unsealing prevention", because the sealing member 2 too easily moved out of the developer outlet 1*a*.

As described above, it was confirmed that not only were the developer supply containers 1 in accordance with the conventional technologies unsatisfactory in terms of "airtightness", but also, were unlikely to be satisfactory in terms of both "accidental unsealing prevention" and how easily unsealable".

Next, the first preferred embodiment of the present invention, and its first modified version, were evaluated.

In the case of the structural arrangement in the first preferred embodiment, the occurrence of the developer leak from the developer outlet 1*a* was not confirmed when the developer supply container 1 was subjected to the vibrations, which simulated the vibrations which were expected to occur during the shipment, and also, when the developer supply container 1 was mounted into the developer supplying apparatus 400. In terms of "how easily unsealable", the structural arrangement in the first preferred embodiment was roughly the same as that in the second conventional example. Regarding "accidental unsealing prevention", the sealing member 2 was securely and unmovably locked to the developer storage portion 24. Therefore, it was impossible for the sealing member 2 to be pulled out of the developer outlet 1*a*. That is, it was confirmed that the structural arrangement in the first preferred embodiment has the "accidental unsealing preventing" function.

As for the structural arrangement of the first modified version of the preferred embodiment, it was roughly the same in performance, in terms of the function of "airtightness" and "accidental unsealing prevention", as the first embodiment. However, in terms of "how easily unsealable", it was superior to that in the first preferred embodiment. That is, the amount of force necessary to move the sealing member 2 to unseal the developer outlet 1*a* when mounting the developer supply container 1 into the developer supplying apparatus 400 was smaller than that in the first preferred embodiment.

It was proved by the evaluations of the various structural arrangements given above that the developer supply containers 1 structured in accordance with the present invention was superior in function than the developer supply containers in accordance with the conventional technologies.

As described above, in order to separate the "airtightly sealing" function of the sealing portion 2*a* of the sealing member 2, from the "accidental unsealing preventing" function of the sealing portion 2*a* of the sealing member 2, the sealing member 2 was provided with the unlocking member 3, which conventional sealing members did not have. Therefore, it was ensured that the developer outlet 1*a* remains "airtightly sealed" by the sealing member 2, and also, that not only the developer outlet 1*a* is "prevented from being accidentally unsealed", but also, the developer outlet 1*a* is "easily unsealable". Therefore, it is possible to provide the developer supply container 1 which is superior in usability to any of the conventional developer supply containers.

Embodiment 2

Next, the developer supply container in the second preferred embodiment of the present invention will be described.

The image forming apparatus into which the developer supply container in the second preferred embodiment of the present invention mounted is the same as the image forming apparatus in the first preferred embodiment described above. Thus, in order to avoid repeating the same description, the description of the image forming apparatus in the first preferred embodiment is to be quoted as the description of the image forming apparatus in this embodiment.

Next, the developer supply container in this embodiment will be described.

[Developer Supply Container]

Figure 32:
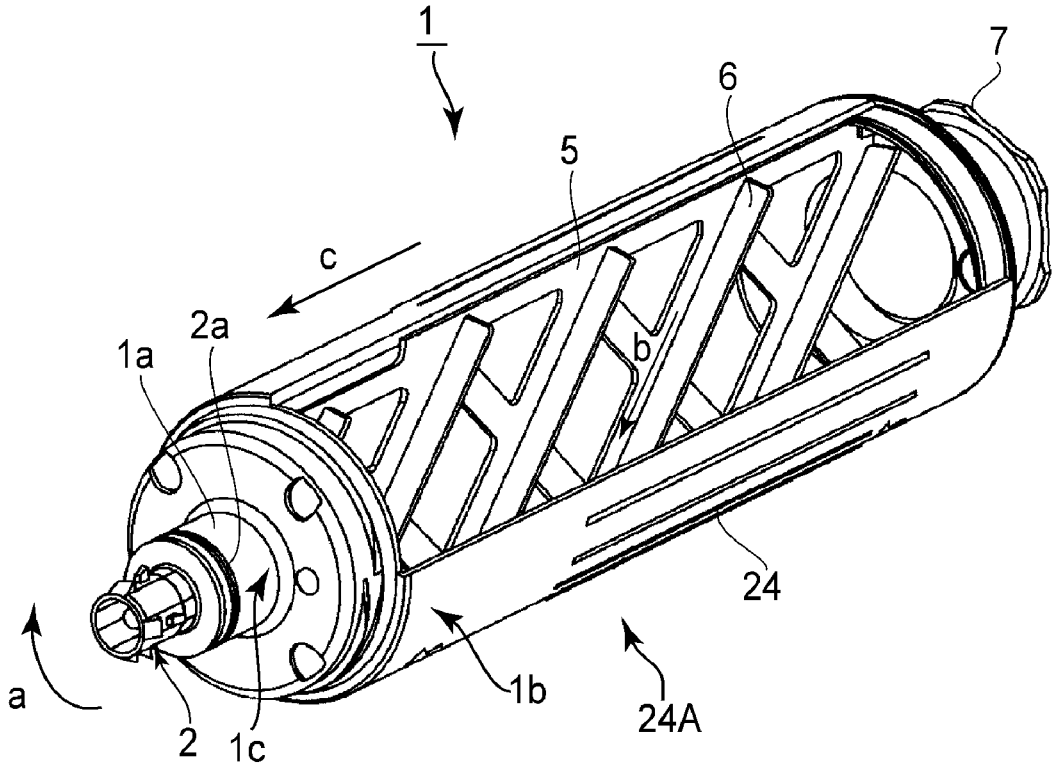
FIG. 32 is a partially broken perspective view of the developer supply container in the second preferred embodiment of the present invention.

FIG. 32 is a perspective view of the developer supply container 1 in this preferred embodiment.

Referring to FIG. 32, in terms of the overall structure, the developer supply container 1 in this embodiment is the same as the developer supply container 1 in the first preferred embodiment. That is, it is made up of a container proper 24A having a large diameter portion 1*b* and a small diameter portion 1*c*. The container proper 24A has a developer storage portion 24, which includes the small diameter portion 1*c*. The small diameter portion 1*c* has a developer outlet 1*a*, which is in the end portion of the small diameter portion 1*c*. The lengthwise opposite end of the developer storage portion 24 from the small diameter portion 1*c* is provided with a flange 7. The developer supply container 1 is provided with a developer conveying member 5 (which is baffling member) for conveying the developer. The developer conveying member 5 is in the developer storage portion 24. Further, the developer supply container 1 is provided with a sealing member 2, which is disposed in such a manner that it can seal the developer outlet 1*a*. Next, referring to FIGS. 5(*a*), 5(*b*), 5(*c*), and 5(*d*), the developer supply container 1 is provided with the sealing member 2 for sealing the developer outlet 1*a*, and a regulating member 3 for regulating the unlocking of the sealing member 2 from the developer outlet 1*a* shown in FIG. 33.

Next, referring to FIG. 32, the internal structure of the developer supply container 1 will be described.

[Conveying Member]

As described above, the container proper 24A, that is, the main portion of the developer supply container 1, is roughly cylindrical. The container proper 24A and apparatus main assembly 100 are structured in such a manner that the container proper 24*a* is roughly horizontally, and rotatably, placed in the apparatus main assembly 100, and rotates as it is rotationally driven by the apparatus main assembly 100. The inside of the container proper 24A of the developer supply container 1 is provided with the internal baffling member 5 (baffling plate), which is in the form of a piece of plate, as described before. Each of the primary surfaces of the baffling member 5 is provided with multiple ribs, which are slanted relative to the rotational axis of the developer supply container 1. The end of one of the slanted ribs 6 is in contact with the small diameter portion 1*c*. The developer supply container 1 is structured so that the developer in the developer supply container 1 is conveyed toward the developer outlet 1*a* by the multiple slanted ribs 6, and is discharged from the developer supply container 1 through the developer outlet 1*a*.

The principle based on which the developer is discharged is as follows. That is, referring to FIG. 32, as the developer supply container 1 is rotated in the direction a, the developer is lifted by the baffling member 5, and then, slides down on the slanted ribs 6 in the direction b, being eventually conveyed to the developer outlet 1*a* of the developer supply container 1 by the slanted ribs 6. As this operation is repeated, the developer in the developer supply container 1 is gradually conveyed, while being stirred, and then, is discharged from the developer supply container 1 through the developer outlet 1*a*.

The method for driving the developer supply container 1 in accordance with the present invention does not need to be limited to the above described one in this embodiment, that is, the rotational driving of the developer supply container 1. That is, the developer supply container 1 may be vibrated, shaken, etc., to discharge the developer through the developer outlet 1*a*. In other words, as long as the developer is properly discharged through the developer outlet 1*a*, the method for driving the developer supply container 1 does not matter.

That is, as long as the apparatus main assembly 100 and developer supply container 1 are structured so that as the developer supply container 1 is driven by the apparatus main assembly 100, the developer is properly discharged from the developer supply container 1, the developer supply container 1 may be driven by any of the abovementioned methods; it may be rotated, swung back and forth, or vibrated.

Further, as long as the developer supply container 1 and apparatus main assembly 100 are structured so that as the developer in the developer supply container 1 is properly conveyed and discharged from the developer supply container 1, the means for conveying the developer in the developer supply container 1 to the developer outlet 1*a* as the developer supply container 1 is driven as described above does not need to be limited to the baffling member 5. For example, the internal surface of the cylindrical portion of the developer storage portion 24 may be provided with a spiral rib(s) (developer conveying portion(s)), or a spiral groove(s) (developer conveying portion(s)). In terms of developer stirring performance, the spiral groove is inferior to the baffling member 5. However, the spiral groove can be integrally formed as a part of the developer storage portion 24, and therefore, is advantageous in terms of cost. Thus, it is desired that the method for conveying the developer in the developer supply container 1 and the method for driving the developer supply container 1 are properly selected based on the required specifications for an image forming apparatus.

[Sealing Member]

Figure 33:
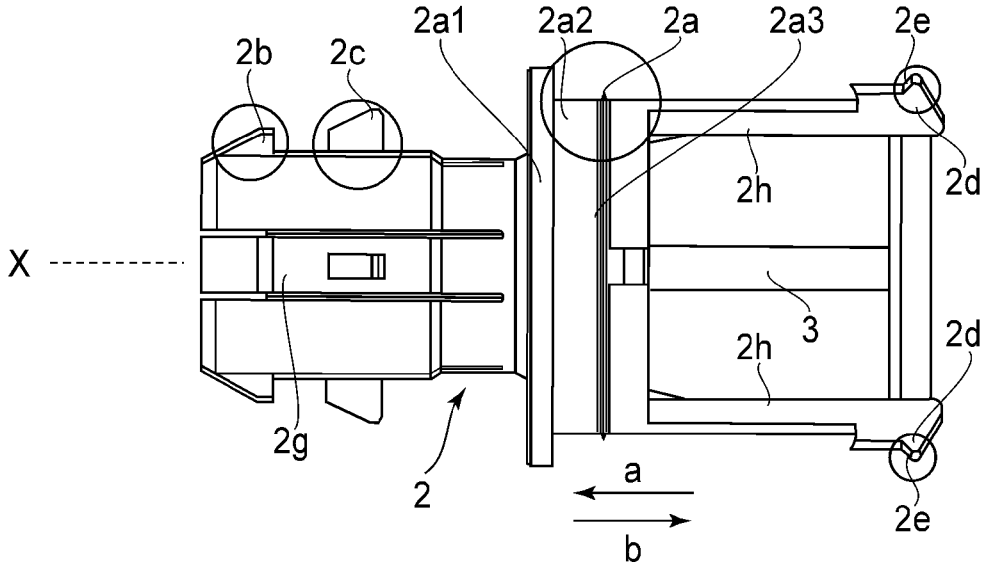
FIG. 33(*a*) is a front view of the combination of the sealing member and sealing member unlocking member.
Figure 33:
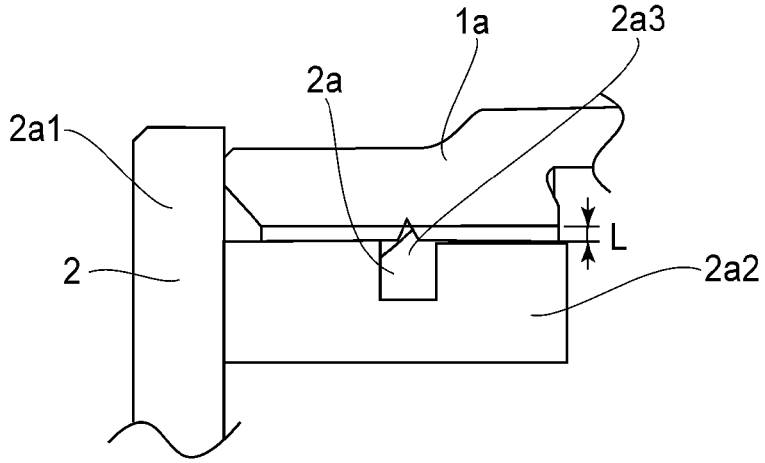

Next, referring to FIGS. 33(*a*) and 33(*b*), the sealing member 2 used in this embodiment will be described. FIG. 33(*a*) is a front view of the sealing member 2 and unlocking regulating member 3. FIG. 33(*b*) is an enlarged view of a part of the sealing member 2*a*, and a part of the developer outlet 1*a*.

Referring to FIG. 33(*a*), the sealing member 2 has a sealing portion 2*a*, a locking projection 2*b*, an unlocking projection 2*c*, a container driving force transmitting portion 2*d*, and a locking portion 2*e*. Further, the sealing member 2 has a plate-like first portion 2*g* having the locking projection 2*a* and unlocking projection 2*b*, and a plate-like second portion 2*f* having the container driving force transmitting portion 2*d* and locking projection 2*b*. The sealing member 2 is made of a resin. The sealing member 2 is injection-molded in such a manner that the abovementioned portions of the sealing member 2 are integrally formed with the main portion of the sealing member 2.

The plate-like first portion 2*g* is an elastically deformable portion (which is sometimes referred to as extending portion or cantilever portion), and extends from the sealing member 2 in the direction a (parallel to rotational axis X of developer supply container 1). That is, the plate-like first portion 2*g* is an elastically deformable portion of the sealing member 2, and extends away from the container proper 24A. It is structured so that as it is subjected to an external force, it is capable of deforming (elastically deforming) inward of the sealing member 2 in terms of the diameter direction of the developer supply container 1, and also, so that as it is freed from the external force, it is capable of elastically returning where it was before it was subjected to the external force, in the outward direction of the sealing member 2 in terms of the diameter direction of the developer supply container 1. In other words, the plate-like first portion 2*g* is deformable to the adjacencies of the rotational axis X of the container proper by an external force. It is also capable of flexing back in the direction to move away from the rotational axis X as it is freed from the external force.

Similarly, the plate-like second portion 2*h* is an elastically deformable portion (which may be referred to as extension or cantilever) of the sealing member 2, and extends away from the sealing portion 2*a* toward the container proper 24A. It is structured so that as it is subjected to an external force, it is capable of deforming (elastically deforming) inward of the sealing member 2 in terms of the diameter direction of the developer supply container 1, and also, so that as it is freed from the external force, it is capable of elastically returning where it was before it was subjected to the external force, in the outward direction of the sealing member 2 in terms of the diameter direction of the developer supply container 1. In other words, the plate-like second portion 2*h* is deformable to the adjacencies of the rotational axis X of the container proper 24A by an external force. It is also capable of elastically flexing back in the direction to move away from the rotational axis X as it is freed from the external force.

Next, referring to FIGS. 33-40, the functions of each of the abovementioned portions of the sealing member 2 and the portions of the members related to the sealing member 2 will be described in detail.

[Sealing Portion]

Figure 34:
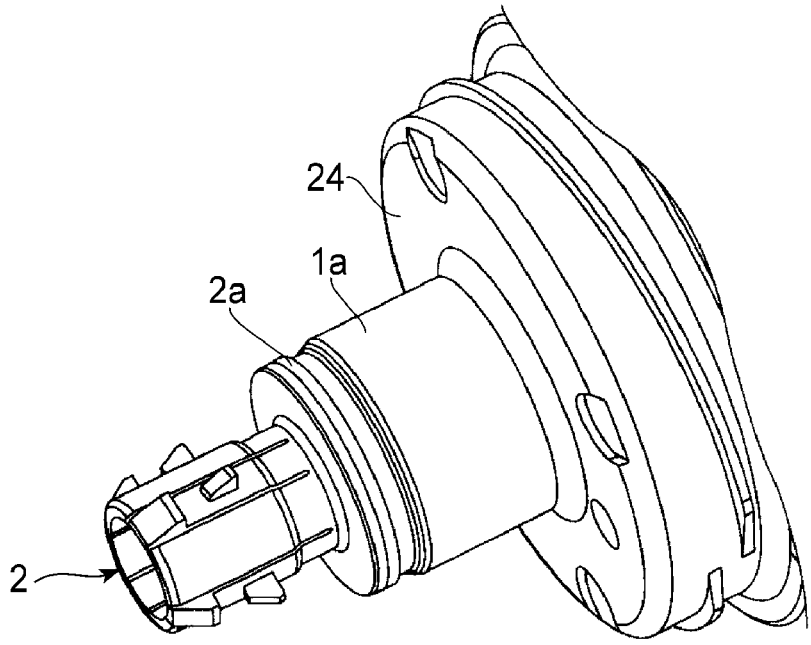
FIG. 34(*a*) is a perspective view of the sealing portion of one of the modified versions of the second preferred embodiment, and FIG. 34(*b*) is a sectional view of the sealing portion shown in FIG. 34(*a*).
Figure 34:
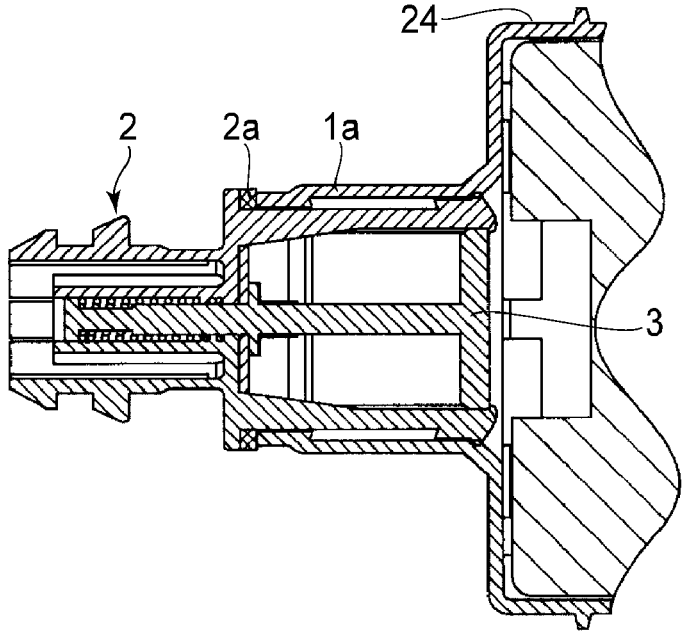

First, referring to FIGS. 33(*a*)-33(*b*), 34(*a*), and 34(*b*), the sealing portion 2*a* will be described. FIGS. 34(*a*) and 34(*b*) show the sealing portion of the sealing member 2 in a first modified version of the second preferred embodiment. FIG. 34(*a*) is a perspective view of the sealing portion, and FIG. 34(*b*) is a front view of the sealing portion.

Referring to FIG. 33(*a*), the sealing portion 2*a* has: a flange portion 2*a*1, which comes into contact with the edge of the developer outlet 1*a*; a cylindrical portion 2*a*2, which extends inward of the container proper from the flange portion 2*a*1; and an elastic portion 2*a*3 (ring), which is fitted around the cylindrical portion 2*a*2 and contacts the cylindrical internal surface of the developer outlet 1*a*. The sealing member 2 and developer outlet 1*a* have the "accidental unsealing preventing" function given by the locking mechanism (which will be described later). Thus, the sealing portion 2*a* is structured so that the primary object of the sealing portion 2*a* is to keep the developer outlet 1*a* "airtightly sealed". That is, the sealing portion 2*a* does not need to be shaped to have both the "airtightly sealing" function, and "accidental unsealing preventing" function; it may be structured primarily to keep the developer outlet 1*a* "airtightly sealed", and to make it "easier to unseal the developer outlet 1*a*".

Next, referring to FIG. 33(*b*), the elastic portion 2*a*3 is shaped so that its largest diameter portion is greater in diameter by a proper amount L than the internal diameter of the developer outlet 1. Thus, as the elastic portion 2*a*3 is pressed into the developer outlet 1*a*, the developer outlet 1*a* becomes airtightly sealed, preventing thereby the developer from leaking from the developer outlet 1*a*.

In order for the sealing portion 2*a* to airtightly seal the developer outlet 1*a* by being pressed into the developer outlet 1*a*, the sealing portion 2*a* needs to be provided with a proper amount of elasticity. Thus, it is common practice to use one of such substances as various rubbers, foamed urethane, and the like, as the material for the sealing portion 2*a*. In the case of this embodiment, a silicon rubber was used as the material for the sealing portion 2*a*.

Further, referring to FIG. 33(*b*), the sealing portion 2*a* in this embodiment is shaped so that the sealing portion 2*a* has only a single sealing projection (which hereafter may be referred to as "single lip"). In other words, in order to minimize the amount of force necessary to unseal the developer outlet 1*a*, the area of contact between the internal wall of the developer outlet 1*a* and the sealing projection was made as small as possible.

Incidentally, the sealing portion 2*a* does not need to be shaped so that it has only a single lip. Further, the material for the sealing portion 2*a* does not need to be limited to one of the above-mentioned substances. In essence, all that is required of the shape and structure of the sealing portion 2*a* is that they can make the amount of force necessary to move the sealing member 2 out of the developer outlet 1*a* as small as possible while preventing the developer from leaking from the developer outlet 1*a*.

For example, referring to FIGS. 34(*a*) and 34(*b*), the sealing member 2 may be structured so that its sealing portion 2*a* presses on the end surface of the wall of the developer outlet 1*a* to seal the developer outlet 1*a*, as the first modified version of this embodiment. In such a case, the sealing member 2 is not structured so that the sealing portion 2*a* is pressed into the developer outlet 1*a*, as shown in FIG. 5(*a*), to airtightly seal the developer outlet 1*a*. Therefore, the amount of force necessary for unsealing the developer outlet 1*a*, that is, the amount of force necessary for moving the sealing member 2 away from the developer outlet 1*a*, is even smaller.

[Locking Projection]

Figure 35:
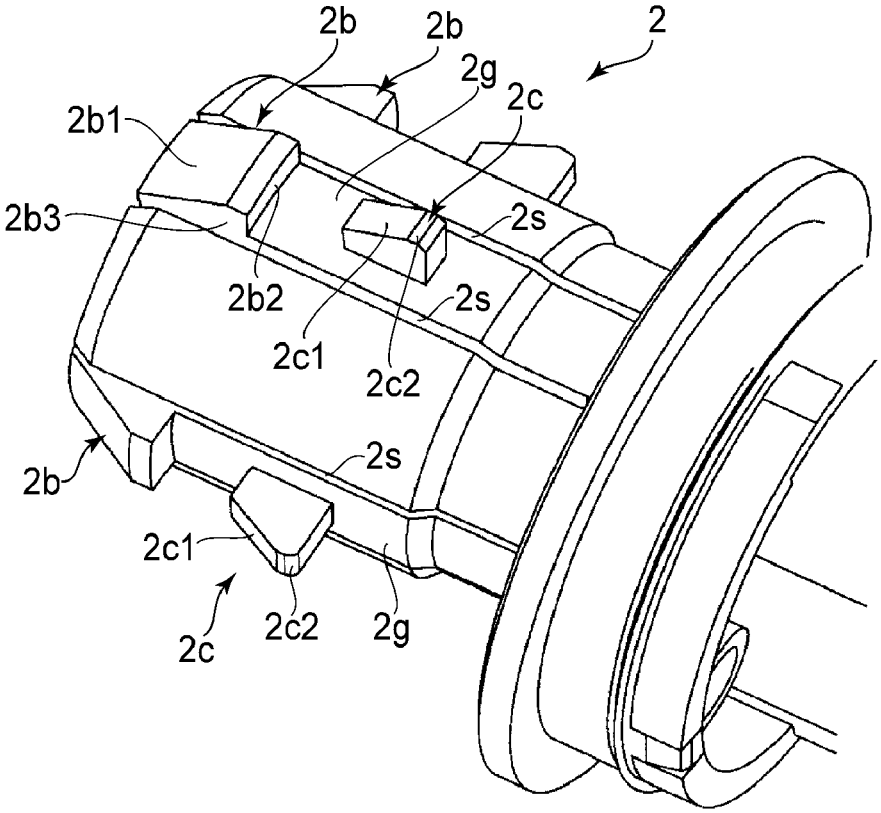
FIG. 35 is an enlarged perspective view of a part of the sealing member.
Figure 36:
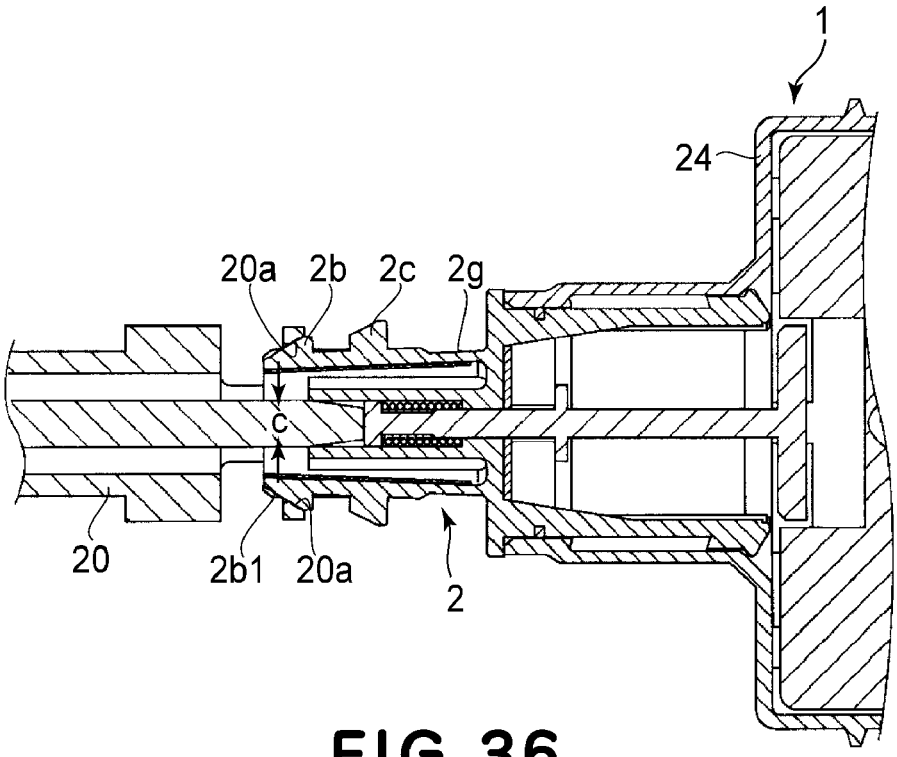
FIG. 36 is a sectional view of the sealing member when the sealing member is in the main assembly of the image forming apparatus.
Figure 37:
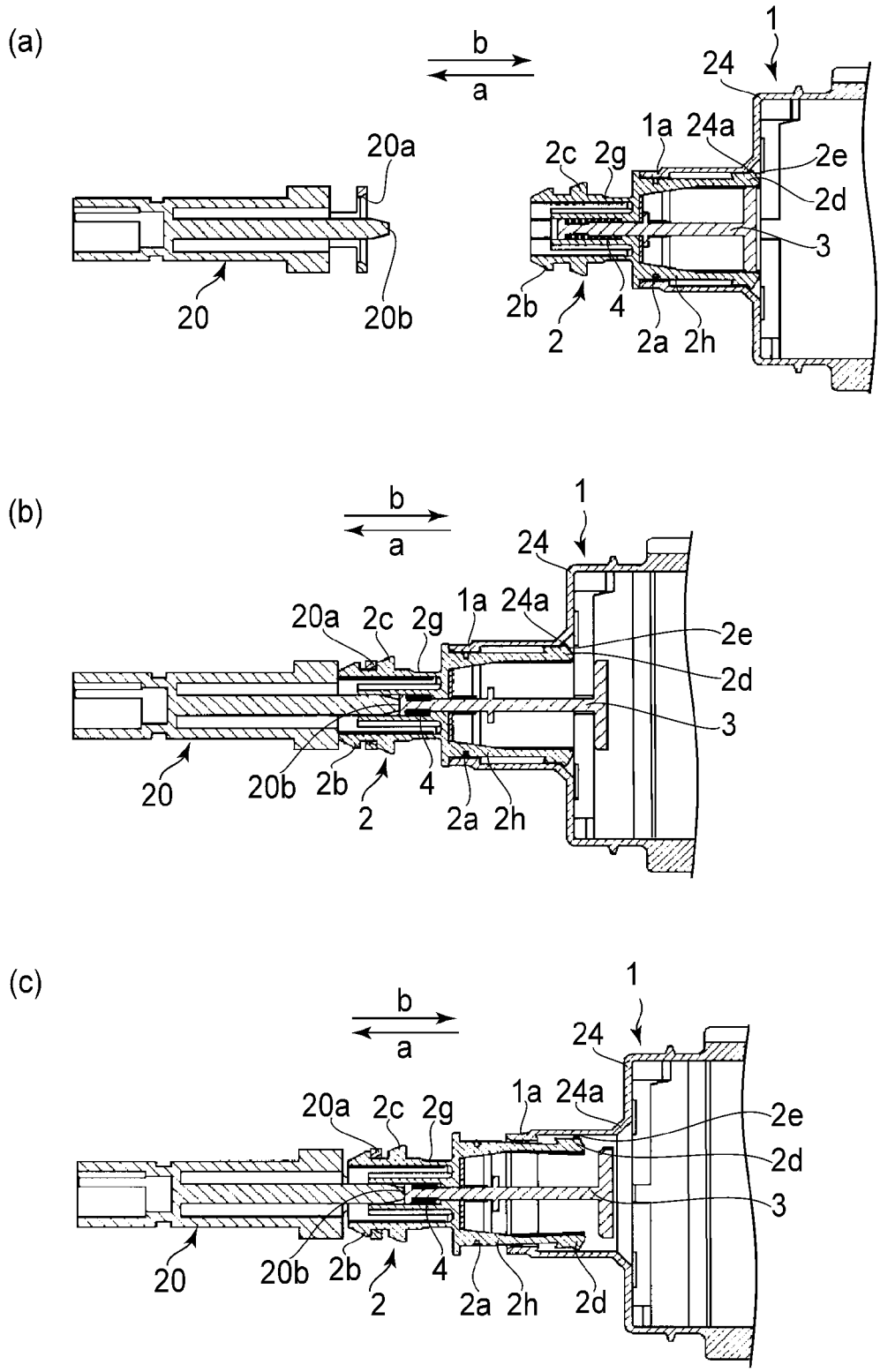
FIGS. 37(*a*)-37(*c*) are sectional views of the combination of the developer container driving portion of the main assembly of the image forming apparatus, and the sealing member portion of the developer supply container, and are for describing the operation for connecting the developer supply container to the developer supply container driving portion of the main assembly.

Next, referring to FIGS. 35, 36, and 37(*a*)-37(*c*), the structure of the locking projection 2*b* will be described. FIG. 35 is an enlarged perspective view of the sealing member portion of the developer supply container, and FIG. 36 is a sectional view of the sealing member portion of the developer supply container, after the plate-like first portion 2*g* of the sealing member 2 deformed in the apparatus main assembly 100. FIG. 37(*a*) is a sectional view of the driving portion 20, and a front portion of the developer supply container 1, before the mounting of the developer supply container 1 into the apparatus main assembly 100, and FIG. 37(*b*) is a sectional view of the driving portion 20 and a front portion of the sealing member 2, after the mounting of the developer supply container 1 into the apparatus main assembly 100. FIG. 37(*c*) is a sectional view of the driving portion 20 and the front portion of the developer supply container 1, after the sealing member 2 was moved to unseal the developer outlet 1*a* of the developer supply container 1.

Referring to FIG. 35, the locking projection 2*b* is at the leading end of each of the multiple plate-like first portion 2*g* of the sealing member 2. There are slits 2*s* on both sides of each plate-like first portion 2*g*, making it possible for the plate-like first portion 2*g* to deform in a direction c indicated in FIG. 36. Also referring to FIG. 35, the leading end of the locking projection 2*b* is provided with a tapered portion 2*b*1, and the opposite end of the locking projection 2*b* from the tapered portion 2*b*2, in terms of the axial line of the developer supply container 1, is a locking surface 2*b*2, which is roughly perpendicular to the plate-like first portion 2*g*. The lateral surfaces which connect the leading end of the locking projection 2*b* and the opposite end of the locking projection 2*b* make up a driving force catching portion 2*b*3, which receives the driving force from the driving portion 20 of the apparatus main assembly 100.

Next, referring to FIG. 37(*a*), in order to ensure that when the developer supply container 1 is mounted into the apparatus main assembly 100, the sealing member 2 smoothly enters the driving portion 20, the sealing member side of the driving portion 20 is provided with a tapered surface 20*a*, that is, a conic surface which gradually reduces in the internal diameter. Thus, as the developer supply container 1 is moved in the direction a, the plate-like first portion 2*g*, which has the locking projection 2*b*, is elastically deformed in the direction c by the combination of the tapered surface 20*a* of the driving portion 20, and the tapered portion 2*b*1 of the leading of the locking projection 2*b*, as shown in FIG. 36.

Next, referring to FIG. 37(*b*), as the developer supply container 1 is moved in the direction a, the sealing member 2 is smoothly inserted into the driving portion 20. Then, as the developer supply container 1 is moved further in the direction a, the plate-like first portion 2*g* is made to restore its shape by its elasticity. Consequently, the sealing member 2 becomes engaged (locked) with the driving portion 20 by its locking projection 2*b* in such a manner that it cannot move either in the direction a, or direction b. In other words, the sealing member 2 becomes engaged (locked) with the driving portion 20 in such a manner that it cannot moved in the thrust direction, except for a small amount of play between the driving portion 20 and locking projection 2*b*.

Further, as the developer supply container 1 is moved into the position shown in FIG. 37(*b*), the unlocking regulating member 3 is moved in the direction b, relative to the sealing member 2, by the unlocking projection 20*b* (which hereafter may be referred to "bumping projection") of the driving portion 20.

The details of the operation carried out by the above described unlocking regulating member 3 to engage the sealing portion 2*a* of the sealing member 2 with the sealing member catching portion 24*a* of the developer storage portion 24, or to disengage the sealing portion 2*a* of the sealing member 2 from the sealing member catching portion 24*a* of the developer storage portion 24, will be described later.

Referring to FIG. 37(*c*), the sealing member 2 is remaining engaged with the driving portion 20 by being pressed toward the driving portion 20. Thus, as the developer storage portion 24 moves in the direction b, only the developer storage portion 24 moves in the direction b. As a result, the sealing member 2 comes out of the developer outlet 1*a*, unsealing thereby the developer outlet 1*a*, and therefore, it becomes possible for the developer to be discharged. Further, as the driving portion 20 rotates, the sealing member 2 rotates by receiving the rotational force from the driving portion 20 through a driving force receiving portion 2*b*3 (FIG. 35).

From the standpoint of the special efficiency of the apparatus main assembly 100 and the cost of the apparatus main assembly 100, described next is the most preferable structure for the image forming apparatus in this embodiment.

That is, the image forming apparatus and developer supply container 1 in this embodiment is structured so that the developer outlet 1*a* is unsealed by keeping the sealing member 2 and driving portion 20 attached (locked) to each other by moving the developer supply container 1 and using the engagement between the locking projection 2*b* of the sealing member 2, and the driving portion 20 of the apparatus main assembly 100, and also, so that the driving force from the apparatus main assembly 100 is transmitted to the developer supply container 1 by using the driving force receiving portion 2*b*3 of the locking projection 2*b*. However, the structural setup for transmitting the driving force to the developer supply container 1 does not need to be limited to this setup.

For example, the apparatus main assembly 100 and developer supply container 1 may be structured so that as the developer supply container 1 is mounted into the apparatus main assembly 100, the driving portion 20 engages with the sealing member 2 by being moved in the direction b by the mounting of the developer supply container 1, and then, the sealing member 2 is moved out of the developer outlet 1, unsealing thereby the developer outlet 1*a*, by the movement of the driving portion 20 in the direction a.

Further, the apparatus main assembly 100 and developer supply container 1 may be structured so the sealing member 2 is provided with a gear 2*i* to transmit the driving force from a driving motor 23 of the apparatus main assembly 100 to the sealing member 2 through the gear 2*i* to rotate the sealing member 2, as in the first referred embodiment described referring to FIG. 10.

[Unlocking Projection]

Figure 38:
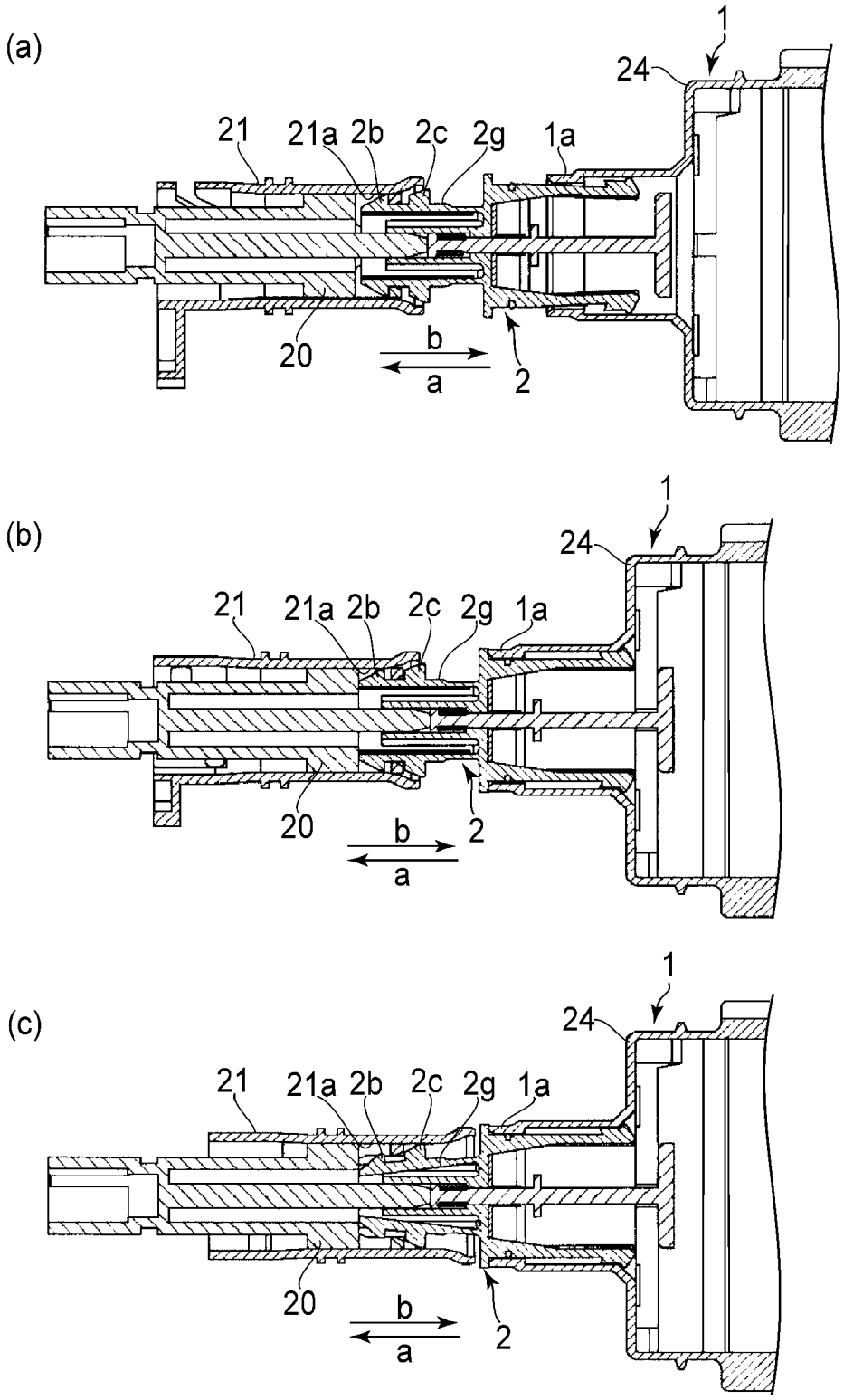
FIGS. 38(*a*)-38(*c*) are sectional views of the combination of the developer container driving portion of the main assembly of the image forming apparatus, and the sealing member portion of the developer supply container, and are for describing the operation for disconnecting the developer supply container from the developer supply container driving portion of the main assembly.
Figure 39:
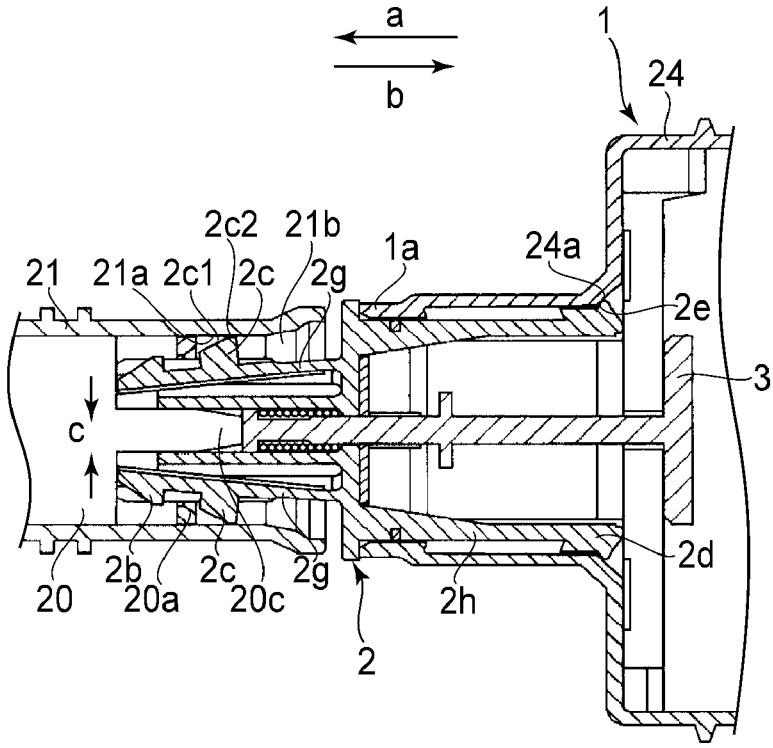
FIG. 39 is a sectional view of the combination of the developer supply container driving portion of the apparatus main assembly, sealing member portion of the developer supply container, and the developer supply container unlocking member of the developer supply container, and is for describing the operation for unlocking the sealing member.

Next, referring to FIGS. 35, 36, 38(*a*)-38(*c*), and 39, the structure of the unlocking projection 2*c* will be described. FIG. 38(*a*) is a sectional view of the combination of the developer container driving portion of the main assembly of the image forming apparatus, and the front portion of the developer supply container 1, when the sealing member 2 of the developer supply container 1 is not in the position in which it keeps the developer outlet 1*a* sealed. FIG. 38(*b*) is a sectional view of the combination of the developer container driving portion 20 of the main assembly of the image forming apparatus, and the front portion of the developer supply container 1, when the sealing member 2 is in the position in which it keeps the developer outlet 1*a* sealed. FIG. 38(*c*) is a sectional view of the combination of the developer container driving portion of the main assembly of the image forming apparatus, and the front portion of the developer supply container 1, after the disengagement of the driving portion 20 of the apparatus main assembly 100 from the locking projection 2*b* by the unlocking projection 2*c*. FIG. 39 is a sectional view of the unlocking regulating member 3 and its adjacencies, and shows the operation of the unlocking regulating member 3.

Referring to FIG. 35, the unlocking projection 2*c* is on each of the multiple plate-like first portion 2*g* having the locking projection 2*b*. It is between the locking projection 2*b* and the base portion of the plate-like first portion 2*g*. The unlocking projection 2*c* has the tapered portion 2*c*1, which is at the leading end of the unlocking projection 2*b*, and a contact surface 2*c*2, which is at the edge of the sealing member 2, in terms of the diameter direction of the developer supply container 1. As described before, there is the slit 2*s* on each side of the plate-like first portion 2*g*, and the end portion of the plate-like first portion 2*g* is bendable in the direction c, as shown in FIG. 36.

Next, referring to FIG. 38(*a*), when the locking projection 2*b* is in engagement with the driving portion 20 of the apparatus main assembly 100, there is a gap between the unlocking projection 2*c* and the disengaging portion 21 of the apparatus main assembly 100.

Next, referring to 38(*b*), when the developer supply container 1 is replaced, the developer storage portion 24 is moved in the direction a. As the developer storage portion 24 is moved in the direction a, the developer outlet 1*a* is sealed by the sealing member 2. At this point in time, there is still a gap between the disengaging portion 21, and the unlocking projection 2*c* of the sealing portion 2. Thus, the locking projection 2*b* and driving portion 20 remain engaged with each other.

Next, referring to FIG. 38(*c*), the unlocking portion 21 of the apparatus main assembly 100 is moved in the direction b, and the contact surface 21*a* of the unlocking portion 21 comes into contact with the contact surface 2*c*2 of the unlocking projection 2*c*, as shown in FIG. 39. During this process, the plate-like first portion 2*g* smoothly displaces in the direction c, because of the relationship between the tapered surface 21*b* of the disengaging portion 21, and the tapered surface 2*c*1 of the unlocking projection 2*c*. Therefore, the unlocking projection 2*c* of the plate-like first portion 2*g* also displaces in the direction c.

Here, the locking projection 2*b* also displaces in the direction c, because it is a part of the plate-like first portion 2*g*. As a result, the locking projection 2*b* becomes disengaged from the driving portion 20. Thereafter, as the developer supply container 1 displaces further in the direction b, the sealing member 2 separates from the driving portion 20, making it possible for the developer supply container 1 to be removed from the apparatus main assembly 100.

Incidentally, the plate-like first portion 2*g* of the sealing member 2, which is provided with the locking projection 2*b* and unlocking projection 2*c*, is desired to be formed of a resinous substance, such as plastic, by injection molding. However, it may be formed of the material other than a resinous substance, with the use of a manufacturing method other than injection molding. Further, the plate-like first portion 2*g* does not need to be formed in a single piece; it may be formed of two or more pieces, which are joined to form the plate-like first portion 2*g*. As a substance to be used as the material for injection-molding the plate-like first portion 2*g*, low density polyethylene is most preferable. However, polypropylene, straight chain polyamide, for example, Nylon (commercial name), high density polyethylene, polyester, ABS, HIPS (high impact polystyrene), etc., can also be used as preferable materials. Further, it may be manufactured of an elastically deformable metal or the like.

As described above, the plate-like first portion 2*g* which is provided with the locking projection 2*b* and unlocking projection 2*c* is formed as an elastically deformable member. Therefore, the driving portion 20 and locking projection 2*b* can be easily engaged or disengaged by utilizing the elasticity of the plate-like first portion 2*g*. Therefore, they can be made simple in structure. Further, the substances listed above as the materials for the plate-like first portion 2*g* have a proper amount of elasticity. Therefore, the driving portion 20 and locking projection 2*b* can be easily engaged with each other or disengaged from each other, while being satisfactorily durable.

In this embodiment, the sealing member 2 is provided with the unlocking projection 2*c* to make it simpler to disengage the locking portion 2*b* and driving portion 20 from each other. However, the above described structural arrangement is not mandatory; the provision of the unlocking projection 2*c* is not mandatory.

For example, the driving portion 20 may be structured as shown in FIG. 13(*a*), which was used to describe the first preferred embodiment. That is, the driving portion 20 of the apparatus main assembly 100 may be separated into a first driving portion 20A and a second driving portion 20B.

In this case, the first driving portion 20A and second driving portion 20B are rotatably supported by a pair of shafts Q and R, respectively, with which the driving portion 20 is provided. Thus, as the first and second driving portion 20A and 20B displace in the direction b, the driving portion 20 engages with the locking projection 2*b*. Further, the sealing member 2 and driving portion 20 may be structured as shown in FIG. 13(*b*). That is, as the first and second driving portions 20A and 20B displace in the direction a, the driving portion 20 disengages from the locking projection 2*b*. In this case, however, the apparatus main assembly 100 becomes complicated in structure. Therefore, it is most preferable that the structural arrangement in the second preferred embodiment is used.

[Container Driving Force Transmitting Portion]

Next, referring to FIGS. 33(*a*) and 33(*b*), the container driving force transmitting portion 2*d* will be described. FIGS. 33(*a*) and 33(*b*) are as described previously.

Referring to FIGS. 33(*a*) and 33(*b*), one of the lengthwise end portions of the sealing member 2 is provided with the locking projection 2*b* and unlocking projection 2*c*, and the opposite lengthwise end of the sealing member 2 is provided with a container driving force transmitting portion 2*d*, which is a part of the plate-like second portion 2*h*. The container driving force transmitting portion 2*d* engages with the container driving force catching portion 24*c* of the developer storage portion 24 (FIG. 5(*d*)), which is near the developer outlet 1*a*, when the sealing member 2 is in the position in which it does not seal the developer outlet 1*a*, as in the first preferred embodiment.

Therefore, the rotational driving force which the sealing member 2 receives from the driving portion 20 of the image forming apparatus 100 is transmitted to the container driving force transmitting portion 2*d* through the locking projection 2*b* of the sealing member 2, and then, is transmitted to the container driving force catching portion 24*c* of the developer storage portion 24. Therefore, the developer supply container 1 becomes rotatable to supply the apparatus main assembly 100 with the developer.

In this embodiment, the image forming apparatus was structured so that the developer supply container 1 is rotated by transmitting the driving force from the apparatus main assembly 100 to the developer supply container 1 through the container driving force transmitting portion 2*d* of the sealing member 2. However, it is not mandatory that the means for rotating the developer supply container 1 is limited to the one in this embodiment.

For example, like the image forming apparatus in the first preferred embodiment described previously referring to FIG. 14, the image forming apparatus in this embodiment may be structured so that the developer supply container 1 is provided with a gear 24*b*, which is fitted around the peripheral surface of the developer storage portion 24, whereas the apparatus main assembly 100 is provided with a member 9 which is solidly attached to the apparatus main assembly 100, and to which the sealing member 2 is engaged to be disengaged from the developer outlet 1*a* to unseal the developer outlet 1*a*.

Here, the relationship between the solidly attached member 9 and sealing member 2 in this embodiment are the same as the relationship between the driving portion 20 and sealing member 2 in the first preferred embodiment, except for the transmission of driving force. That is, the apparatus main assembly 100 and developer supply container 1 may be structured so that the developer outlet 1*a* is unsealed, as described in the section titled "Locking Projection", while the sealing member 2 remains engaged with the solidly attached member 9, and then, the force for driving the developer supply container 1 is directly transmitted from the motor 23 of the apparatus main assembly 100 to the container gear 24*b* of the developer storage portion 24.

However, in terms of cost and special efficiency, the structural arrangement, such as this one, is disadvantageous, not only making it therefore difficult to reduce the apparatus main assembly 100 in size, but also, making the developer supply container 1 complicated in structure as well as shape.

Further, in this preferred embodiment, the locking portion 2*e*, shown in FIG. 33, doubles as the container driving force transmitting portion 2*d*. Therefore, if the sealing member 2 fails to be disengaged from the developer outlet 1*a* because of the problems having occurred to the developer supply container 1 and/or apparatus main assembly 100 (if developer supply container 1 fails to be accurately mounted), the container driving force is not transmitted to the sealing member 2, and therefore, the developer supply container 1 does not rotate. Therefore, the apparatus main assembly 100 is not supplied with the developer. Thus, even after the replacement of the old developer supply container 1, from which the developer has been exhausted, with a brand-new developer supply container 1, the apparatus main assembly 100 fails to recognize the replacement. Therefore, it is possible for an operator to be informed that the developer supply container 1 is having a problem, or the developer supply container 1 failed to be accurately mounted.

In the case of the structural arrangement, in which the force for driving the developer supply container 1 is directly transmitted from the apparatus main assembly 100 to the container gear 24*b* of the developer storage portion 24, the developer supply container 1 rotates anyway even if there is a problem, such as the above described one. Therefore, it is possible that an unexpected incident may occur. Also because of this reason, the structural arrangement in the first second embodiment may be said to be the most desirable one.

[Locking Portion]

Figure 40:
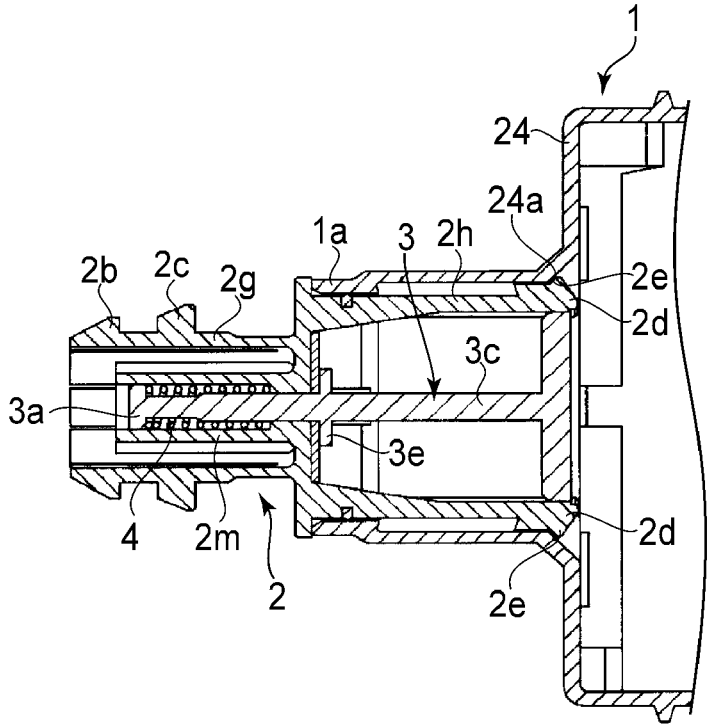
FIG. 40 is a sectional view of the sealing member portion of the developer supply container prior to the mounting of the developer supply container into the main assembly of the image forming apparatus.

Next, referring to FIGS. 33(*a*), 33(*b*) and 40, the locking portion 2*e* will be described. FIG. 40 is a sectional view of the sealing member portion of the developer supply container 1 before the mounting of the developer supply container 1 into the apparatus main assembly 100. FIGS. 33(*a*) and 33(*b*) are as described before.

Referring to FIG. 33(*a*), the end of the plate-like second portion 2*h* has the container driving force transmitting portion 2*d*, and a part of the container driving force transmitting portion 2*d* is provided with the locking portion 2*e*, which functions as an engaging portion. Next, referring to FIG. 40, the developer storage portion 24 is provided with the sealing member catching portion 24*a*, which is located in the adjacencies of the developer outlet 1*a* of the developer storage portion 24 and functions as the portion with which the locking portion 2*e* locks. The locking portion 2*e* engages (locks) with the sealing member catching portion 24*a* to prevent the sealing member 2 from slipping out of the developer outlet 1*a*, because the unlocking regulating member 3, which functions as a regulating portion (which will be described later), keeps the locking portion 2*e* engaged (locked) with the sealing member catching portion 24*a* to prevent the sealing member 2 from slipping out of the developer outlet 1*a*. Their functions and operations will be described later in detail. However, the locking portion 2*e* has a surface which is tilted in the direction in which the sealing member 2 is separated. The sealing member catching portion 24*a* which functions as the portion with which the locking portion 2*e* locks, is the corner portion where the diameter of the container proper 24A reduces from the large diameter 1*b* to the small diameter 1*c*.

[Unlocking Regulating Member]

Figure 41:
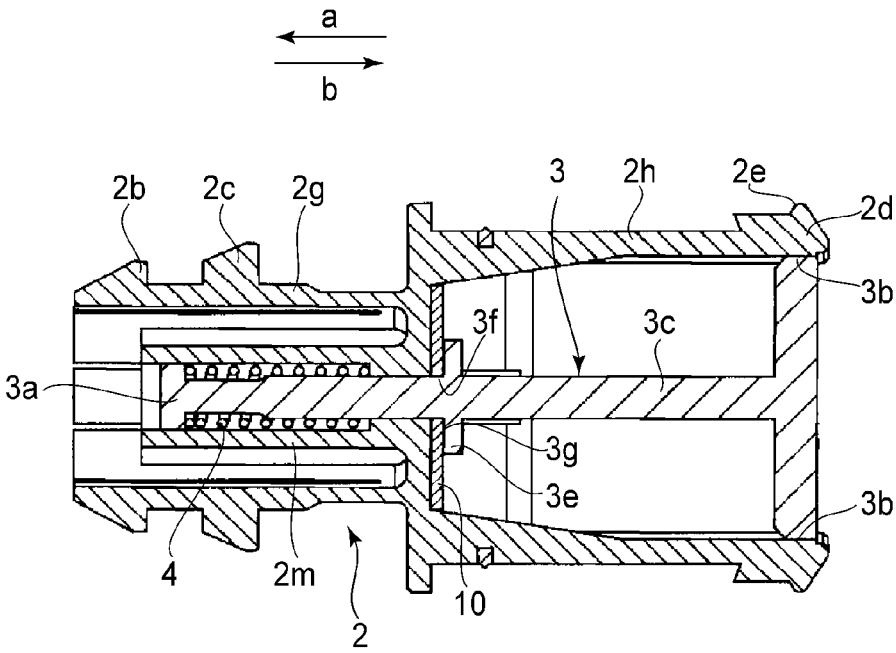
FIG. 41 is a sectional view of the combination of the sealing member and sealing member unlocking member, and is for describing the sealing member and sealing member unlocking member.
Figure 42:
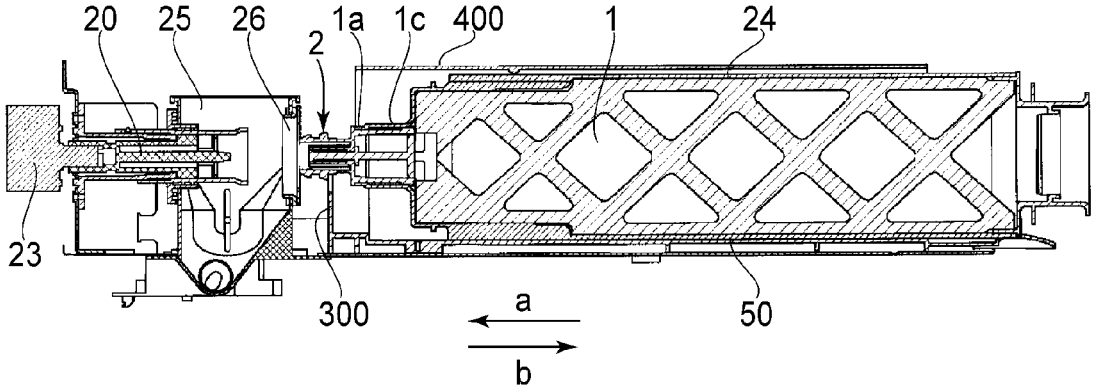
FIG. 42 a sectional view of the developer supply container, and its adjacencies, in the second preferred embodiment, when the developer supply container is in the apparatus main assembly; it is for describing the operation for mounting the developer supply container into the main assembly of the image forming apparatus.

Next, referring to FIG. 41, the unlocking regulating member 3 which functions as a regulating member, and the spring 4 which functions as a pressure applying member, will be described. FIG. 41 is a drawing of the combination of the sealing member 2 and unlocking regulating member 3 after the installation of the unlocking regulating member 3 into the sealing member 2.

Referring to FIG. 41, the unlocking regulating member 3 has a bumping portion 3*a*, an unlocking portion 3*b*, and a supporting shaft 3*c*. The supporting shaft 3*c* connects the bumping portion 3*a* to the unlocking portion 3*b*. Further, there is the spring 4 between the sealing member 2 and supporting shaft 3*c*. The spring 4 is the member for keeping the unlocking regulating member 3 continuously pressured in the direction a. The bumping portion 3*a* is small in diameter (6 mm in this embodiment). As the unlocking regulating member 3 is installed into the sealing member 2, the bumping portion 3*a* is positioned on the inward side of the roughly cylindrical shape, which the multiple plate-like first portions 2*g* of the sealing member 2 form. Further, the bumping portion 3*a* is surrounded by a protective wall 2*m*. Therefore, after the installation of the unlocking regulating member 3, the bumping portion 3*a* cannot be easily touched by an operator. This structural arrangement enhances the "accidental unsealing preventing" function. Further, the protective wall 2*m* functions a guiding portion for guiding the sliding of the unlocking regulating member 3, that is, the sliding of the supporting shaft 3*c*, in the direction a and direction b. Further, the bumping portion 3*a* functions as a releasing force receiving portion which receives the force generated in the direction b from the bumping projection 20*b* which functions as the releasing member of the driving portion 20, that is, the force for moving the unlocking regulating member 3 from the locking position (regulating position) to the unlocking position (non-regulating position).

Also referring to FIG. 41, the unlocking regulating member 3 is provided with a sealing portion 3*e*, which is greater in diameter than the supporting shaft 3*c*. After the installation of the unlocking regulating member 3 into the sealing member 2, the sealing surface 3*g* of the sealing portion 3*e* remains airtightly in contact with the surface of the sealing member 10, which is provided on the sealing member side, by the resiliency of the spring 4. The sealing member 10 is formed of an elastic substance. Therefore, as long as the sealing member 2 and the unlocking regulating member 3 are in the state shown in FIG. 41, the developer in the developer storage portion 24 does not leak even if the developer supply container 1 is vibrated, or falls during its shipment.

In this embodiment, the developer supply container 1 is sealed at the above described point. However, the developer supply container 1 may be sealed between the shaft sealing portion 3*f*, which is the peripheral surface of the supporting shaft 3*c* (which is downstream side of the sealing portion 3*e* in terms of the direction a), and the inward peripheral surface of the sealing member 10, as shown in FIG. 41. More concretely, the diameter of the inward peripheral surface of the sealing member 10 is made smaller than the diameter of the shaft sealing portion 3*f*, so that the interface between the shaft sealing portion 3*f* and sealing member 10 can be sealed by pressing the shaft sealing portion 3*f* into the sealing member 10. In this case, however, when the unlocking regulating member 3 moves in the direction a or b, the shaft sealing portion 3*f* and the inward surface of the sealing member 10 always rub against each other. Therefore, the movement of the unlocking regulating member 3 is not as smooth as desired. The structures of these portions may be designed as necessary in consideration of the properties of the developer, the vibrations, impacts, etc., which might occur during the shipment of the developer supply container 1.

The details of the function of each of the various portions of the sealing member 2 and unlocking regulating member 3 will be described in the following section titled as "Operation for Mounting Developer Supply Container".

[Operation for Mounting Developer Supply Container]

Next, referring to FIGS. 42-45, 46-49, and also, FIGS. 25-28 used to be described the first preferred embodiment, the operation for mounting the developer supply container 1 into the apparatus main assembly 100 will be described. FIGS. 42-45 are sectional views of the developer supply container 1 and its adjacencies, and are for describing the operation for mounting the developer supply container 1 into the apparatus main assembly 100. FIGS. 46-49, which correspond to FIGS. 42-45, one for one, are sectional views of the driving portion 20, disengaging portion 21, sealing member 2, and unlocking regulating member 3 in the sealing member 2, and are for describing the operation of the unlocking regulating member 3 in the sealing member 2. FIGS. 25-28, which also correspond to FIGS. 42-45, are perspective views of the developer supplying apparatus 400 of the apparatus main assembly 100.

Figure 46:
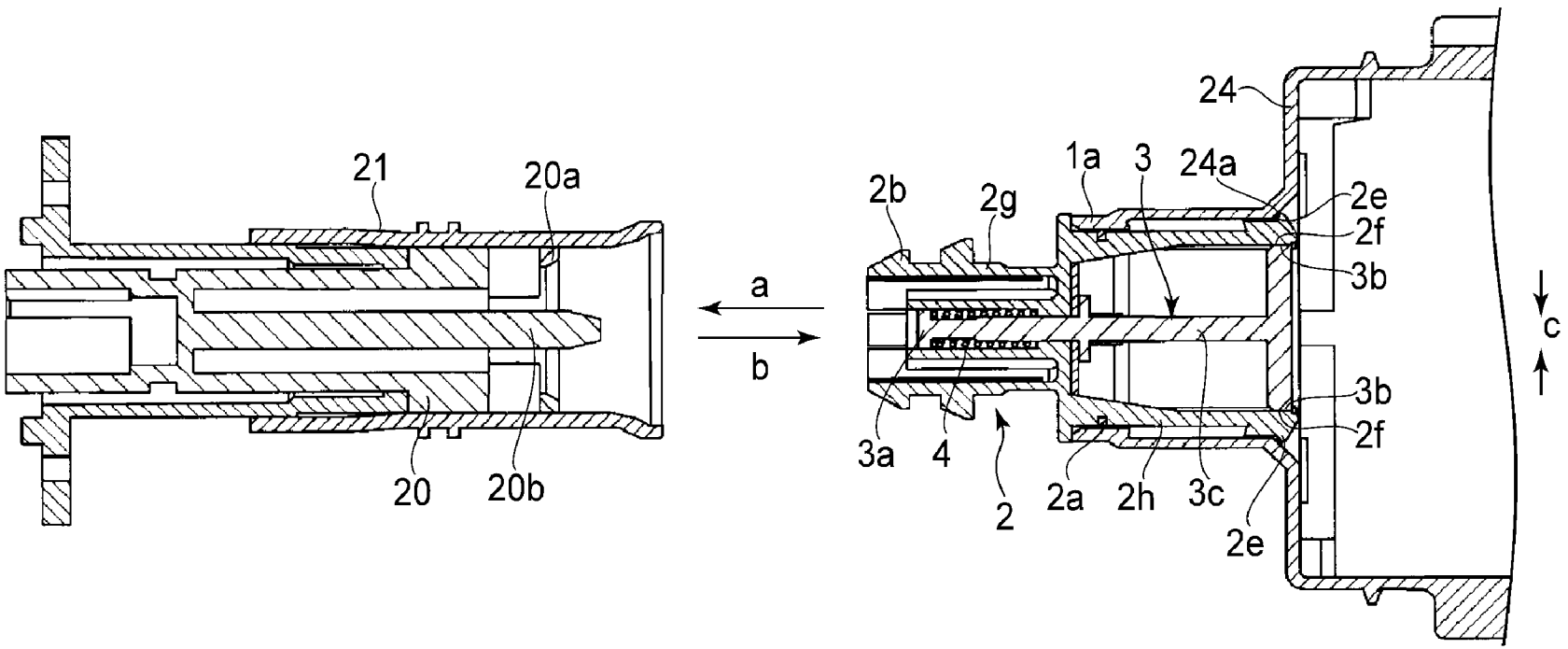
FIG. 46 is a sectional view of the combination of the developer supply container driving portion of the main assembly of the image forming apparatus, and the sealing member portion of the developer supply container, in the second preferred embodiment, and is for describing the operation for mounting the developer supply container into the main assembly of the image forming apparatus.

First, referring to FIG. 25, when an operator mounts the developer supply container 1, the developer supply container 1 is to be mounted into the container holder 50, with which the developer supplying apparatus 400 of the apparatus main assembly 100 is provided, in the direction a. The container holder 50 is held by an unshown stopper so that it does not move in the direction a. As the developer supply container 1 is inserted, the locking portion 2*e* of the developer supply container lengages with the sealing member catching portion 24*a* of the developer storage portion 24, as shown in FIG. 46. Further, the unlocking portion 3*b* of the unlocking regulating member 3 is on the unlocking force catching surface 2*f*, which is on the inward side of the locking portion 2*e*. In this condition, the unlocking regulating member 3 interferes with the movement of the locking portion 2*e*. Therefore, the locking portion 2*e* cannot be displaced in the unlocking direction (direction c in FIG. 46) to be disengaged from the locking portion 24*a* of the developer storage portion 24. Therefore, the locking portion 2*e* cannot be disengaged from the sealing member catching portion 24*a* of the developer storage portion 24. Therefore, even if the operator tries to move the sealing member 2 in the direction to unseal the developer outlet 1*a* by a mistake, the developer outlet 1*a* cannot be unsealed. That is, it is ensured that until the sealing member 2 is moved to unseal the developer outlet 1*a*, the engagement between the locking portion 2*e* and the sealing member catching portion 24*a* of the developer storage portion 24 remain engaged. That is, the locking portion 2*e* and the sealing member catching portion 24*a* of the developer storage portion 24 function to "prevent the accidental unsealing".

Further, the unlocking portion 3*b* of the unlocking regulating member 3 is on the inward side of the developer storage portion 24, being therefore inaccessible from outside the developer storage portion 24. Therefore, even if an operator handles the developer supply container 1 in an unexpected manner, the sealing member 2 does not easily come out of the developer outlet 1*a*.

Figure 43:
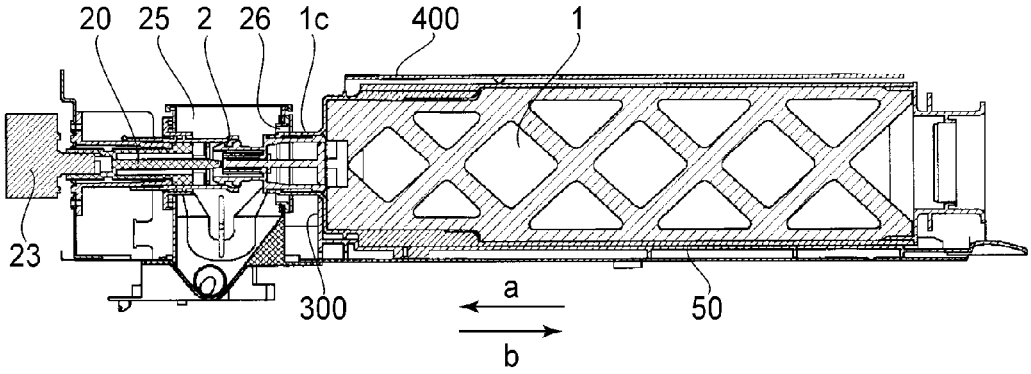
FIG. 43 is a sectional view of the developer supply container, and its adjacencies, in the second preferred embodiment, when the developer supply container is in the apparatus main assembly; it is for describing the operation for mounting the developer supply container into the main assembly of the image forming apparatus.
Figure 47:
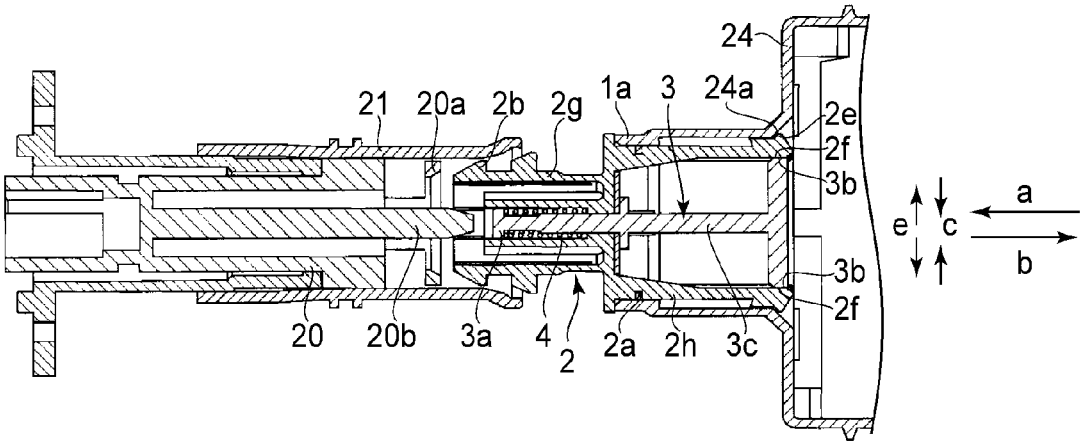
FIG. 47 is a sectional view of the combination of the developer supply container driving portion of the main assembly of the image forming apparatus, and the sealing member portion of the developer supply container, in the second preferred embodiment, and is for describing the operation for mounting the developer supply container into the main assembly of the image forming apparatus.

As the operator inserts the developer supply container 1 further in the direction a, from the position shown in FIG. 25 to the position shown in FIG. 26, the leading end of the developer supply container 1 bumps into a container stopper 300, with which the leading end of the container holder 50 is provided, as shown in FIG. 43. Thus, it becomes impossible for the operator to insert the developer supply container 1 further in the direction a. As the leading end of the developer supply container 1 bumps into the container stopper 300, the developer supply container 1 becomes locked with the container holder 50 so that it moves with the container 50 thereafter. When the developer supply container 1 is in the state shown in FIG. 43, there is a gap between the bumping portion 3*a* of the unlocking regulating member 3 and the bumping projection 20*b* of the driving portion 20, as shown in FIG. 47. Thus, the unlocking regulating member 3 does not move in the direction b, relative to the sealing member 2. Therefore, the locking portion 2*e* of the sealing member 2 and the sealing member catching portion 24*a* of the developer storage portion 24 are kept engaged by the unlocking regulating member 3, as they are when they are in the positions shown in FIG. 46. That is, it is ensured that the developer supply container 1 is prevented from "being accidentally unsealed". Therefore, it is possible to prevent the sealing member 2 from being moved in the direction to unseal the developer outlet 1*a* by the vibrations and impacts which are sometimes generated during the operation for mounting the developer supply container 1.

There is also a gap between the locking projection 2*b* of the sealing member 2, and the driving portion 20; the sealing member 2 is not in contact with the driving portion 20. Further, as the small diameter portion 1*c* of the developer supply container 1 slides into a buffer seal 26, the peripheral surface of the small diameter portion 1*c* of the developer storage portion 24 comes into contact with the inward surface of the buffer seal 26. Therefore, the interface between the small diameter portion 1*a* and the buffer seal 26 becomes airtightly sealed. Further, this airtight contact between the small diameter portion 1*c* and the buffer seal 26 is maintained during the operation which will be described next. Therefore, the problem that developer leaks from the toner buffer 25 during the operation for mounting the developer supply container 1 is reliably prevented.

Figure 44:
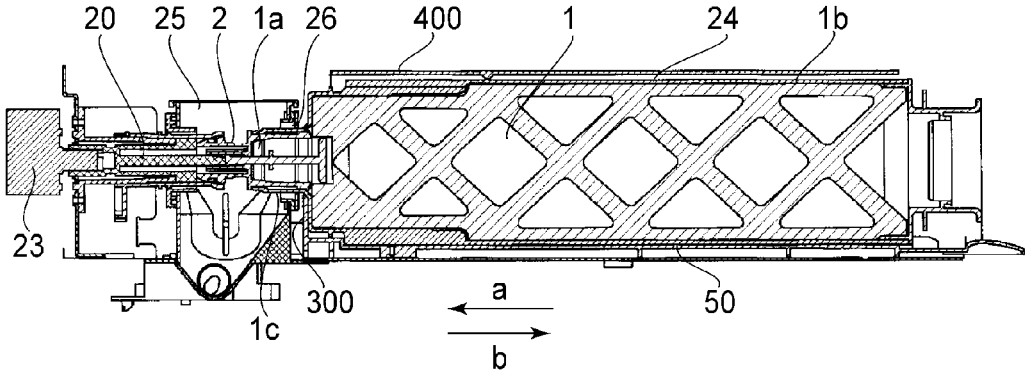
FIG. 44 is a sectional view of the developer supply container, and its adjacencies, in the second preferred embodiment when the developer supply container is in the apparatus main assembly; it is for describing the operation for mounting the developer supply container into the main assembly of the image forming apparatus.
Figure 45:
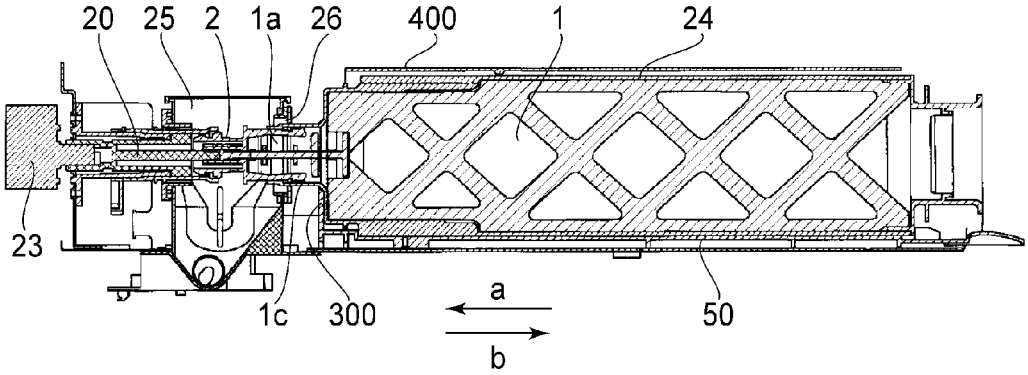
FIG. 45 is a sectional view of the developer supply container, and its adjacencies, in the second preferred embodiment, when the developer supply container is in the apparatus main assembly; it is for describing the operation for mounting the developer supply container into the main assembly of the image forming apparatus.

Next, while the developer supply container 1 is in the state shown in FIG. 26, the operator rotates a set lever 8 in the direction d by a preset amount. As the set lever 8 is rotated, the container holder 50 is moved in the direction a by an unshown mechanism for moving the container holder 50. Thus, the developer supply container 1 on the container holder 50 moves with the container holder 50 in the direction a, to the position shown in FIG. 44. At this point in time, the container holder 50 is in its closest position to the toner buffer 25 of the developer supplying apparatus 400, as shown in FIG. 44. When the developer supply container 1 moves from its position shown in FIG. 43 to its position shown in FIG. 44, the locking projection 2*b* engages with the driving portion 20, as described in the section titled as "Locking Projection". Next, referring to FIG. 48, the relationship between the developer supply container 1 and driving portion 20 when they are in the positions shown in FIG. 44 will be described.

Figure 48:
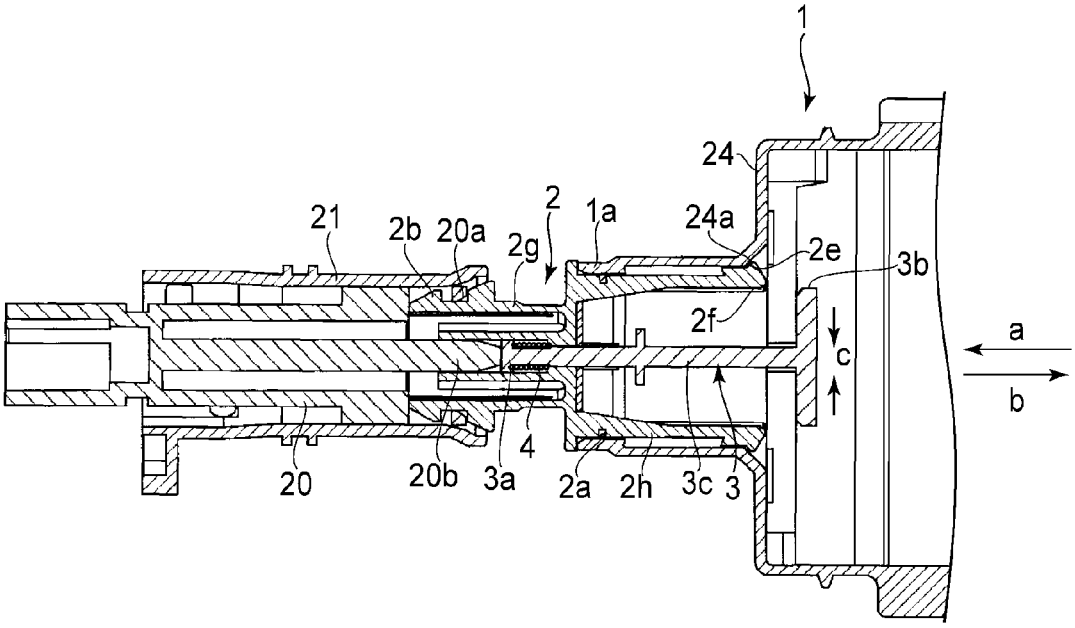
FIG. 48 is a sectional view of the combination of the developer supply container driving portion of the main assembly of the image forming apparatus, and the sealing member portion of the developer supply container, in the second preferred embodiment, and is for describing the operation for mounting the developer supply container into the main assembly of the image forming apparatus.

Referring to FIG. 48, when the sealing member 2 of the developer supply container 1 is remaining engaged with the driving portion 20, the bumping portion 3*a* of the unlocking regulating member 3 is in contact with the bumping projection 20*b* of the driving portion 20. Therefore, the unlocking portion 3*b* is moved in the direction b, relative to the sealing member 2, by the supporting shaft 3*c*. As the unlocking portion 3*b* moves in the direction b, it becomes separated from the unlocking force catching surface 2*f*, but, the locking portion 2*e* and sealing member catching portion 24*a* remain engaged with each other. Here, the force for moving the unlocking regulating member 3 in the direction b has only to be greater than the pressure generated by the spring 4 in the direction a. Therefore, the amount of this force may be set based on the specifications of the apparatus main assembly 100; it is optional.

Next, the operator is to rotate the set lever 8 in the direction d, from the position shown in FIG. 27 to the position shown in FIG. 28. As the set lever 8 is rotated, the container holder 50 is displaced by the unshown container holder displacement mechanism, in the direction b, which is opposite to the direction in which it was displaced previously.

Figure 49:
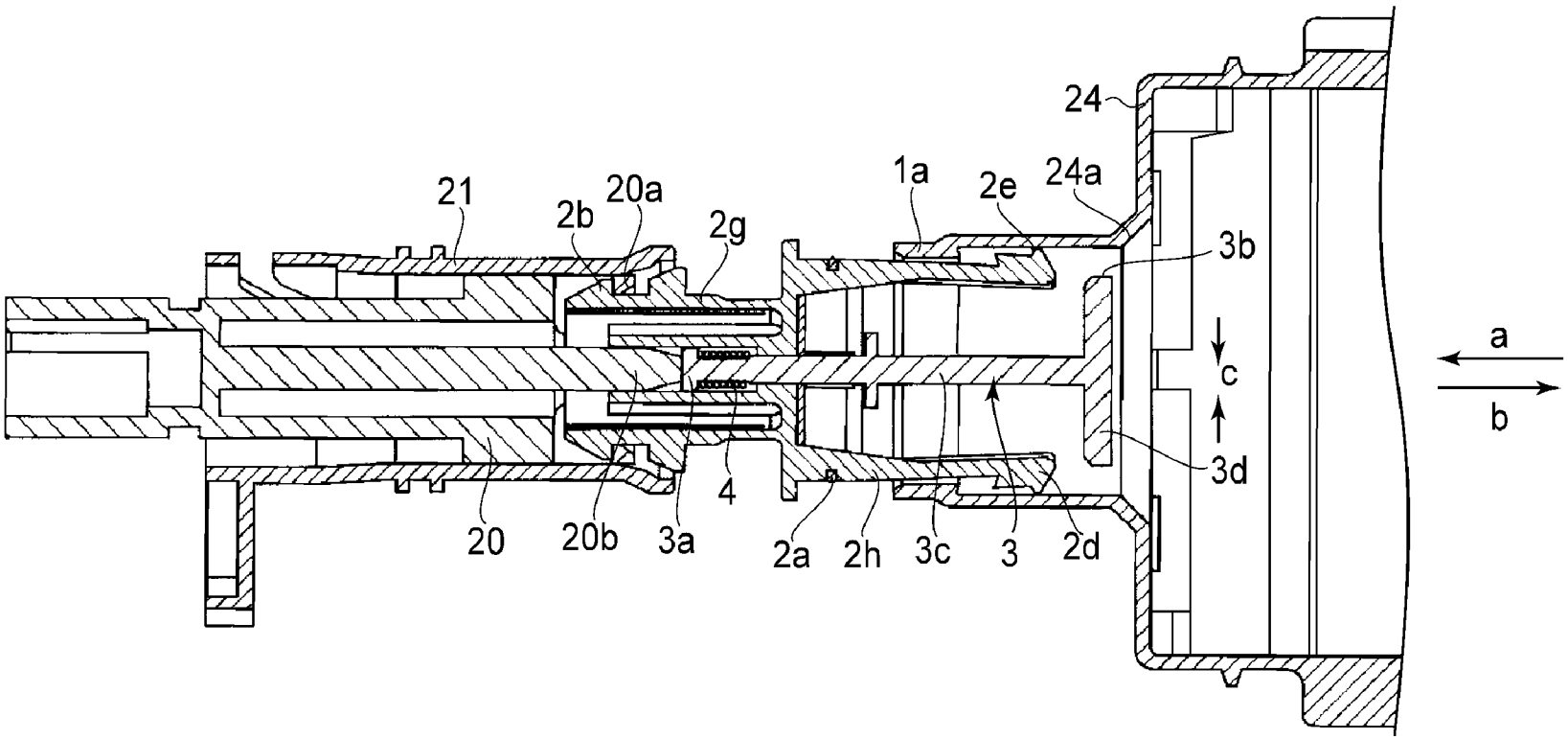
FIG. 49 is a sectional view of the combination of the developer supply container driving portion of the main assembly of the image forming apparatus, and the sealing member portion of the developer supply container, in the second preferred embodiment, and is for describing the operation for mounting the developer supply container into the main assembly of the image forming apparatus.

As the container holder 50 displaces in the direction b, only the developer storage portion 24 displaces in the direction b, because the locking projection 2*b* of the sealing member 2 is in engagement with the driving portion 20, as shown in FIG. 49, and also, as described in the section titled as "Locking Projection".

Here, both the locking portion 2*e* of the sealing member 2 and the sealing member catching portion 24*a* of the developer storage portion 24 are such surfaces that are slanted in the outlet unsealing direction of the sealing member 2. Further, the locking portion 2*e* is near the end portion of the plate-like second member 2*h*, and is structured so that as the plate-like second member 2*h* deforms in the direction c, the locking portion 2*e* is allowed to displace in the direction to disengage (unlock) the sealing member catching portion 24*a*. Therefore, as the developer storage portion 24 is moved in the direction b, the plate-like second member 2*h* is pushed by the slanted surface of the sealing member catching portion 24*a*, causing thereby the locking portion 2*e* to be moved in the direction c. This movement of the locking portion 2*e* disengages the locking portion 2*e* from the sealing member catching portion 24*a*, allowing thereby the sealing member 2 to be moved to unseal the developer outlet 1*a*. The amount of unsealing force F necessary to move the sealing member 2 is the combination of the amount of friction F1 between the sealing portion 2*a* and the inward surface of the developer outlet 1*a*, and the amount of force F2 necessary for the locking portion 2*e* to slide over the sealing member catching portion 24*a*.

Further, in the case of the structural arrangement in this embodiment, the unlocking regulating member 3 bears the role of keeping locking portion 2*e* and sealing member catching portion 24*a* engaged until the unsealing operation is started. This relation is maintained even if an attempt is made to move the sealing member 2 in the direction a to unseal the developer outlet 1*a*. Therefore, even if the length of contact between the locking portion 2*e* and sealing member catching portion 24*a* in terms of the diameter direction of the developer supply container 1 is short, the unlocking regulating member 3 can yield a large amount of force necessary to keep engaged the locking portion 2*e* and sealing member catching portion 24*a*. In this embodiment, the length of contact between the locking portion 2*e* and sealing member catching portion 24*a* was set to 0.5 mm. Further, the locking portion 2*e* and sealing member catching portion 24*a* are made so that their slanted surfaces are smooth. Therefore, the amount of force F2 necessary for the locking portion 2*e* to slide over the sealing member catching portion 24*a* can be set to a value in a range in which there is no practical problem.

As the developer outlet 1*a* is unsealed through the above described operation, it becomes possible for the developer to be discharged. Since the apparatus main assembly 100 and developer supply container 1 are structured so that the amount of force F necessary to move the sealing portion 2*a* of the sealing member 2 out of the developer outlet 1*a* is very small. Therefore, the developer supply container 1 can be easily unsealed. That is, the outlet 1*a* can be "easily unsealed".

On the other hand, during the opposite operation from the above described operation for unsealing the developer outlet 1*a*, that is, when sealing the developer outlet 1*a* of the developer supply container 1 with the sealing member 2, the locking portion 2*e* and sealing member catching portion 24*a* are first engaged with each other by the elastic force of the plate-like second member 2*h*, as shown in FIG. 48. Then, when the bumping projection 20*b* of the driving portion 20 and the bumping portion 3*a* of the unlocking regulating portion 3 separate from each other, the unlocking regulating member 3 is moved in the direction a, relative to the sealing member, by the pressure from the spring 4, as shown in FIG. 48. Therefore, the unlocking regulating member 3 moves to the position in which it prevents the locking portion 2*e* from displacing. Therefore, the locking portion 2*e* and the locking portion 24*a* of the developer storage portion 24 are kept engaged again by the unlocking regulating member 3. That is, the sealing member 2 becomes locked with the developer storage portion 24, making it impossible for the developer outlet 1*a* to be unsealed.

Further, in this embodiment, the direction (for example, direction a in FIG. 46) in which the sealing member 2 is moved to unseal the developer outlet 1*a*, and the direction (for example, direction b in FIG. 48) in which the unlocking regulating member 3 is moved to unlock the sealing member 2 are different, as will be evident from the above described operation. That is, the developer outlet 1*a* cannot be unsealed unless the sealing member 2 is moved in the direction to unseal the developer outlet 1*a* while applying a force to the unlocking regulating member 3 in the opposite direction from the direction in which the sealing member 2 is to be moved to unseal the developer outlet 1*a*. Therefore, this embodiment is superior in "accidental unsealing preventing" function to the embodiments in which the direction in which the sealing member 2 is moved to unseal the developer outlet 1*a* is the same as the direction in which the unlocking regulating member 3 is moved for unlocking.

Figure 50:
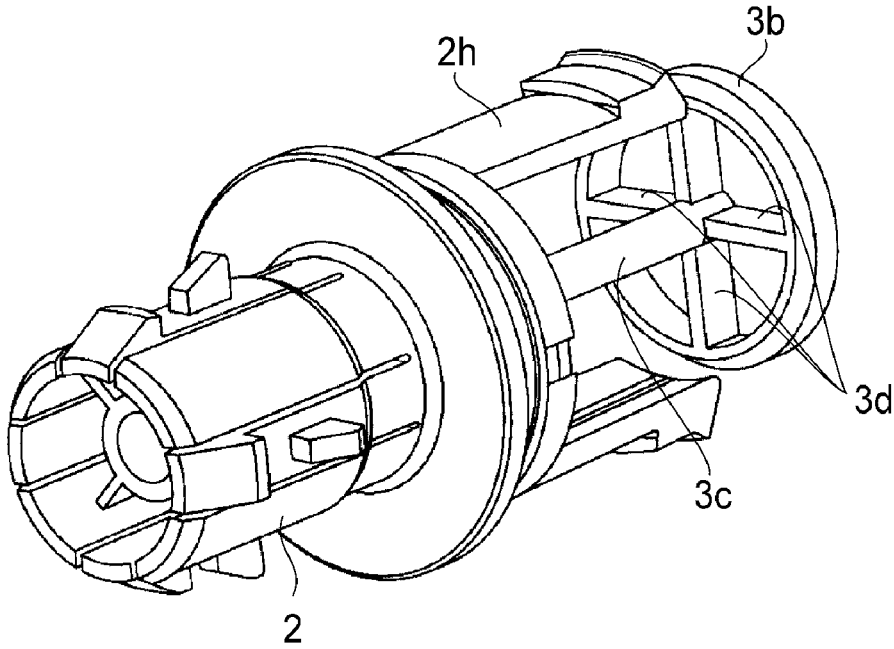
FIG. 50 is a perspective view of the combination of the sealing member and sealing member unlocking member (sealing member regulating member).

Further, when the unlocking regulating member 3 is moved from the position shown in FIG. 48 to the position shown in FIG. 49, it moves in the direction a in the small diameter portion 1*c*. Therefore, even if the developer in the developer storage portion 24 is remaining stuck in the adjacencies of the developer outlet 1*a* because of the vibrations which occur during the shipment of the developer supply container 1, and/or the developer supply container 1 is left unattended for a long time, the shape of the unlocking regulating member 3, and the shape of the connective portion 3*d*, which are shown in FIG. 50, are very effective to loosen the stuck developer as the above described unsealing operation is started. That is, the unlocking portion 3*b* and connective portion 3*d* are moved relative to the developer, by the unsealing operation. Therefore, the developer becomes loosened, contributing to the reliability with which the developer is discharged immediately after the sealing member 2 is moved to unseal the developer outlet 1*a*.

Further, referring to FIG. 49, after the sealing member 2 is moved to unseal the developer outlet 1*a*, the unlocking regulating member 3 is within the developer outlet 1*a*. Thus, the developer in the developer storage portion 24 is discharged through the developer outlet 1*a* by the rotation of the developer supply container 1, as described before, while the unlocking regulating member 3 is remaining in the developer outlet 1*a*. During the discharging of the developer, the connective portion 3*d* and the unlocking portion 3*b* are in the small diameter portion 1*c*, and play the role of regulating the developer flow while the developer is discharged. Thus, compared to the structural arrangements which do not have the same structural features as those in this embodiment, the developer supply container 1 and apparatus main assembly 100 in this embodiment are more consistent in the amount by which the developer is discharged through the developer outlet 1*a*. In particular, in the case of the structural arrangement which provides nothing for regulating the discharging of the developer, it is possible that if the developer in the developer supply container 1 is remaining fluid because the developer supply container 1 is shook, or subjected to the like operation, by an operator, before the unsealing of the developer supply container 1, the developer will burst out through the developer outlet as soon as the sealing member 2 is moved to unseal the developer outlet 1*a*, and will scatter in the adjacencies of the developer outlet 1*a*. In the case of the structural arrangement in this embodiment, however, the connective portion 3*d* and unlocking portion 3*b* regulates, within the developer outlet 1*a*, the speed at which the developer is discharged. Therefore, the developer (toner) is discharged at a relatively stable rate, without being scattered.

The shape of the connective portion 3*d* and unlocking operation controlling portion of the unlocking regulating member 3 may be decided based on the above described their function for loosening the developer at the beginning of the discharging of the developer, and the degree at which the amount by which the developer is discharged is wanted to be regulated. For example, if it is unnecessary to seriously loosen the developer, and also, if it is not desired to regulate the amount by which the developer is discharged, a shape, such as the one shown in FIG. 51, may be chosen as the second example of modification, which has little effect upon the discharging of the developer. On the other hand, if it is desired to seriously loosen the developer, and keep constant the amount by which the developer is discharged, a shape, such as the one shown in FIG. 52, which is smaller in the cross section of the developer passage, may be selected. In other words, the shape of the connective portion 3*d* and unlocking portion 3*b* may be decided in consideration of the physical properties of the developer, specifications of the image forming apparatus, etc.

Figure 51:
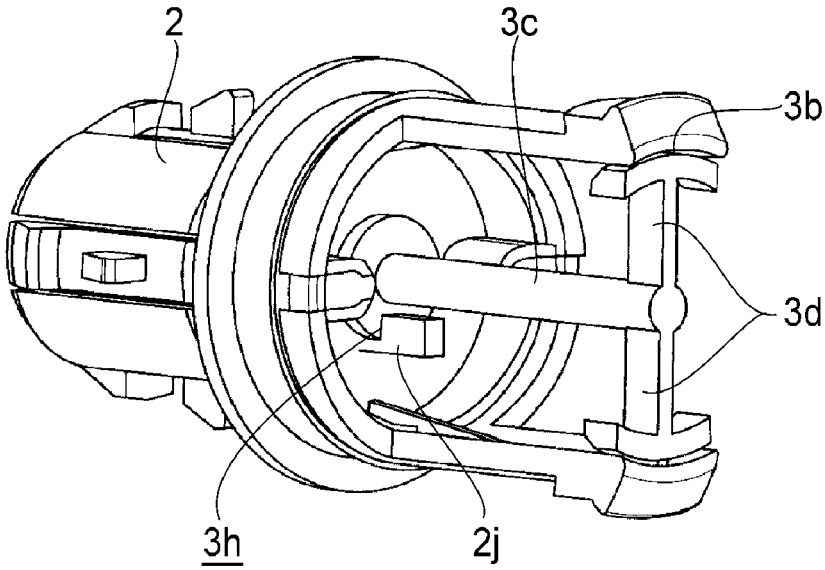
FIG. 51 is a perspective view of the combination of the sealing member and sealing member unlocking member in the second example of the modified versions of the second preferred embodiment.

However, if a shape, such as the one shown in FIG. 51, is selected, that is, if the unlocking regulating member 3 is provided with a pair of unlocking operation regulating portions 3*b*, which opposes each other in terms of the diameter direction of the developer storage portion 24, a rotation prevention mechanism, such as the one shown in FIG. 51, is necessary to prevent the problem that the accidental rotation of the unlocking regulating member 3 causes the unlocking portion 3*b* to disengage from the unlocking operation regulating surface 2*f*. For example, the sealing member 2 may be provided with a phase control projection 2*j*, while providing the unlocking regulating member 3 with a locking portion 3*h* which engages with the phase control projection 2*j*. The locking portion 3*h* is provided with a recess, which corresponds in position to the phase control projection 2*j*, and the engagement between the locking portion 3*h* and phase control projection 2*j* regulates the rotational movement of the unlocking regulating member 3 while allowing the sealing member 2 to be freely moved in the direction to be separated. Therefore, even if the unlocking regulating member 3 moves relative to the sealing member 2 in the direction b, which is shown in FIG. 41, it does not rotates.

Figure 53:
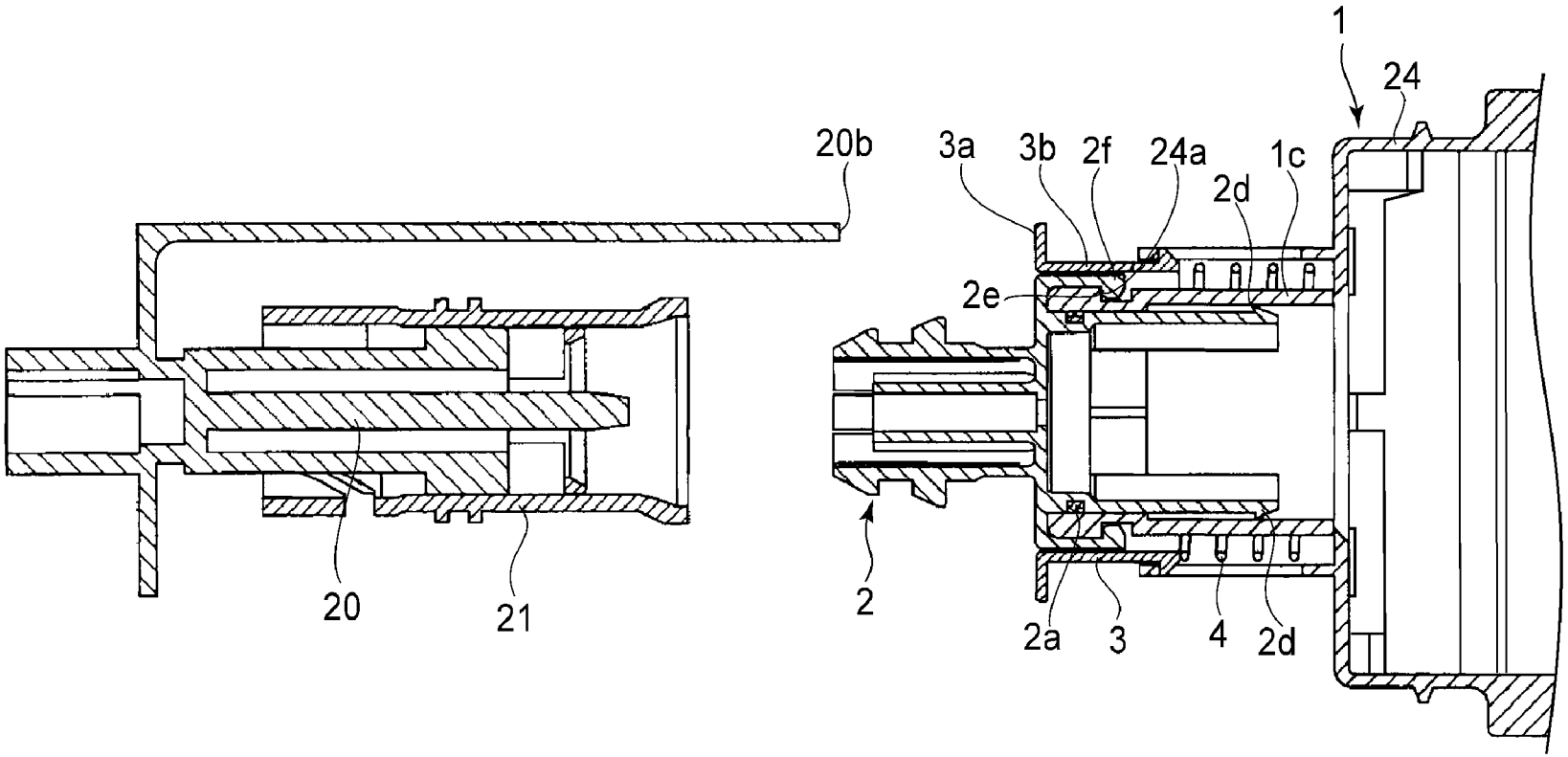
FIG. 53 is a sectional view of the combination of the developer supply container driving portion, sealing member, sealing member, and sealing member unlocking member, in the fourth example of the modified versions of the second preferred embodiment.
Figure 54:
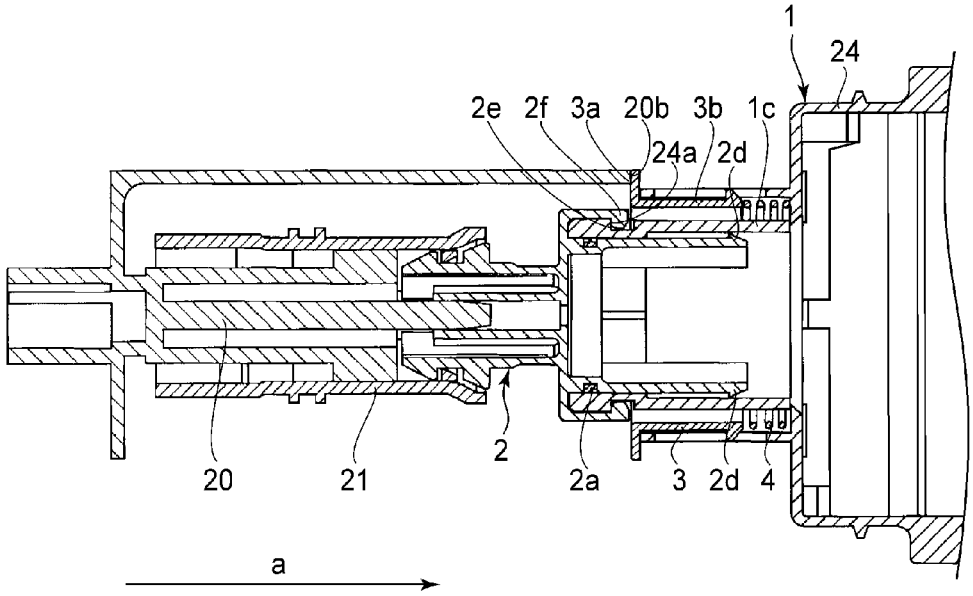
FIG. 54 is a sectional view of the combination of the developer supply container driving portion, sealing member, sealing member unlocking member, in FIG. 53, and is for describing the operation of the combination.
Figure 55:
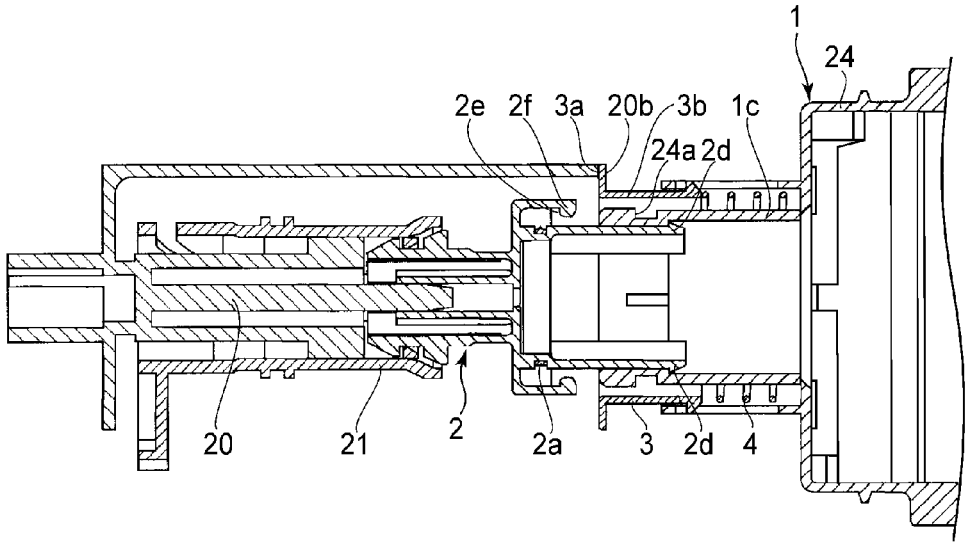
FIG. 55 is a sectional view of the combination of the developer supply container driving portion, sealing member, sealing member unlocking member, in FIG. 53, and is for describing the operation of the combination.

Further, in this embodiment, the locking portion 2*e* and sealing member catching portion 24*a* are provided within the developer supply container 1. However, they may be provided outside the developer supply container 1, as shown in FIGS. 53 and 54, as the fourth example of modification. FIG. 53 is a sectional view of the sealing member 2, unlocking regulating member 3, and their adjacencies, when the unlocking regulating member 3 is in the position into which it was pushed out in the direction a by the bumping projection 20*b* of the apparatus main assembly 100. FIG. 55 is a sectional view of the sealing member 2, unlocking regulating member 3, and their adjacencies, when the sealing member 2 is in the position into which it was moved to unseal the developer outlet 1*a*.

The movements of the unlocking regulating member 3, sealing member 2, and developer supply container 1, are the same as those in the second embodiment.

More concretely, referring to FIG. 25, the developer supply container 1 is inserted into the container holder 50 from the direction a. When the developer supply container 1 is inserted, the locking portion 2*e*, sealing member catching portion 24*a*, and unlocking regulating member 3 are in such a condition that the locking portion 2*e* and sealing member catching portion 24*a* are reliably kept engaged by the unlocking regulating member 3. Therefore, the sealing member 2 cannot be moved in the direction to unseal the developer outlet 1*a*. However, as the developer supply container 1 is inserted further in the direction a from the position shown in FIG. 25 to the position shown in FIG. 26, the bumping portion 3*a* of the unlocking regulating member 3 still remains separated from the bumping projection 20*b* of the driving portion 20. Therefore, the locking portion 2*e* and sealing member catching portion 24*a* still remain engaged with each other by the unlocking regulating member 3. Therefore, the sealing member 2 cannot be moved in the direction to unseal the developer outlet 1*a*.

Then, the lever 8 is rotated by an operator from the position shown in FIG. 26 to the position shown in FIG. 27. Thus, the container holder 50 moves in the direction a. As the container holder 50 moves in the direction a, the bumping portion 3*a* of the unlocking regulating member 3 comes into contact with the bumping projection 20*b* of the driving portion 20. Thus, the unlocking portion 3*b* is moved relative to the sealing member 2 by the supporting shaft 3*c*. FIG. 54 shows the unlocking portion 3*b*, sealing member 2, and their adjacencies, after the movement of the unlocking portion 3*b* relative to the sealing member 2. Consequently, the locking portion 2*e* and sealing member catching portion 24*a* become disengaged from each other. In other words, the sealing member 2 becomes unlocked.

Next, the set lever 8 is rotated further by the operator from the position shown in FIG. 27 to the position shown in FIG. 28. As the set lever 8 is rotated, the sealing member 2 remains engaged with the driving portion 20, and therefore, only the container proper 24 moves in the direction b, as it does in the second preferred embodiment. Thus, the sealing member 2 separates from the developer outlet 1*a*. FIG. 55 shows the sealing member 2 and its adjacencies after the separation of the sealing member 2 from the developer outlet 1*a*.

Also in this case, the sealing portion 2*a* of the sealing member 2 is given the "airtightly sealing" function, and the locking portion 2*e* and unlocking regulating member 3 are given the "accidental unsealing preventing" function, as in the second preferred embodiment. In other words, also in this case, the developer supply container 1 and apparatus main assembly 100 are structured so that the function to "airtight seal" the developer supply container 1 and the function to "prevent accidental unsealing" of the developer supply container 1, which are the gist of the present invention, can be separated.

The employment of the above described structural arrangement places the locking portion 2*e* and sealing member catching portion 24*a* on the outward side of the small diameter portion 1*c*. Therefore, there is nothing in the developer outlet 1*a* that regulates the developer when the developer is discharged. In other words, the effects upon the discharging of the developer is reduced.

Further, the unlocking regulating member 2 is not put through the sealing member 2. Therefore, there is a merit that it is unnecessary to seal between the unlocking regulating member 3 and sealing member 2.

However, the unlocking regulating member 3 is placed outside the small diameter portion 1*c*, being therefore likely to be touched by a user. In other words, there is a small amount of possibility that the sealing member 2 is accidentally moved in the direction to unseal the developer outlet 1*a*. Therefore, from the standpoint of "accidental unsealing prevention", the structural arrangement in the second preferred embodiment is preferable to that in the fourth example of modification. Whether or not to employ this structural arrangement may be decided in consideration of the "accidental unsealing prevention", "developer discharging performance", and structural simplicity.

[Comparative Verification]

Lastly, the results of the comparative verification of the structural arrangement in this embodiment described above will be described. Table 2 shows the results of the evaluation of the second preferred embodiment, and the first and second modified versions of the second embodiment, in terms of the "airtightness", "how easily unsealable", "accidental unsealing prevention", and "discharging performance".

Referring to FIGS. 33 and 50, the sealing member 2 in this embodiment is provided with the locking portion 2*e* and unlocking regulating member 3, which are for "preventing accidental unsealing", which is one of the characteristic features of the present invention. Further, in order to make it possible for the sealing portion 2*a* to "airtightly seal" the developer outlet 1*a*, and to be easily separated from the developer outlet 1*a*, the sealing portion 2*a* was structured to have only a single lip.

Referring to FIG. 34, the sealing member 2 used in the first of the modified versions of the second preferred embodiment is structured so that the sealing portion 2*a* directly faces the end surface of the developer outlet portion 1*a*.

Referring to FIG. 51, the sealing member 2 used in the second of the modified versions is different in the shape of the connective portion 3*d* and unlocking portion 3*b* of the unlocking regulating member 3 from the sealing member 2 in the preferred embodiment.

Figure 52:
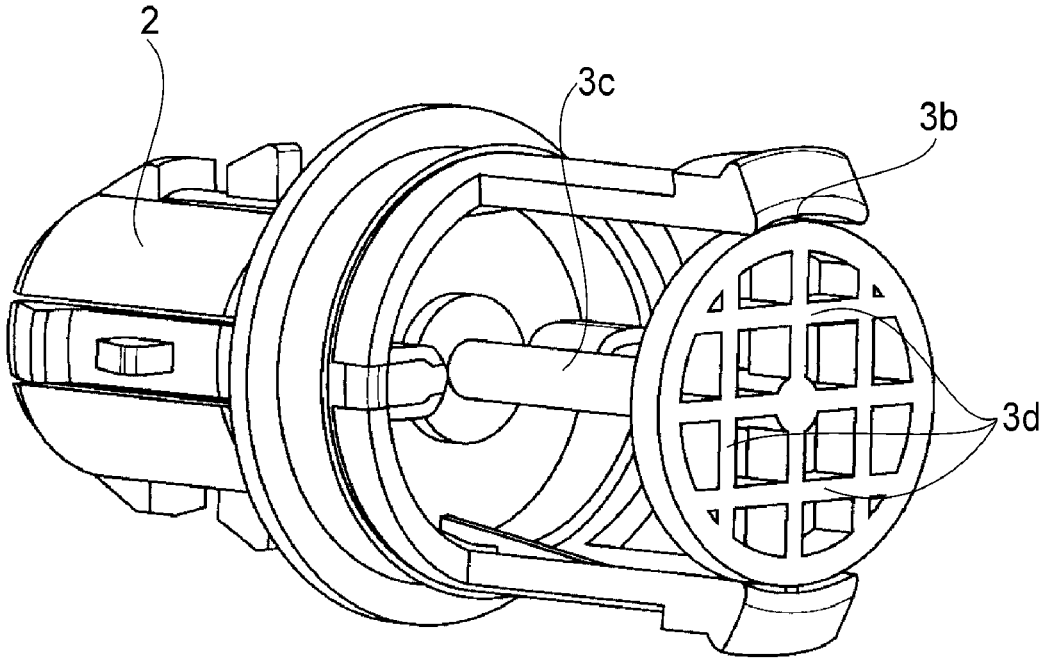
FIG. 52 is a perspective view of the combination of the sealing member and sealing member unlocking member in the third example of the modified versions of the second preferred embodiment.

Referring to FIG. 52, the sealing member 2 used in the third of modified versions is different in the connective portion 3*d* and unlocking portion 3*b* of the unlocking regulating member 3 from the sealing member 2 in the preferred embodiment.

Referring to FIGS. 53 and 54, in the case of the sealing member 2 used in the fourth of the modified versions, the locking portion 2*e* is positioned outside the developer outlet 1*a*, and so is the unlocking regulating member 3.

The sealing member 2 used in the first example of a conventional image forming apparatus is the same as the sealing member 2 in the first conventional example, shown in FIG. 29, which was described along with the first preferred embodiment. That is, it is not provided with the locking portion 2*e* and unlocking regulating member 3 with which the developer supply container 1 in the second preferred embodiment is provided, and the sealing portion 2*a* is provided with two lips. Further, the sealing portion 2*a* is structured to be given the function to "airtightly sealing" the developer supply container 1 and the function to "preventing the accidental unsealing" of the developer supply container 1.

Next, the method for evaluation each of the structural arrangements in terms of "how easily unsealable", "accidental unsealing prevention", and "developer discharging performance", will be described.

"How easily unsealable" was evaluated as follows. The amount of operational force (unsealing force) necessary to rotate the set lever 8 in the direction d was detected by attaching a torque gauge to the set lever 8 of the developer supplying apparatus 400 shown in FIGS. 25-25. Incidentally, the amount of operational force is the value obtained by converting the amount of torque (operational force) necessary to be applied to the point of the set lever 8 which is 0.05 m away from the rotational axis of the set lever 8.

"Prevention of accidental unsealing" was evaluated by the measuring the amount of force necessary to pull the sealing member 2 out of the developer outlet 1*a*, using a multipurpose push-pull gauge.

In terms of the "airtight sealing", "prevention of accidental unsealing", and "how easily unsealable", the second and third examples of modification are the same as the second preferred embodiment. However, in terms of the "developer discharging performance", they are different from the second preferred embodiment. Thus, the second and third example of modification were compared with the first preferred embodiment and first example of the conventional apparatus, in terms of the "developer discharging performance", in particular.

First, in order to check the regulating effects of the connective portion 3*d* and unlocking portion 3*b* upon the developer discharge, the developer in the developer supply container 1 was fully fluidized by shaking the developer supply container 1 back and forth 10 times in the direction parallel to the rotational axis of the developer supply container 1 after the developer supply container 1 was refilled with 1,000 g of preselected developer. Then, the developer supply container 1 was horizontally and stationarily set, and the developer outlet 1*a* was immediately unsealed by separating the sealing member 2 from the developer outlet 1*a* (roughly three seconds after shaking). As the developer outlet 1*a* is unsealed, the fluidized developer is discharged through the developer outlet 1*a* (this phenomenon may be referred to as "flushing"). The amount by which the developer was discharged from the time when the developer outlet 1*a* was unsealed to the time when the discharging ("flushing") of developer ended was measured.

Further, in order to check the "developer loosening effect" of the connective portion 3*d* and unlocking portion 3*b*, which occurred after the unsealing of the developer outlet 1*a*, the following experiment was conducted. That is, in order to cause the developer in the toner container 1 to pack as it does during the shipment of the toner container 1, the toner bottle 1 was filled with 1,000 g of the preselected developer, and then, the toner bottle 1 was dropped 1,000 times from a height of 30 mm, with the toner bottle 1 positioned so that the developer outlet 1*a* faced downward. Then, the toner container 1 was mounted in the apparatus main assembly 100, and the operation for supplying the apparatus main assembly 100 with the developer from the toner container 1 was carried out while measuring the length of time (in seconds) it took for the developer to begin to come out of the toner container 1. The toner bottle used for the experiment was 90 mm in internal diameter, 320 mm in length, and 30 mm in the diameter of the developer outlet 1*a*.

The results of the evaluation of the experiment described above are given in Table 2.

TABLE 2

| | sealing property | unsealing force (N) | locking strength (N) |
|---|---|---|---|
| Emb. 1 | G | approx. 10.4-15.3 | not openable |
| Emb. 2 | G | approx. 10.6 | not openable |
| Conv. 1 | G | approx. 39.2-44.1 | approx. 40-45 |

G: good

First, the second preferred embodiment of the present invention, and the first and second modified versions of the second preferred embodiment were evaluated.

In terms of the "how easily unsealable", the structural arrangement in the second preferred embodiment was roughly 10.4 N-15.3 N in the amount of force necessary to operate the set lever 8, and therefore, it was possible to very smoothly operate the set lever 8. The smaller the amount of force necessary to operate the set lever 8, the smaller the amount of the load to which an operator will be subjected, and therefore, the better in terms of the contribution to the usability of the developer supply container 1 in the operation for mounting or dismounting the developer supply container 1. In terms of the "prevention of accidental unsealing", it was ensured that the sealing member 2 remained unmovably locked. Therefore, it was impossible for the sealing member 2 to be pulled out of the developer outlet 1*a*. That is, it was confirmed that the structural arrangement in the second preferred embodiment definitely had the function to "prevent accidental unsealing".

In comparison, the first example of the conventional structural arrangement gave the sealing portion 2*a* the locking function. Therefore, the amount of force for the "prevention of accidental unsealing", had to set to be in a range of 40 N-45 N. Therefore, the amount of force for unsealing the developer outlet 1*a* had to be increased to deal with the increase in the amount of force which kept the sealing member 2 locked. In other words, it was difficult for the first example of the conventional structural arrangement to have both the function to "prevent accidental unsealing", and the function to be "easily unsealable".

Here, the "locking strength" means the largest amount of force necessary to separate the sealing member 2 from the container proper 24 while the unlocking regulating member 3 is keeping the locking portion 2*e* and sealing member catching portion 24*a* engaged with each other.

Thus, it was possible to take the locking function away from the sealing portion 2 by employing the locking mechanism in this embodiment. Therefore, it was possible for the sealing portion 2*a* to set the minimum amount of force necessary to unseal the developer outlet 1*a*. Further, when the developer supply container 1 is taken out of an image forming apparatus after being mounted in the image forming apparatus, the sealing member 2 will be rocked again by the function of the spring 4 provided within the sealing member 2 as described before. Therefore, the developer supply container 1 was "prevented from accidentally unsealed", while remaining easily unsealable, regardless of the number of times it was inserted into the apparatus main assembly 100, and dismounted from the apparatus main assembly 100.

Further, the structural arrangement (FIG. 34) in the first example of modification is similar in the locking structure to that in the second preferred embodiment. Therefore, in terms of the "airtightly sealing" function and the "prevention of accidental unsealing", it was roughly the same in performance as the second preferred embodiment. However, in the case of the structural arrangement in the first example of modification, the sealing portion 2*a* was placed at one of the end surfaces of the sealing member 2. Therefore, it was much better in terms of "how easily unsealable". That is, the amount of force necessary to operate the set lever 8 was roughly 10.6 N, which is very small. Therefore, it was possible to smoothly move the sealing member 2 to unseal the developer outlet 1*a*. In the case of this structural arrangement, unlike the sealing member 2 in the second preferred embodiment, the sealing portion 2*a* does not rub the inward surface of the small diameter portion 1*a*. Therefore, the amount of force necessary to move the sealing member 2 to unseal the developer outlet 1*a* is smaller by the amount of force necessary to rub the inward surface of the small diameter portion 1*a*. Further, in the case of the first example of the conventional apparatus, if the sealing portion 2*a* is placed on one of the end surfaces of the sealing member 2 as it is in the first example of modification, it becomes impossible for the sealing member 2 to be locked. Therefore, the developer outlet 1*a* cannot be kept airtightly sealed. Therefore, the sealing portion 2*a* cannot be placed on one of the end surfaces of the sealing member 2.

The employment of the locking structure in this preferred embodiment made possible the modifications such as the above described ones, greatly contributing to the improvement of the developer supply container 1 and apparatus main assembly 100 in terms of the usability in the operation for inserting the developer supply container 1 into the apparatus main assembly 100 and the operation for removing the developer supply container 1 from the apparatus main assembly 100.

Next, the second preferred embodiment, and its second and third versions of modifications, will be described, in comparison with the first example of the conventional apparatus, in terms of the "developer discharging performance".

According to the results of the experiment for examining the "discharge controlling effect", the flushing amount in the second preferred embodiment was roughly 140 g. According to the results of the experiment for examining the "developer loosening effect", the length of time it took for the developer to begin to be smoothly discharged from the developer supply container 1 was 130 seconds.

According to the results of the experiment for examining the "discharge controlling effect", the flushing amount in the second of (FIG. 51) the modified versions of the preferred embodiment was roughly 210 g. According to the results of the experiment for examining the "developer loosening effect", the length of time it took for the developer to begin to be smoothly discharged from the developer supply container 1 was 180 seconds.

According to the results of the experiment for examining the "discharge controlling effect", the third (FIG. 52) of the modified versions of the preferred embodiment was roughly 55 g in the flushing amount. According to the results of the experiment for examining the "developer loosening effect", the length of time it took for the developer to begin to be smoothly discharged from the developer supply container 1 was 60 seconds.

Also according to the results of the experiment for examining the "discharge controlling effect", the first example of the conventional image forming apparatus, which did not have the connective portion 3*d* and unlocking portion 3*b*, was roughly 300 g in the flushing amount. According to the results of the experiment for examining the "developer loosening effect", the length of time it took for the developer to begin to be smoothly discharged from the developer supply container 1 was 250 seconds.

As will be evident from the results of the experiment for examining the "discharge controlling effect", the more aggressive the connective portion 3*d* and unlocking portion 3*b* in terms of the shape for regulating the discharging of the developer, the smaller the amount of flushing. That is, the second of the modified version, second preferred embodiment, and third of the modified version, were smaller in the amount of flushing in the listed order. That is, they were roughly 210 g, 140 g, and 55 g in the amount of flushing, whereas the first example of the conventional apparatus was roughly 300 g in the amount of flushing.

Regarding this flushing phenomenon, if the amount of flushing is large, the fluidized developer flows into the toner buffer by a large amount when the sealing member 2 is moved to unseal the developer outlet 1*a* in the image forming apparatus, making it possible for the developer to overflow from the toner buffer 25. Therefore, the amount of flushing is desired to be as small as possible. In particular, in recent years, image forming apparatuses have been reduced in size, and therefore, the toner buffers 25 also have been reduced in size. Therefore, the employment of the structural arrangements in the preferred embodiments or the modified version of the preferred embodiments makes it possible to reduce the amount of flushing by utilizing a part of the unlocking regulating member 3, with the use of a very simple and compact structural arrangement. Incidentally, the amount of flushing can be set based on the developer specification, image forming apparatus specification, and image forming apparatus structure, as described before.

Next, regarding the "loosening effect", the following became evident about the length of time it takes for the developer having compacted in the developer supply container 1, to become loose and begin to be discharged.

That is, in the case of the first example of the conventional image forming apparatus, it took roughly 250 seconds for the compacted developer to be loosened and begin to be discharged, whereas in the case of the second example of modification, second preferred embodiment, and third example of modification, which are listed in the order of the size of the area of contact between the combination of the connective portion 3*d* and unlocking portion 3*b*, and the developer, it took roughly 180 seconds, 130 seconds, and 60 seconds, respectively. That is, the larger the area of contact, the shorter the length of time it took for the compacted developer to loosen and begin to be discharged. This occurred because when the unlocking regulating member 3 was moved relative to the container proper 24, the connective portion 3*d* and unlocking portion 3*b* loosened the developer in the adjacencies of the developer outlet 1*a*, and therefore, it became easier for the developer in the container proper 24 to be discharged. The shorter the length of time it takes for the developer to begin to be discharged, the faster the developer is supplied to the toner buffer 25 after the replacement of the developer supply container 1, and therefore, the shorter the downtime of the image forming apparatus.

In the case of the first example of the conventional apparatus, which does not have the developer loosening means, if the developer is in the contacted state, an operator may have to wait as long as roughly 250 seconds before the apparatus becomes ready for image formation. In comparison, however, by employing one of the structural arrangements in the preferred embodiments and their modified version, the length of time an operator has to wait before the operator can begin to form an image after the replacement of the developer supply container 1 can be significantly reduced by using a part or parts of the locking structure, being therefore able to contribute to the usability of the image forming apparatus.

In the case of the second of the modified versions of the preferred embodiment, its connective portion 3*d* and unlocking portion 3*b* were made smaller than those in the second preferred embodiment so that the developer flow was regulated as little as possible. Thus, if it is desired to ensure, by not regulating the developer flow, that the developer is discharged by a preset amount, it is preferable that a structural arrangement, such as the one in the second modified version, is employed.

It is evident from the evaluation of the image forming apparatuses in the above described preferred embodiments, modified versions of the preferred embodiments, and the conventional image forming apparatus, that the developer supply container 1 in accordance with the present invention is superior in function to any of the developer supply container 1 based on the conventional technologies.

According to the present invention, in order to separate the "airtightly sealing" function of the sealing portion 2*a* of the sealing member 2, from the "accidental unsealing preventing" function of the sealing portion 2*a*, the developer supply container 1 is provided with the unlocking regulating member 3, which ensures that the sealing member 2 remains locked in the developer outlet 1*a*, and also, that the sealing member 2 is unlocked from the developer outlet 1*a* only when the developer supply container 1 is mounted into the apparatus main assembly 100. Therefore, not only does the developer supply container 1 remain "airtightly sealed" when it needs to be, but also, can be "easily unsealed", while being "prevented from being accidentally unsealed". In other words, the present invention can provide the developer supply container 1 which is superior in usability to any of the conventional developer supply containers.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 291560/2008 filed Nov. 13, 2008 which is hereby incorporated by reference.

What is claimed is:

1. A developer supply container detachably mountable to an image forming apparatus, said developer supply container comprising:

a rotatable container body provided with an inside space containing a developer, said container body further provided with a portion-to-be-engaged on an inner surface of said container body;

an opening, provided at one end of said container body with respect to a direction of a rotational axis of said container body, configured and positioned to permit discharging of the developer from the inside space;

a sealing portion configured and positioned to seal said opening, said sealing portion being movable relative to said container body in the rotational axis direction between a sealing position for sealing said opening and an unsealing position for unsealing said opening;

an extended portion extended from said sealing portion toward an inside of said container body and movable integrally with said sealing portion in the rotational axis direction, said extended portion being displaceable toward the rotational axis;

an engaging portion provided at a free end portion of said extended portion and engageable with said portion-to-be-engaged; and a limiting portion movable between a limiting position in which displacement of said extended portion toward the rotational axis is limited to substantially hold said sealing portion in the sealing position by engagement between said engaging portion and said portion-to-be-engaged, and a regulation release position in which displacement of said extended portion toward the rotational axis is permitted to permit the relative movement of said sealing portion by disengagement between said engaging portion and said portion-to-be-engaged.

2. A developer supply container according to claim 1, further comprising a release force receiving portion, movable integrally with said limiting portion in the rotational axis direction, configured and positioned to receive, from a releasing member provided in said image forming apparatus, a releasing force for moving said limiting portion from the limiting position to the regulation release position in the rotational axis direction.

3. A developer supply container according to claim 2, further comprising a guide portion configured and positioned to guide movement of said limiting portion in the rotational axis direction.

4. A developer supply container according to claim 3, further comprising an urging member configured and positioned to urge said limiting portion in a direction away from the regulation release position toward the limiting position, wherein said limiting portion is movable from the limiting position to the regulation release position against an urging force of said urging member by the releasing force received by said release force receiving portion.

5. A developer supply container according to claim 4, wherein said limiting portion moves in a direction away from said opening in the rotational axis direction by the releasing force received by said release force receiving portion from said releasing member upon inserting said developer supply container into said image forming apparatus in the rotational axis direction.

6. A developer supply container according to claim 2, wherein a plurality of said extended portions are provided and disposed at different positions about the rotational axis, and a corresponding number of said limiting portions are provided, and wherein said release force receiving portion is common to said limiting portions.

7. A developer supply container according to claim 6, wherein said extended portions are disposed at substantially regular intervals about the rotational axis.

8. A developer supply container according to claim 1, further comprising a coupling portion, provided to be engageable with a driving member provided in said image forming apparatus, configured and positioned to receive a rotating force for rotating said container body from said driving member, said coupling portion being movable integrally with said sealing portion in the rotational axis direction, and a projected portion projected from the inner surface of said container body toward the rotational axis, wherein said extended portion is abuttable to said projected portion to transmit the rotating force received by said coupling portion to said projected portion.

9. A developer supply container according to claim 8, further comprising a feeding portion, provided in said container body, configured and positioned to feed the toner toward said opening with rotation of said container body about the rotational axis.

10. A developer supply container according to claim 1, wherein said extended portion is made of resin material elastically deformable toward the rotational axis, and wherein, when said limiting portion is in the limiting position, said limiting portion limits an elastic deformation of said extended portion toward the rotational axis, and when said limiting portion is in the regulation release position, said limiting portion permits an elastic deformation of said extended portion toward the rotational axis.

11. A developer supply container detachably mountable to an image forming apparatus, said developer supply container comprising:

a rotatable container body provided with an inside space containing a developer, said container body further provided with a portion-to-be-engaged on an inner surface of said container body;

an opening, provided at one end of said container body with respect to a direction of a rotational axis of said container body, configured and positioned to permit discharging of the developer from the inside space;

a sealing portion configured and positioned to seal said opening, said sealing portion being movable relative to said container body in the rotational axis direction between a sealing position for sealing said opening and an unsealing position for unsealing said opening;

an extended portion extended from said sealing portion toward an inside of said container body and movable integrally with said sealing portion in the rotational axis direction, said extended portion being elastically deformable toward the rotational axis;

an engaging portion provided at a free end portion of said extended portion and engageable with said portion-to-be-engaged; and a limiting portion movable between a limiting position in which an elastic deformation of said extended portion toward the rotational axis is limited to substantially hold said sealing portion in the sealing position by engagement between said engaging portion and said portion-to-be-engaged, and a regulation release position in which an elastic deformation of said extended portion toward the rotational axis is permitted to permit the relative movement of said sealing portion by disengagement between said engaging portion and said portion-to-be-engaged.

12. A developer supply container according to claim 11, further comprising a release force receiving portion, movable integrally with said limiting portion in the rotational axis direction, configured and positioned to receive, from a releasing member provided in said image forming apparatus, a releasing force for moving said limiting portion from the limiting position to the regulation release position in the rotational axis direction.

13. A developer supply container according to claim 12, further comprising an urging member configured and positioned to urge said limiting portion in a direction away from the regulation release position toward the limiting position, wherein said limiting portion is movable from the limiting position to the regulation release position against an urging force of said urging member by the releasing force received by said release force receiving portion.

14. A developer supply container according to claim 11, further comprising a coupling portion, provided to be engageable with a driving member provided in said image forming apparatus, configured and positioned to receive a rotating force for rotating said container body from said driving member, said coupling portion being movable integrally with said sealing portion in the rotational axis direction, and a projected portion projected from the inner surface of said container body toward the rotational axis, wherein said extended portion is abuttable to said projected portion to transmit the rotating force received by said coupling portion to said projected portion.

15. A developer supply container according to claim 11, wherein said extended portion is made of resin material elastically deformable toward the rotational axis, and wherein, when said limiting portion is in the limiting position, said limiting portion limits the elastic deformation of said extended portion toward the rotational axis, and when said limiting portion is in the regulation release position, said limiting portion elastically deforms said extended portion toward the rotational axis.

* * * * *